US009764557B2

(12) United States Patent
Miyamoto et al.

(10) Patent No.: US 9,764,557 B2
(45) Date of Patent: Sep. 19, 2017

(54) RECORDING APPARATUS

(71) Applicant: SEIKO EPSON CORPORATION, Tokyo (JP)

(72) Inventors: Yuji Miyamoto, Shiojiri (JP); Satoshi Iwaya, Ina (JP); Masaki Shimomura, Matsumoto (JP); Tokujiro Okuno, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/123,617

(22) PCT Filed: Feb. 25, 2015

(86) PCT No.: PCT/JP2015/000970
§ 371 (c)(1),
(2) Date: Sep. 2, 2016

(87) PCT Pub. No.: WO2015/136868
PCT Pub. Date: Sep. 17, 2015

(65) Prior Publication Data

US 2017/0087859 A1 Mar. 30, 2017

(30) Foreign Application Priority Data

Mar. 14, 2014 (JP) ..... 2014-050941

(51) Int. Cl.
*B41J 2/175* (2006.01)
*B41J 2/21* (2006.01)

(52) U.S. Cl.
CPC ..... *B41J 2/17526* (2013.01); *B41J 2/21* (2013.01)

(58) Field of Classification Search
CPC ..... B41J 2/17526; B41J 2/21
See application file for complete search history.

(56) References Cited

U.S. PATENT DOCUMENTS

2003/0170042 A1* 9/2003 Okamoto ..... B41J 2/17526 399/90
2010/0309256 A1* 12/2010 Kim ..... B41J 2/17513 347/50

FOREIGN PATENT DOCUMENTS

JP 2009-202346 9/2009

OTHER PUBLICATIONS

ISR and Written Opinion dated Apr. 23, 2015 for PCT/JP2015/000970.

* cited by examiner

*Primary Examiner* — Lisa M Solomon
(74) *Attorney, Agent, or Firm* — Workman Nydegger

(57) ABSTRACT

In a configuration in which an ink accommodating portion is provided on the outside of an apparatus main body, both improvement of maintenance and suppressing of performance deterioration of the apparatus are achieved.
A recording apparatus includes a recording head that is capable of discharging liquid onto a medium, a controller that controls the recording head, a housing that covers a structure including the recording head and the controller, a case that stores a liquid accommodating member accommodating the liquid and an electronic component holding information of the liquid accommodating member, and is attached to the outside of the housing, a tube that guides the liquid from the liquid accommodating member to the inside of the housing, and an electric wiring that electrically connects the controller and the electronic component, in which the electric wiring includes a connection portion which connects cables, a cable on the controller side which constitutes a wiring of the controller side with respect to the connection portion, and a cable on the electronic component side which constitutes a wiring of the electronic component side with respect to the connection portion, and at least one (Continued)

of the cable on the controller side and the cable on the electronic component side is able to be connected to and disconnected from the connection portion.

13 Claims, 45 Drawing Sheets

RECORDING APPARATUS

TECHNICAL FIELD

The present invention relates to a recording apparatus which performs recording on a medium.

BACKGROUND ART

Hereinafter, an ink jet printer will be described as an example of a recording apparatus. In an ink jet printer disclosed in PTL 1, an external ink supplying device is provided on the outside of the printer, and an amount of ink able to be accommodated can be increased. An ink bag and the printer main body included in the external ink supplying device are connected through an ink supplying tube.

CITATION LIST

Patent Literature

PTL 1: Japanese Unexamined Patent Application Publication No. 2009-202346

SUMMARY OF INVENTION

Technical Problem

Here, in an ink accommodating portion (external ink supplying device in example of PTL 1 described above), there is a case in which an ink accommodating member (ink bag) is provided for each ink color, each of the ink accommodating members can be exchanged, and in each ink accommodating member, a storage medium (electronic component) which holds information of types (color and capacity) of ink, a remaining ink amount, or the like is provided in each ink bag. In this case, a controller (main substrate) of a printer and the storage medium are electrically connected through a cable.

In the meantime, in a case in which the ink accommodating portion is provided on the outside of the apparatus, it is also considered that the ink accommodating portion is installed on a side surface of a housing constituting an exterior of the printer. In a case of such a configuration, at the time of performing maintenance of an apparatus main body of a printer, the ink accommodating portion is required to be detached from the housing, first.

At this time, if the cable is wired without extra length, the cable is required to be detached from a controller (main substrate) of the printer before detaching the ink accommodation portion, or the like, and thus work takes labor and time. Meanwhile, it is not preferable that the cable has extra length in order to avoid such maintenance deterioration, since an influence of noise is likely to be significant in response to an increase of a length of the cable. Moreover, an influence of noise in response to an increase of a length of the cable in this specification means both of a passive case in which the cable picks up the noise from the outside and an active case in which the cable generates noise.

Here, the invention is made in consideration of such a circumstance, and an object thereof is to achieve compatibility of improvement of maintenance and suppressing of performance deterioration of an apparatus, in a configuration in which an ink accommodating portion is provided on the outside of an apparatus main body.

Solution to Problem

According to a first aspect of the invention, there is provided a recording apparatus including a recording head that is capable of discharging liquid onto a medium, a controller that controls the recording head, a housing that covers a structure including the recording head and the controller, a case that stores a liquid accommodating member accommodating the liquid and an electronic component holding information of the liquid accommodating member, and is attached to the outside of the housing, a tube that guides the liquid from the liquid accommodating member to the inside of the housing, and an electric wiring that electrically connects the controller and the electronic component, in which the electric wiring includes a connection portion which connects cables, a cable on the controller side which constitutes a wiring of the controller side with respect to the connection portion, and a cable on the electronic component side which constitutes a wiring of the electronic component side with respect to the connection portion, at least one of the cable on the controller side and the cable on the electronic component side is able to be connected to and disconnected from the connection portion, an opening through which the electric wiring passes is formed in the case, and the connection portion is provided between the opening and the electronic component.

According to the aspect, the electric wiring which electrically connects the controller and the electronic component includes the connection portion, and is capable of disconnecting the cable on the electronic component side or the cable on the controller side in the connection portion. Accordingly, even when the electric wiring is shortened, the case can be easily separated from the housing. That is, both improvement of maintenance of the apparatus and suppressing of performance deterioration of the apparatus can be achieved.

According to a second aspect of the invention, there is provided a recording apparatus including a recording head that is capable of discharging liquid onto a medium, a controller that controls the recording head, a housing that covers a structure including the recording head and the controller, a case that stores a liquid accommodating member accommodating the liquid and an electronic component holding information of the liquid accommodating member, and is attached to the outside of the housing, a tube that guides the liquid from the liquid accommodating member to the inside of the housing, and an electric wiring that electrically connects the controller and the electronic component, in which the electric wiring includes a connection portion which connects cables, a cable on the controller side which constitutes a wiring of the controller side with respect to the connection portion, and a cable on the electronic component side which constitutes a wiring of the electronic component side with respect to the connection portion, at least one of the cable on the controller side and the cable on the electronic component side is able to be connected to and disconnected from the connection portion, an opening through which the electric wiring passes is formed in the housing, and the connection portion is provided between the opening and the controller.

According to the aspect, the electric wiring which electrically connects the controller and the electronic component includes the connection portion, and is capable of disconnecting the cable on the electronic component side or the cable on the controller side in the connection portion. Accordingly, even when the electric wiring is shortened, the case can be easily separated from the housing. That is, both improvement of maintenance of the apparatus and suppressing of performance deterioration of the apparatus can be achieved.

According to a third aspect of the invention, in the recording apparatus related to the first or second aspect, the connection portion is configured with a circuit substrate.

According to a fourth aspect of the invention, in the recording apparatus related to the third aspect, a plurality of the liquid accommodating members are provided inside the case, and the electronic component and the cable on the electronic component side are provided in each of the plurality of liquid accommodating members, and the circuit substrate is capable of connecting a plurality of the cables on the electronic component side and one cable on the controller side, and relays transmitting and receiving of the information between a plurality of the electronic components and the controller using the one cable on the controller side.

According to the aspect, the plurality of cables on the electronic component side are connected to the circuit substrate, that is, are aggregated, and connected to the controller by one cable on the controller side. Therefore, compared to a configuration in which each of the plurality of electronic components is connected to the controller, a length of the cable can be shortened, and thus influence of noise can be suppressed to be minimum amount.

According to a fifth aspect of the invention, in the recording apparatus related to the fourth aspect, the circuit substrate is fixed to the inside of the opening.

According to the aspect, since the circuit substrate is fixed to the inside of the opening, that is, to a position near the opening, a work of connection and disconnection of the cable on the electronic component side or the cable on the controller side can be further easily performed.

According to a sixth aspect of the invention, in the recording apparatus related to the fourth or fifth aspect, the plurality of cables on the electronic component side are wired in parallel without being overlapped with each other in the inside of the case.

According to the aspect, since the plurality of cables on the electronic component side are wired in parallel without being overlapped in the inside of the case, the plurality of cables on the electronic component side do not receive an influence of noise from each other, or is capable of reducing the influence of noise.

According to a seventh aspect of the invention, in the recording apparatus related to the first or second aspect, the connection portion is configured with a connector.

According to the aspect, since the connection portion is configured with the connector, the connection portion can be configured with a simple structure at a row cost.

DESCRIPTION OF EMBODIMENTS

Hereinafter, an embodiment of the invention will be described on the basis of drawings. Moreover, the same configuration in each embodiment will be given the same numeral, a first example will be described only, and description of a configuration of each of the examples to be described later will be omitted.

First Example

Figure 1:
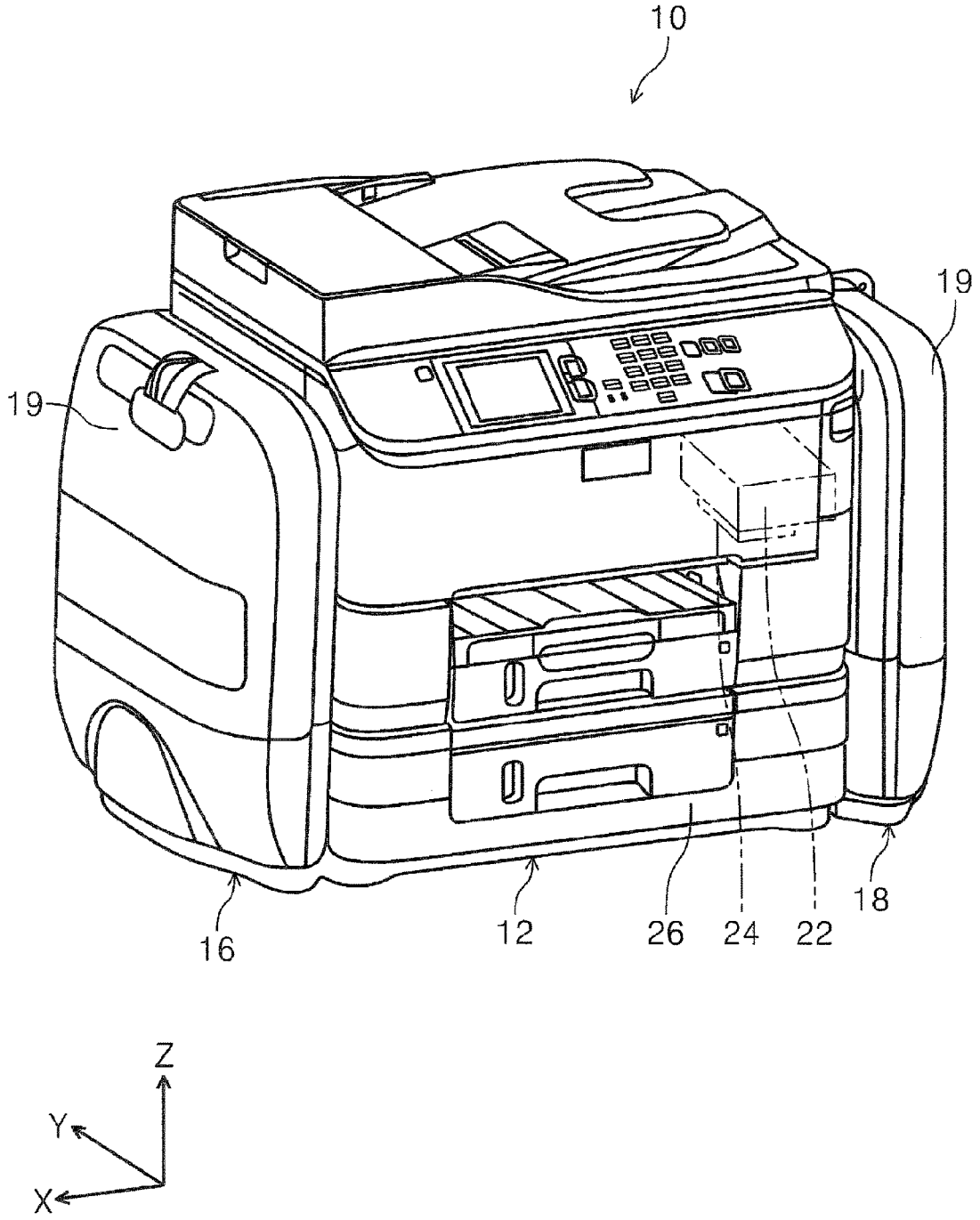
FIG. 1 is an exterior perspective view of a printer according to a first example.
Figure 2:
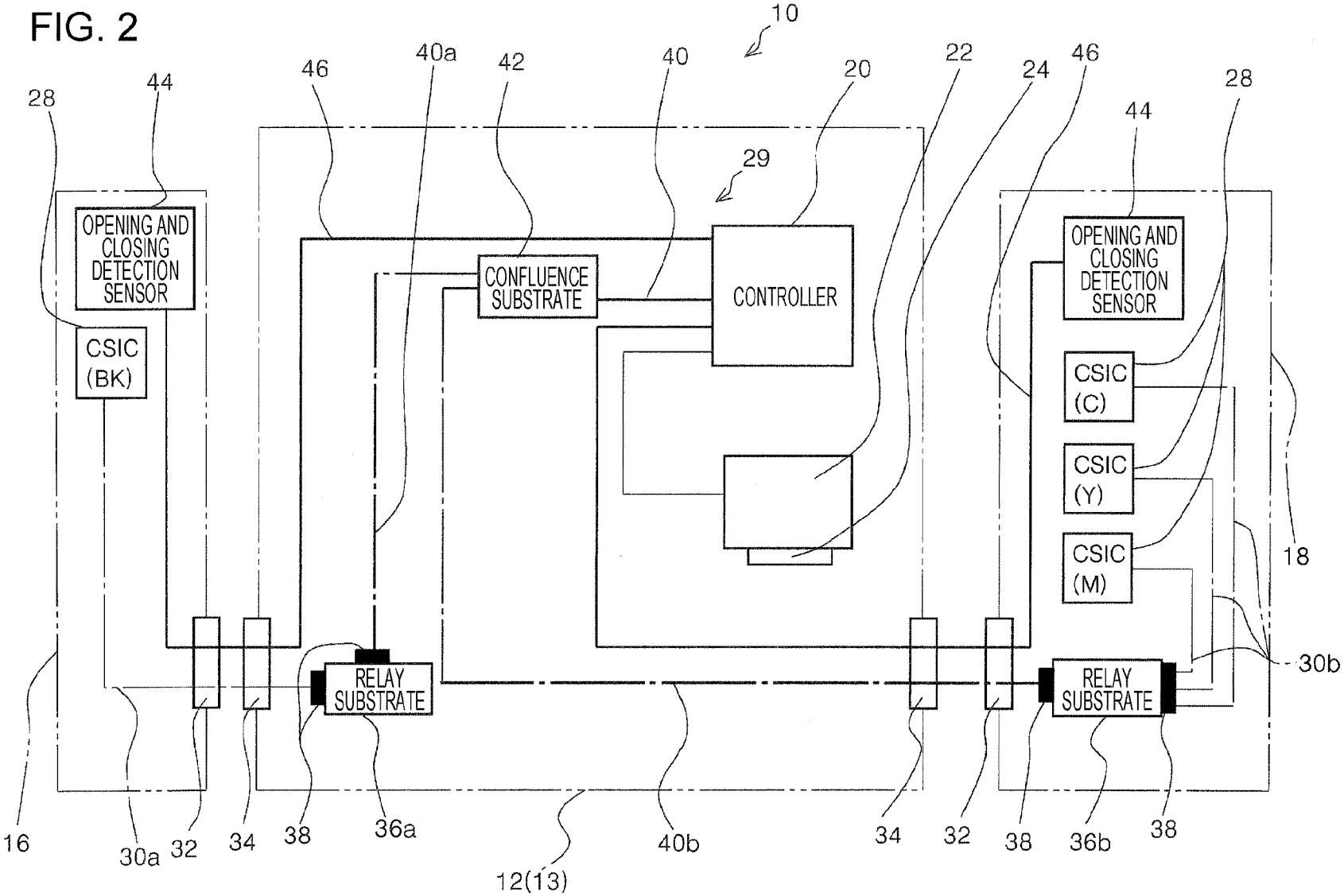
FIG. 2 is a block diagram illustrating an outline of an electric wiring in the printer according to the invention.
Figure 3:
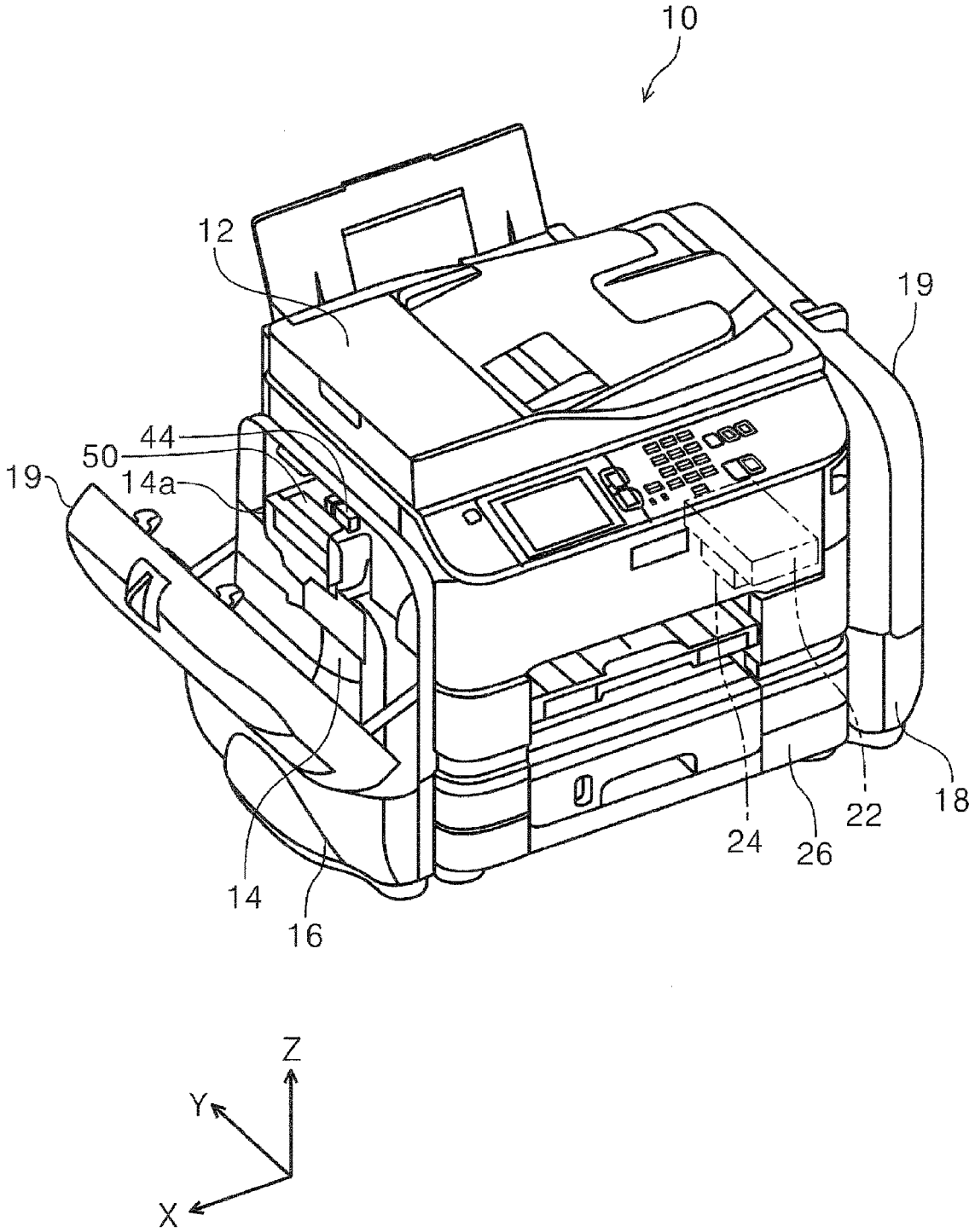
FIG. 3 is a perspective view illustrating an open state of a case of a side storing an ink accommodating member of black ink in the printer according to the first example.
Figure 4:
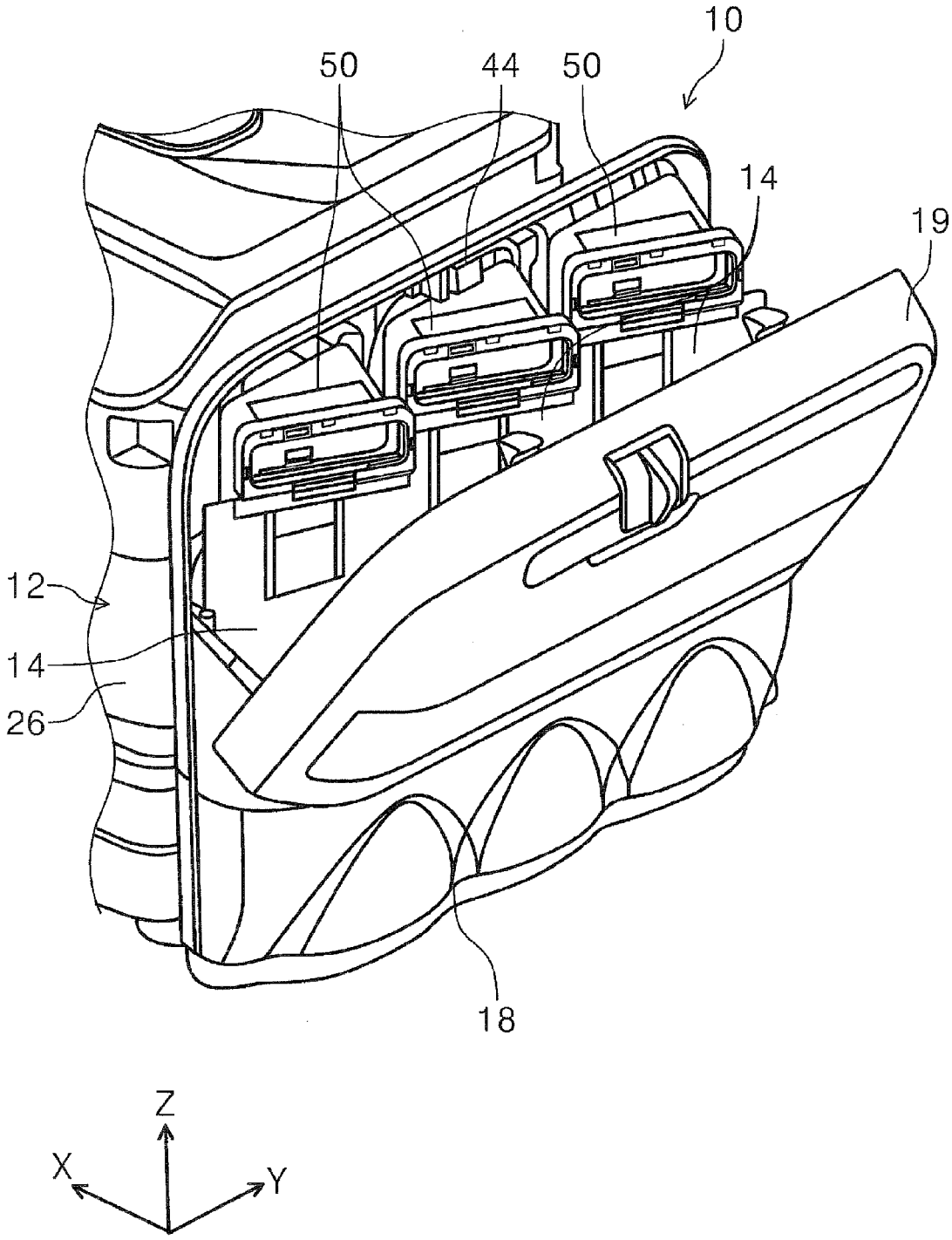
FIG. 4 is a perspective view illustrating an open state of a case of a side storing an ink accommodating member of color ink in the printer according to the first example.
Figure 5:
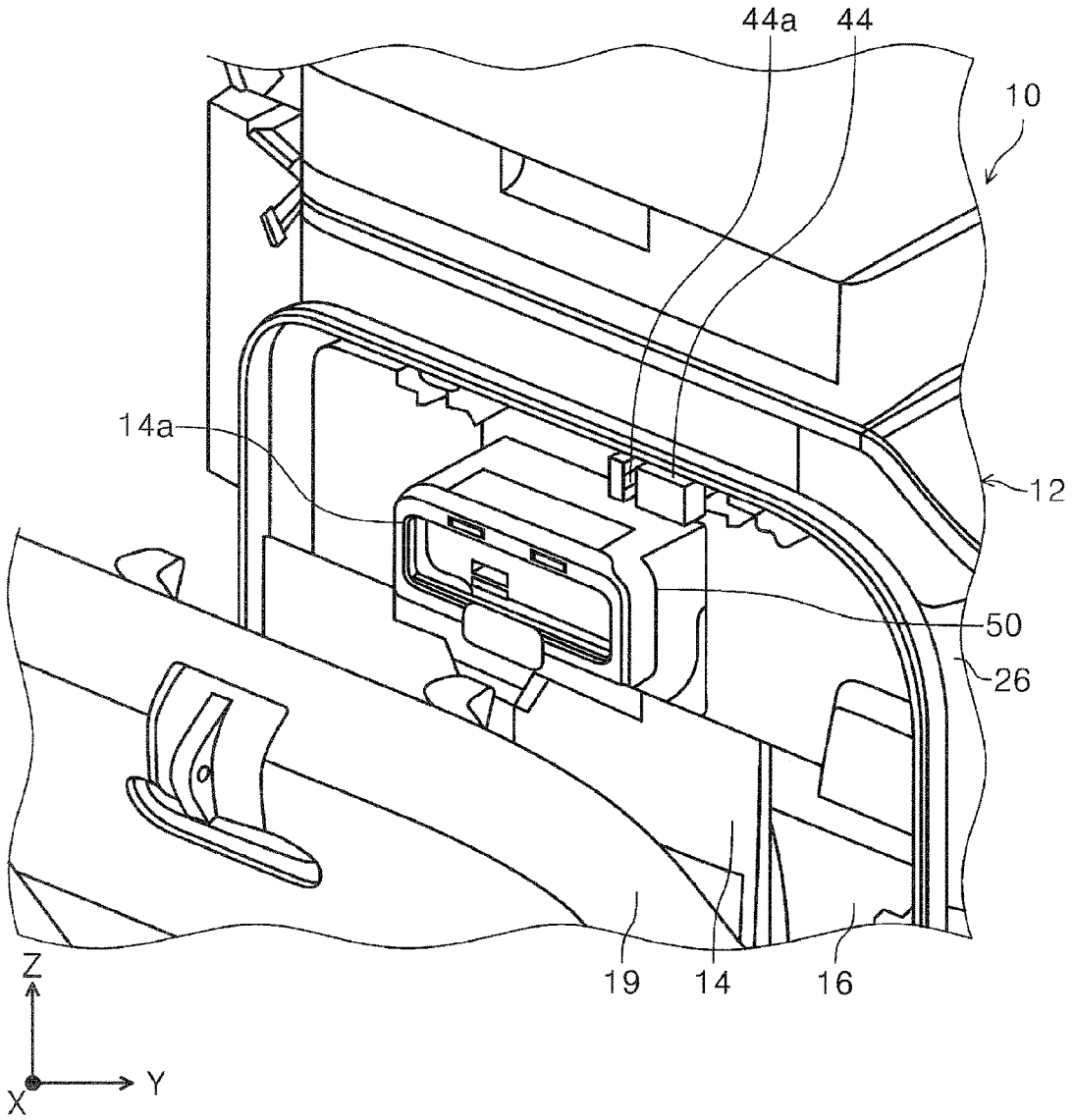
FIG. 5 is an enlarged view of a vicinity of an attaching portion of the ink accommodating member in FIG. 3.

FIG. 1 is an exterior perspective view of a printer (hereinafter, it is referred to as a printer 10) according to the first example, FIG. 2 is a block diagram illustrating an outline of an electric wiring in the printer 10, FIG. 3 is a perspective view illustrating an open state of a case of a side storing an ink accommodating member of black ink in the printer 10, FIG. 4 is a perspective view illustrating an open state of a case of a side storing an ink accommodating member of color ink in the printer 10, and FIG. 5 is an enlarged view of a vicinity of an attaching portion of the ink accommodating member in FIG. 3.

Figure 6:
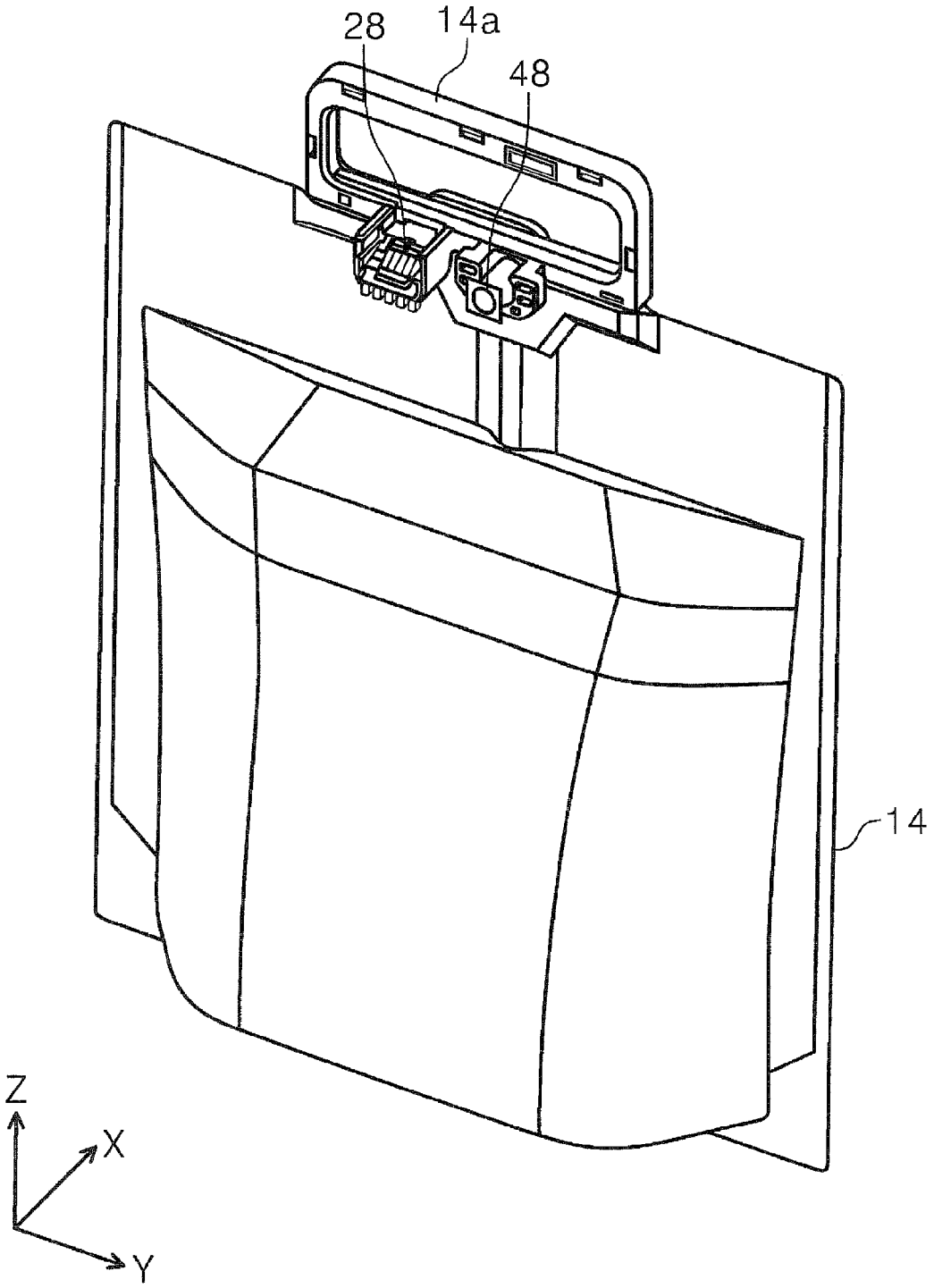
FIG. 6 is an exterior perspective view of the ink accommodating member.
Figure 7:
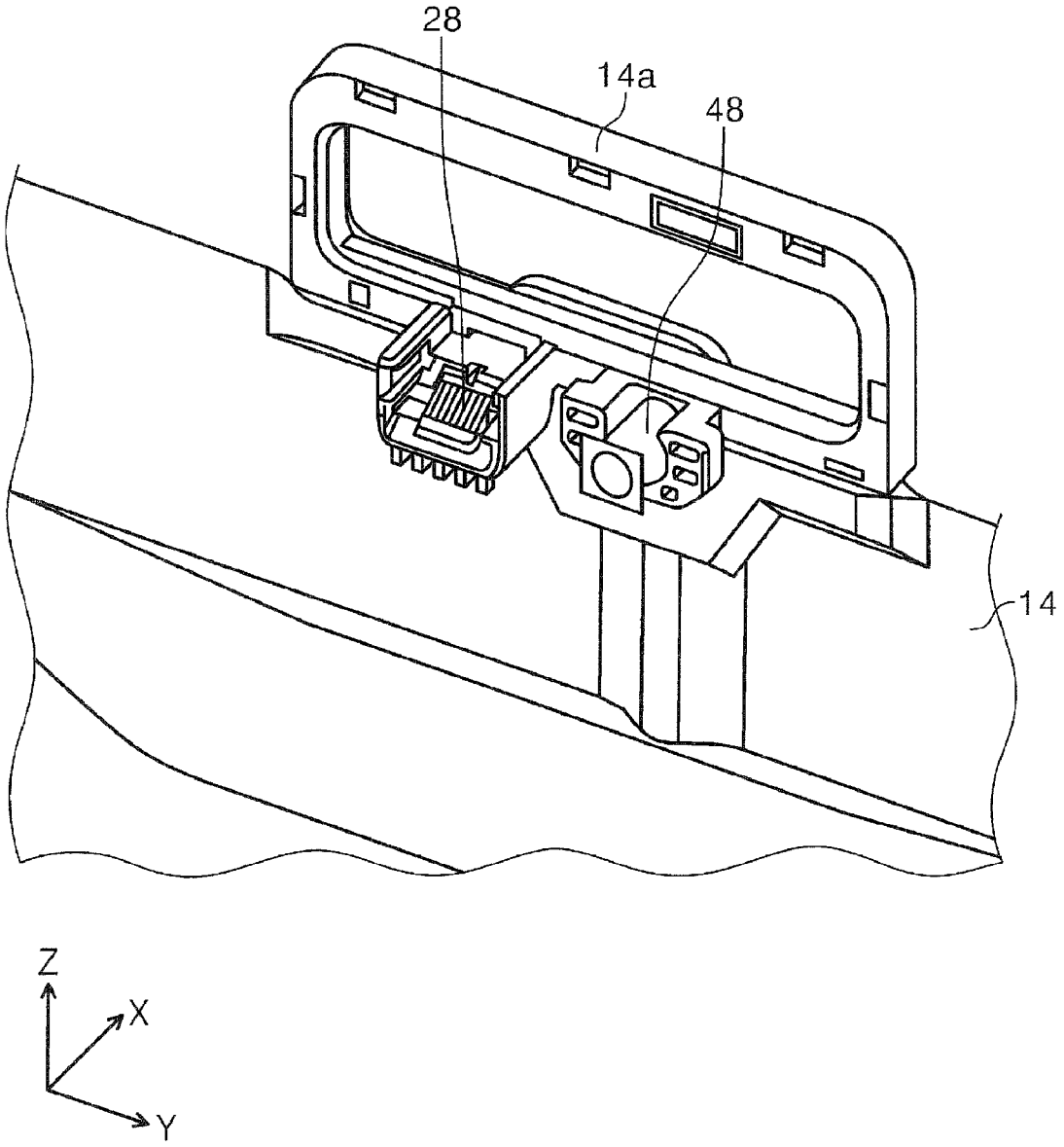
FIG. 7 is an enlarged perspective view of an attaching portion with respect to an ink accommodating member storage case of the ink accommodating member.
Figure 8:
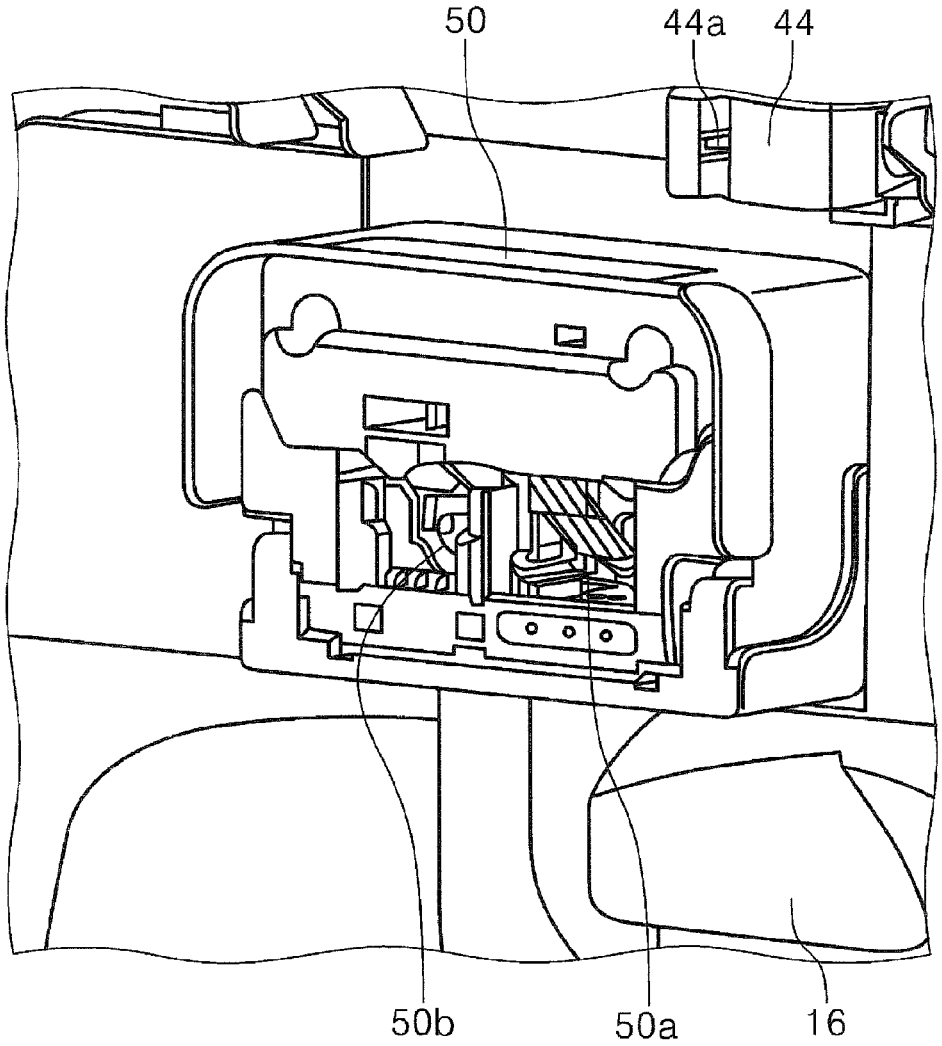
FIG. 8 is an enlarged perspective view of the attaching portion in the ink accommodating member storage case in which the ink accommodating member of the black ink is stored.
Figure 8:
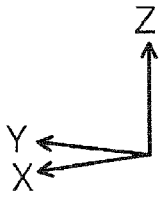
Figure 9:
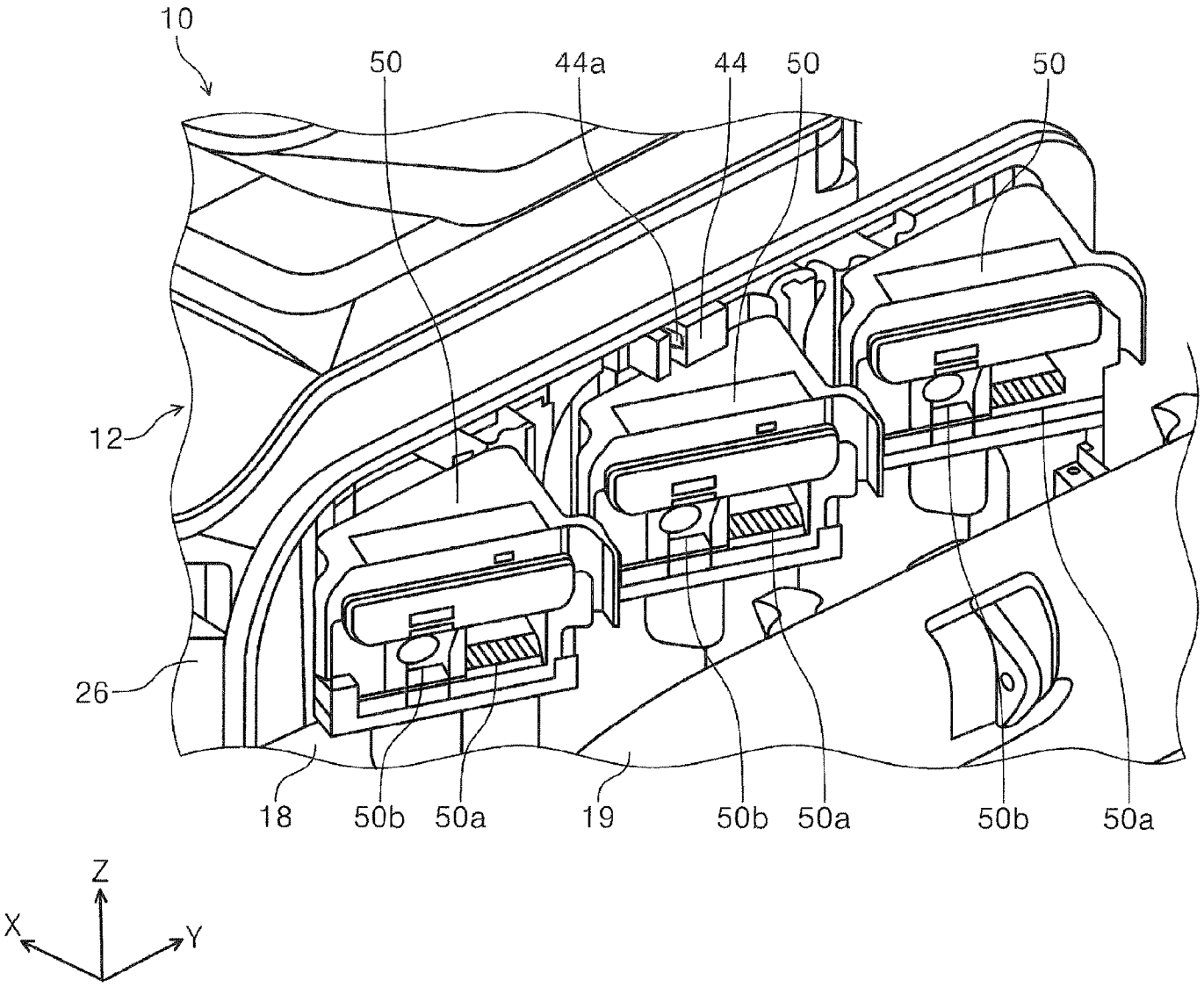
FIG. 9 is an enlarged perspective view of the attaching portion in the ink accommodating member storage case which stores the ink accommodating member of the color ink.
Figure 10:
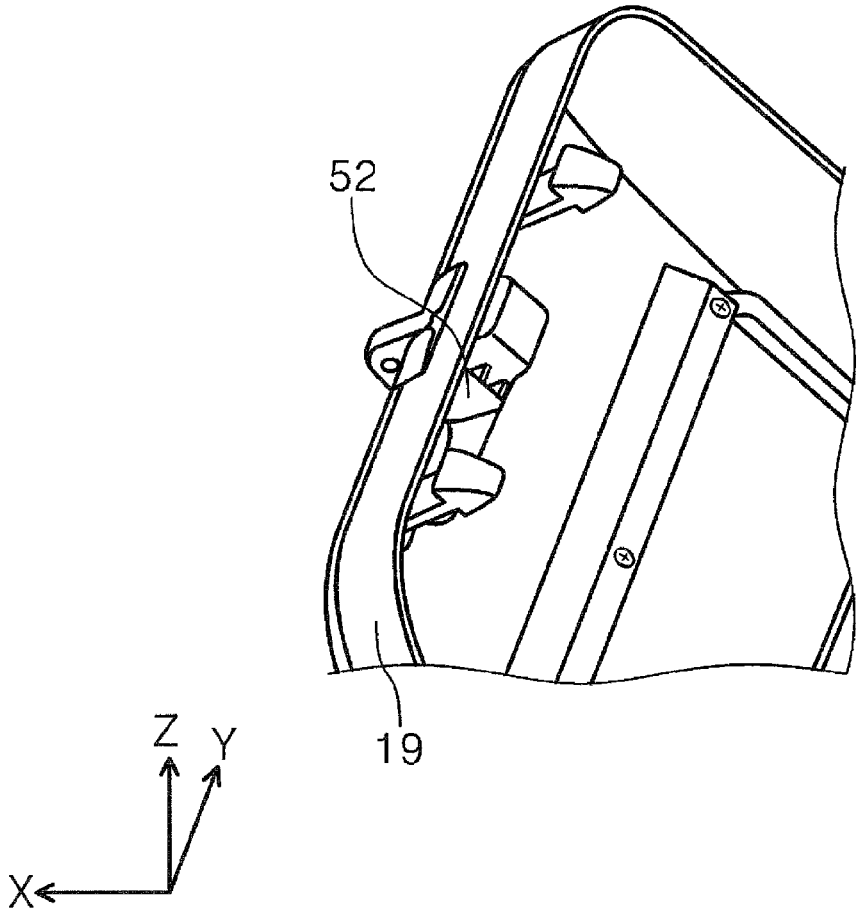
FIG. 10 is a perspective view of an opening and closing cover in the ink accommodating member storage case.

FIG. 6 is an exterior perspective view of the ink accommodating member, FIG. 7 is an enlarged perspective view of the attaching portion with respect to the ink accommodating member storage case of the ink accommodating member, FIG. 8 is an enlarged perspective view of the attaching portion in the ink accommodating member storage case which stores the ink accommodating member of the black ink, FIG. 9 is an enlarged perspective view of the attaching portion in the ink accommodating member storage case which stores the ink accommodating member of the color ink, and FIG. 10 is a perspective view of the opening and closing cover in the ink accommodating member storage case.

Figure 11:
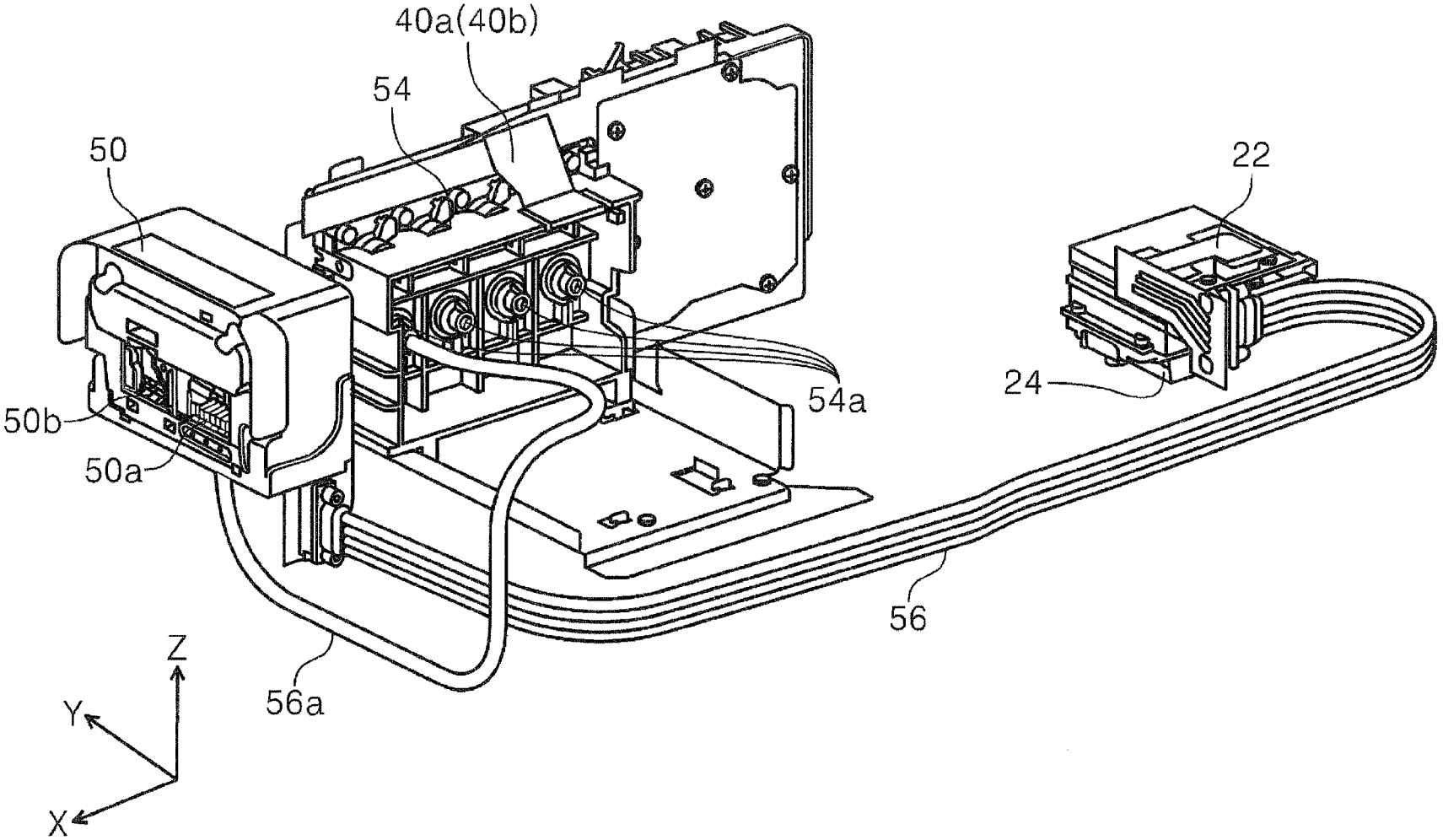
FIG. 11 is a perspective view illustrating a supplying passage of the black ink in the printer according to the first example.
Figure 12:
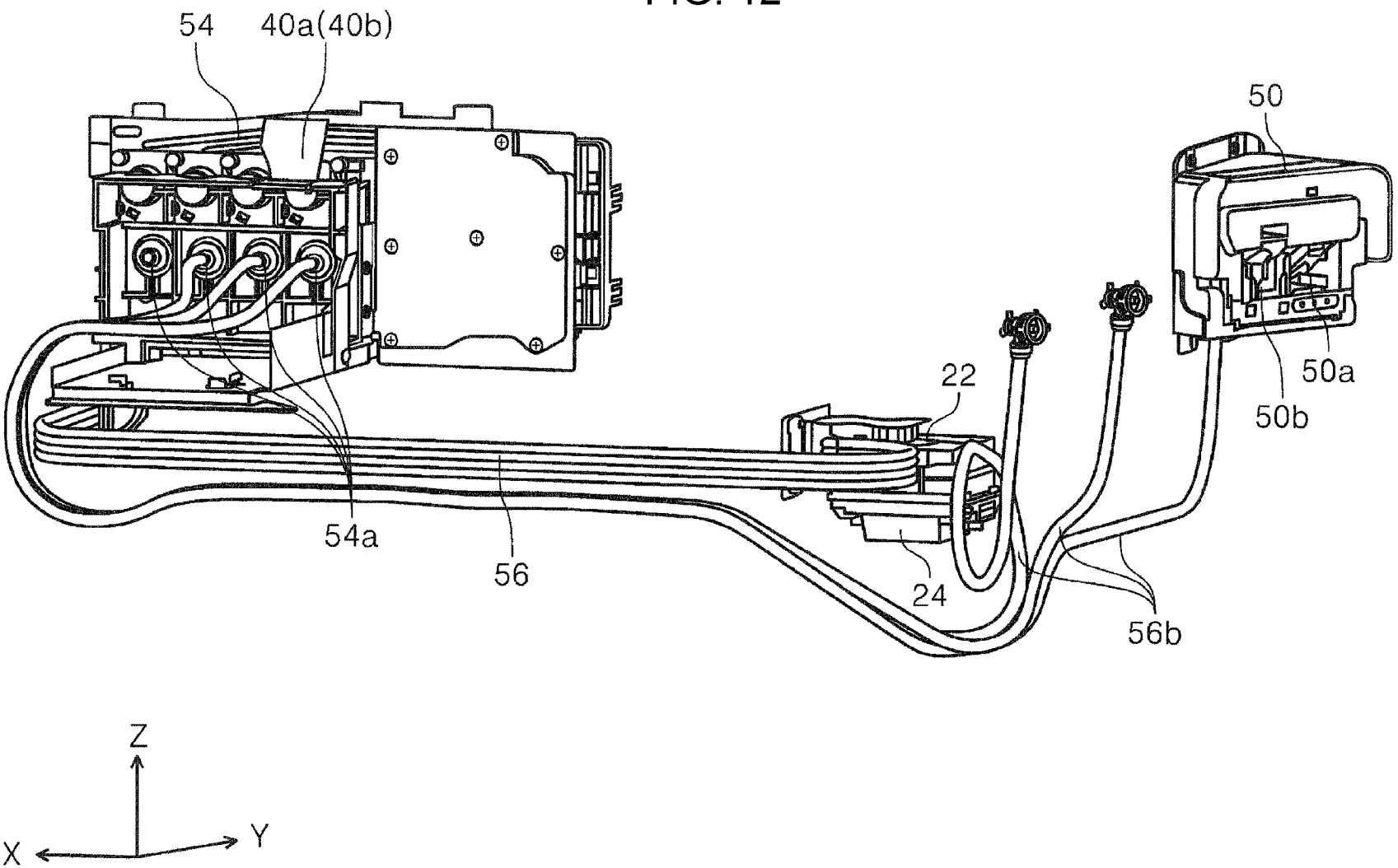
FIG. 12 is a perspective view illustrating a supplying passage of the color ink in the printer according to the first example.
Figure 13:
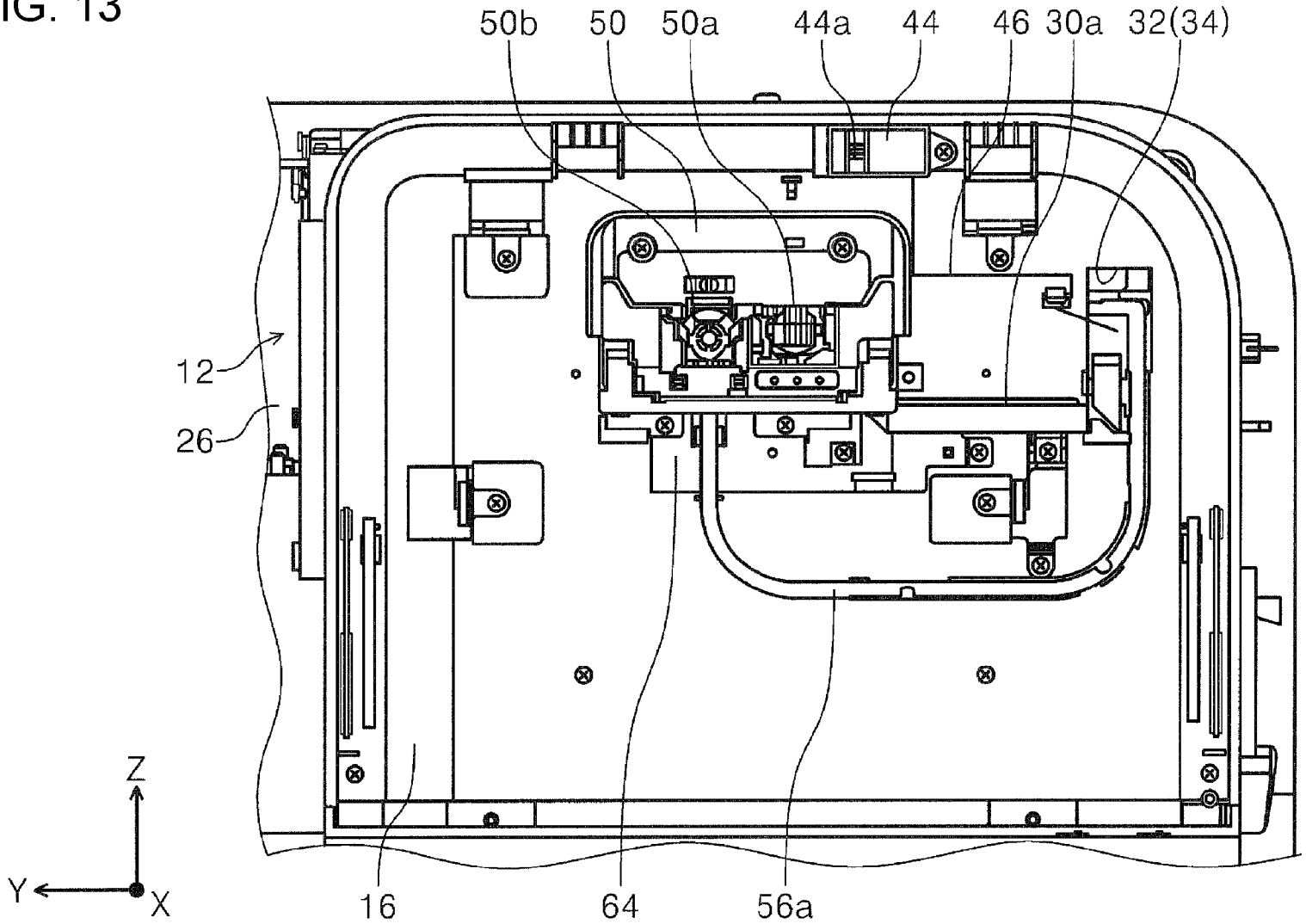
FIG. 13 is a side view illustrating the supplying passage of the black ink from the ink accommodating member storage case which stores the ink accommodating member of the black ink to the inside of the housing.
Figure 14:
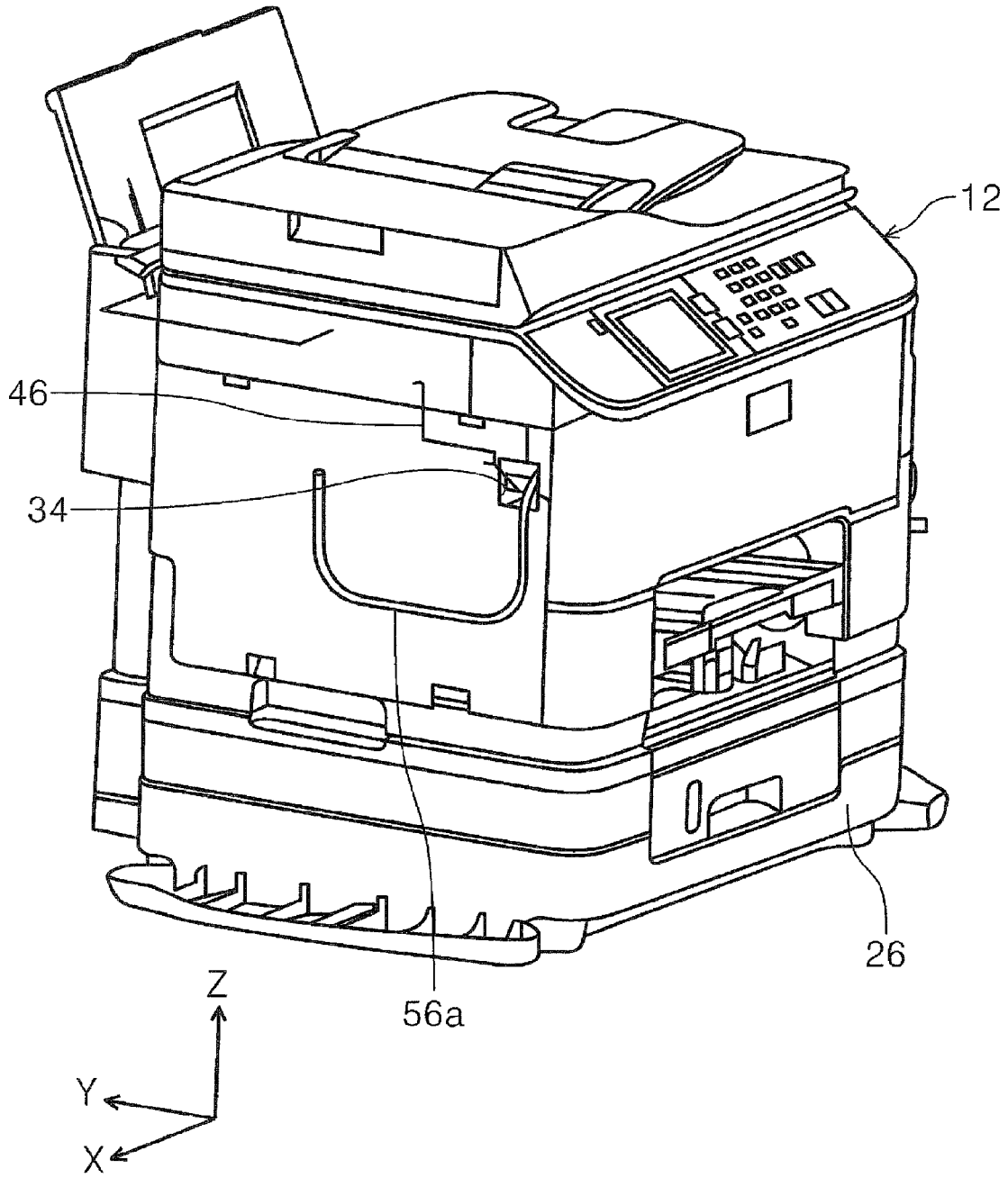
FIG. 14 is a perspective view illustrating an opening which is provided on a side surface of the housing, and guides the ink tube of the black ink extending from the ink accommodating member storage case to the inside of the housing.
Figure 15:
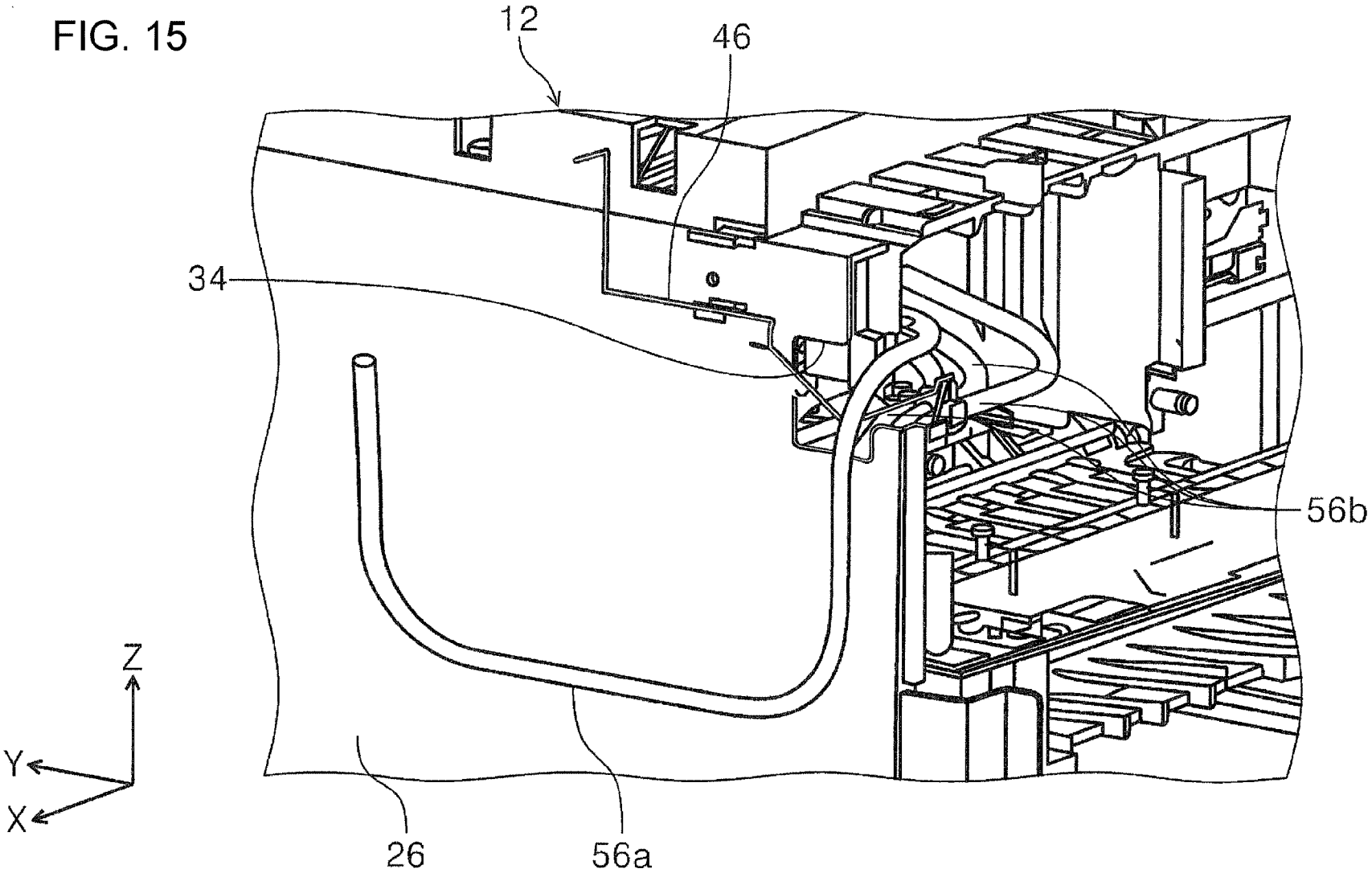
FIG. 15 is an enlarged perspective view of the opening in FIG. 14.

FIG. 11 is a perspective view illustrating a supplying passage of the black ink in the printer 10, FIG. 12 is a perspective view illustrating the supplying passage of the color ink in the printer 10, FIG. 13 is a side view illustrating the supplying passage of the black ink from the ink accommodating member storage case which stores the ink accommodating member of the black ink to the inside of the housing, FIG. 14 is a perspective view illustrating an opening which is provided on a side surface of the housing, and guides the ink tube of the black ink extending from the ink accommodating member storage case to the inside of the housing, and FIG. 15 is an enlarged perspective view of the opening in FIG. 14.

Figure 16:
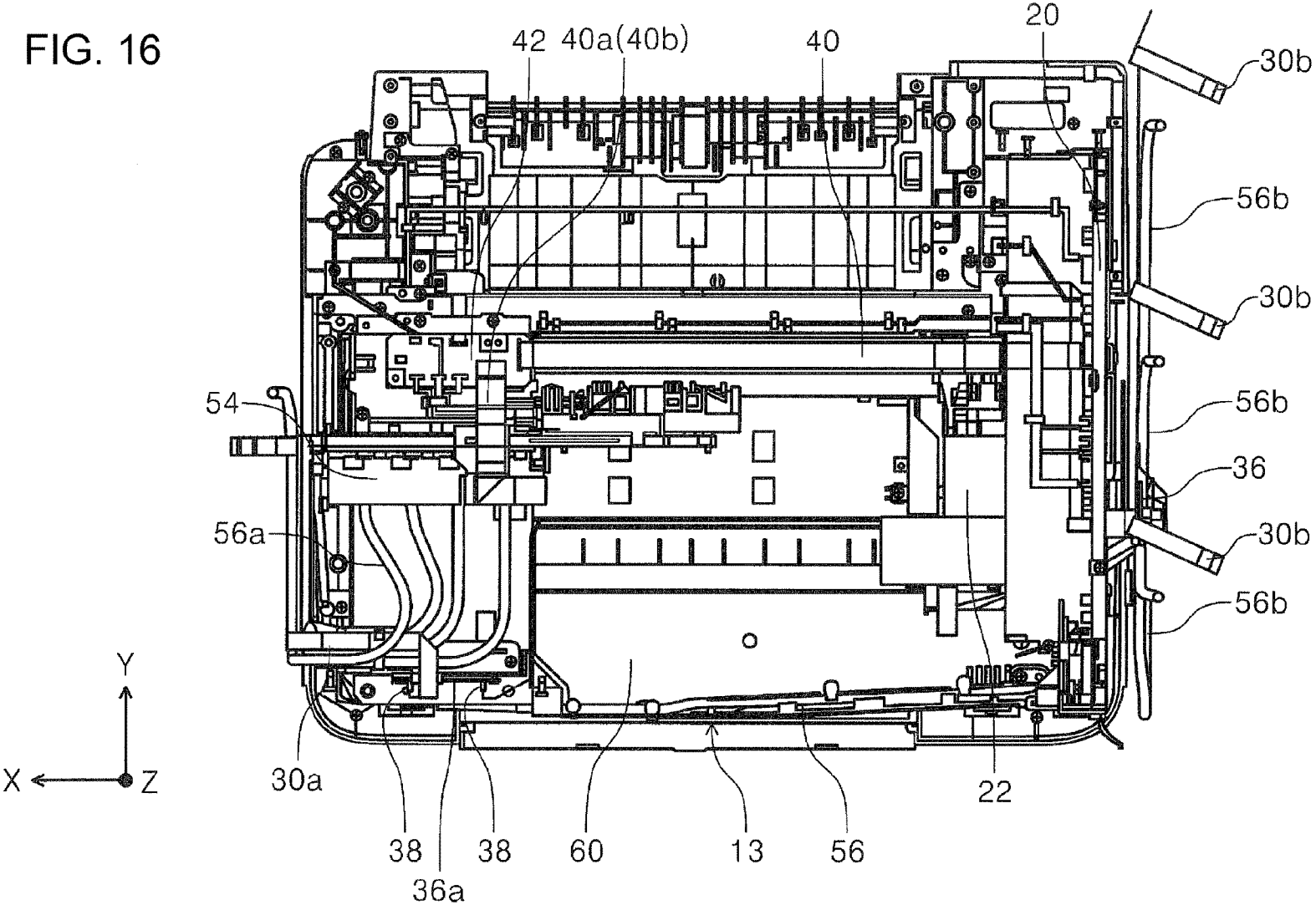
FIG. 16 is a plane view of a structure of the printer according to the first example.
Figure 17:
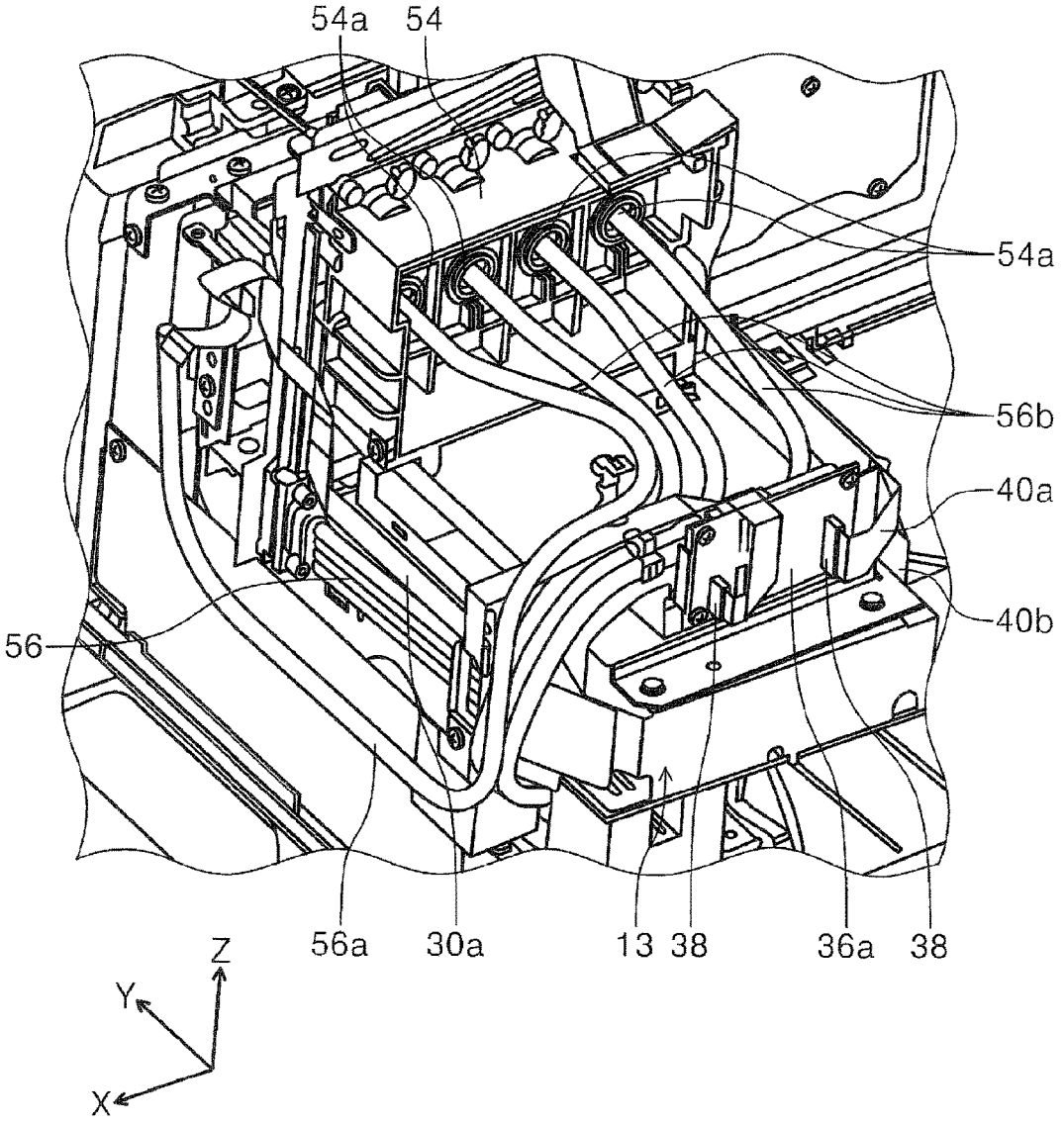
FIG. 17 is a perspective view illustrating an ink relay portion which is provided in the structure.
Figure 18:
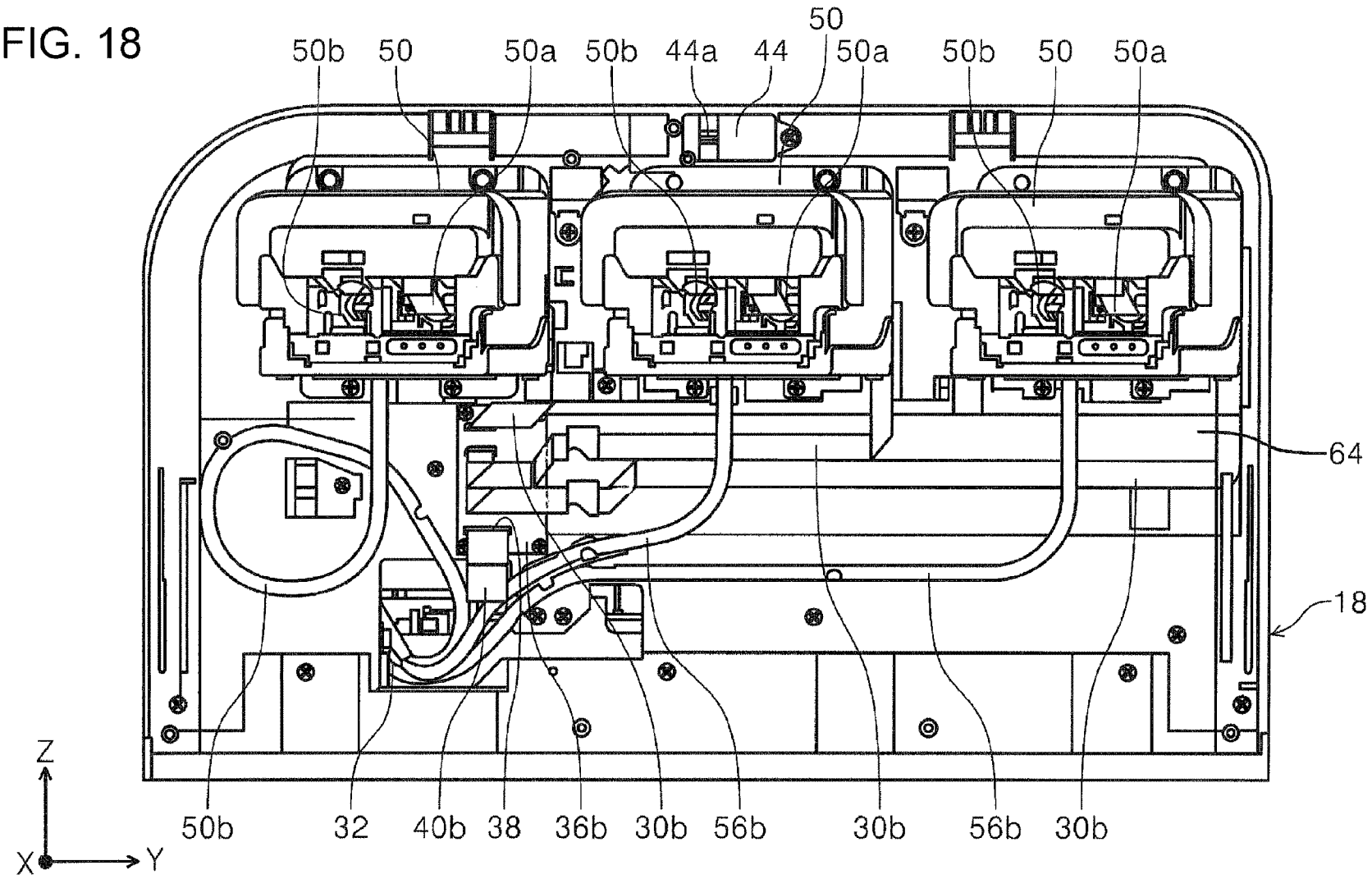
FIG. 18 is a side view illustrating the supplying passage of the color ink from the ink accommodating member storage case which stores the ink accommodating member of the color ink to the inside of the housing.
Figure 19:
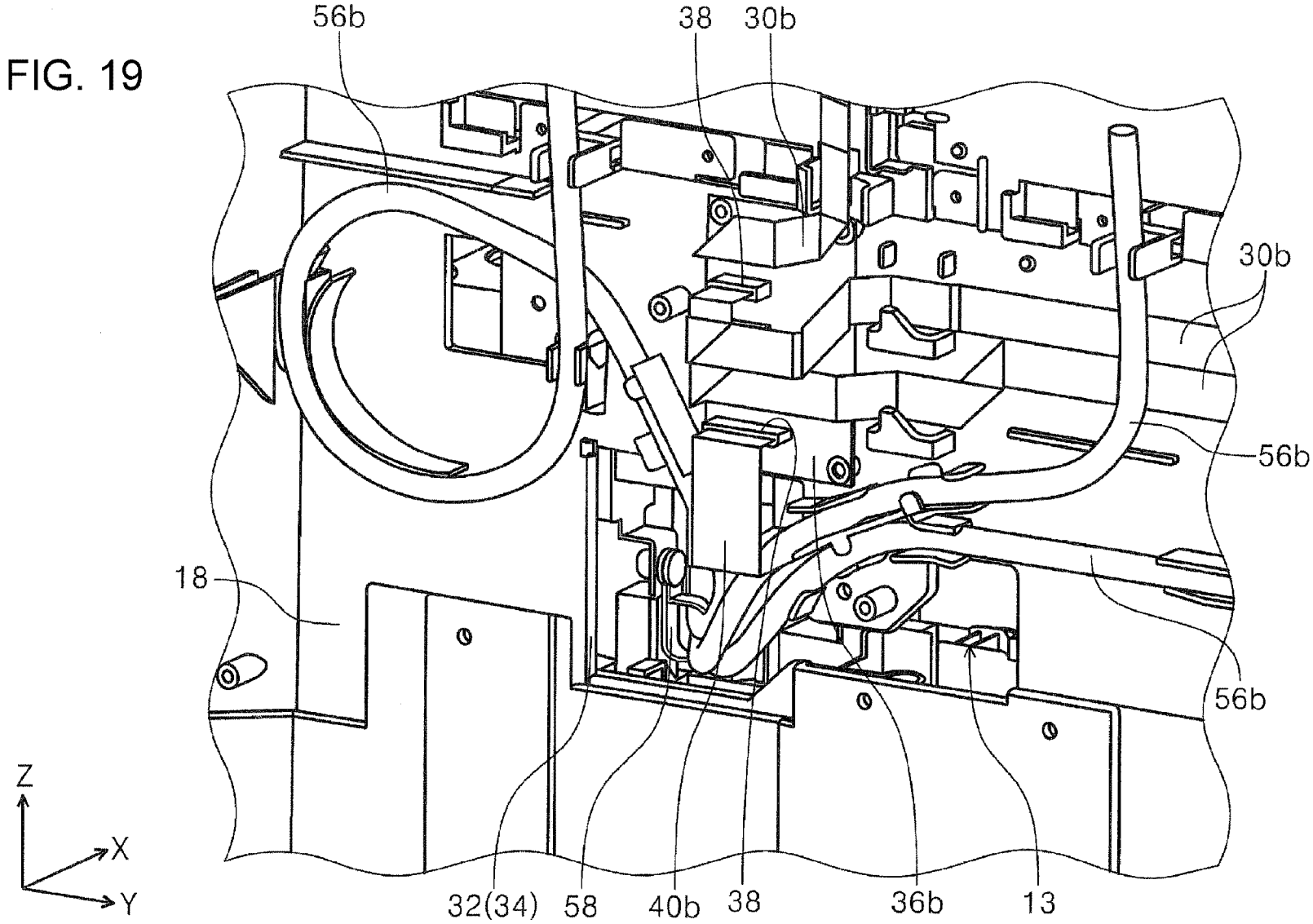
FIG. 19 is an enlarged view of a vicinity of an opening portion in the ink accommodating member storage case.
Figure 20:
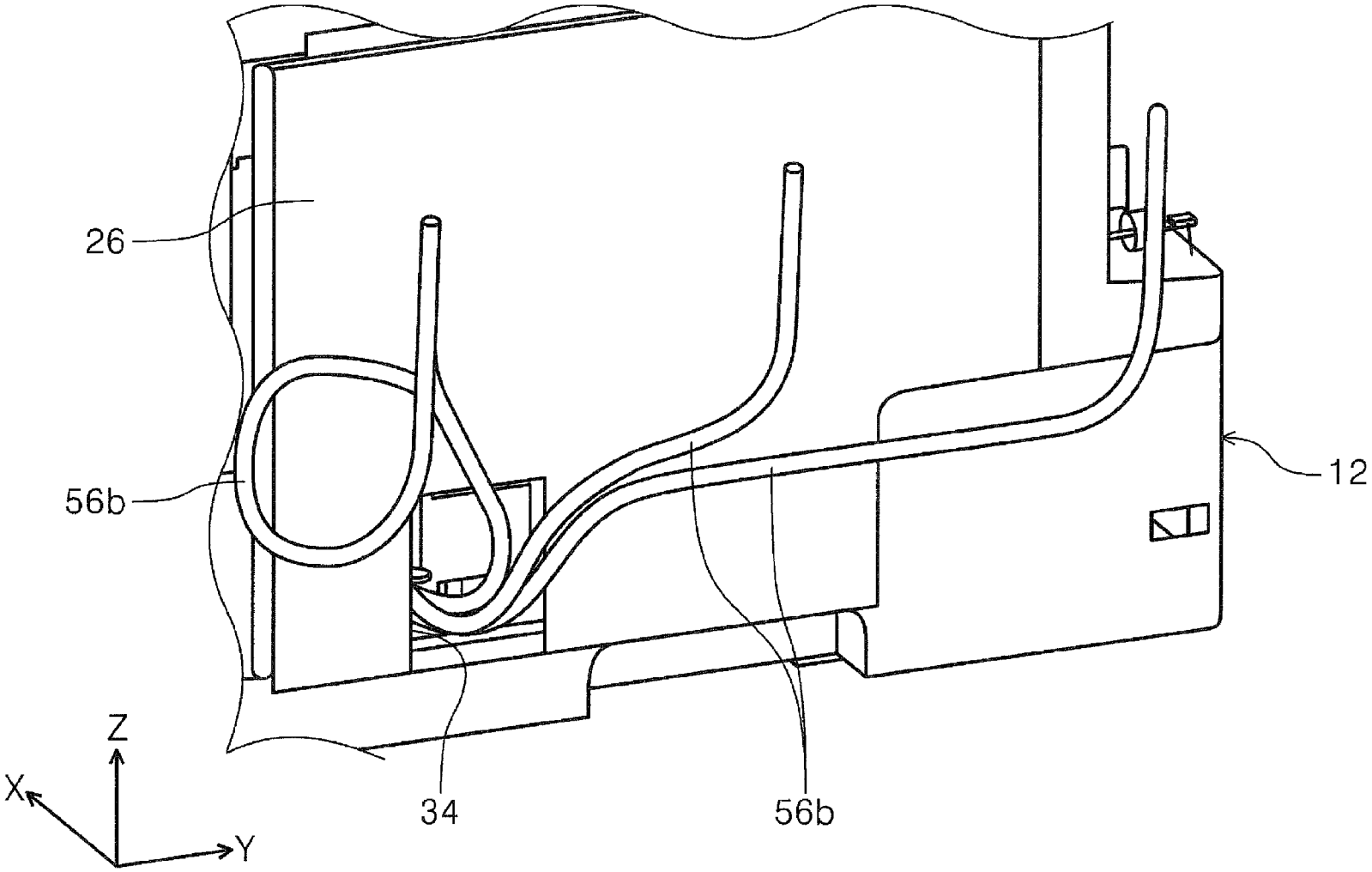
FIG. 20 is a perspective view illustrating the opening which is provided on a side surface of the housing, and guides a plurality of ink tubes of the color ink extending from the ink accommodating member storage case to the inside of the housing.

FIG. 16 is a plan view of a structure of the printer 10, FIG. 17 is a perspective view illustrating an ink relay portion inside the structure, FIG. 18 is a side view illustrating the supplying passage of the color ink from the ink accommodating member storage case which stores the ink accommodating member of the color ink to the inside of the housing, FIG. 19 is an enlarged view of a vicinity of the opening portion in the ink accommodating member storage case, and FIG. 20 is a perspective view illustrating the opening which is provided on a side surface of the housing, and guides a plurality of the ink tubes of the color ink extending from the ink accommodating member storage case to the inside of the housing.

Figure 21:
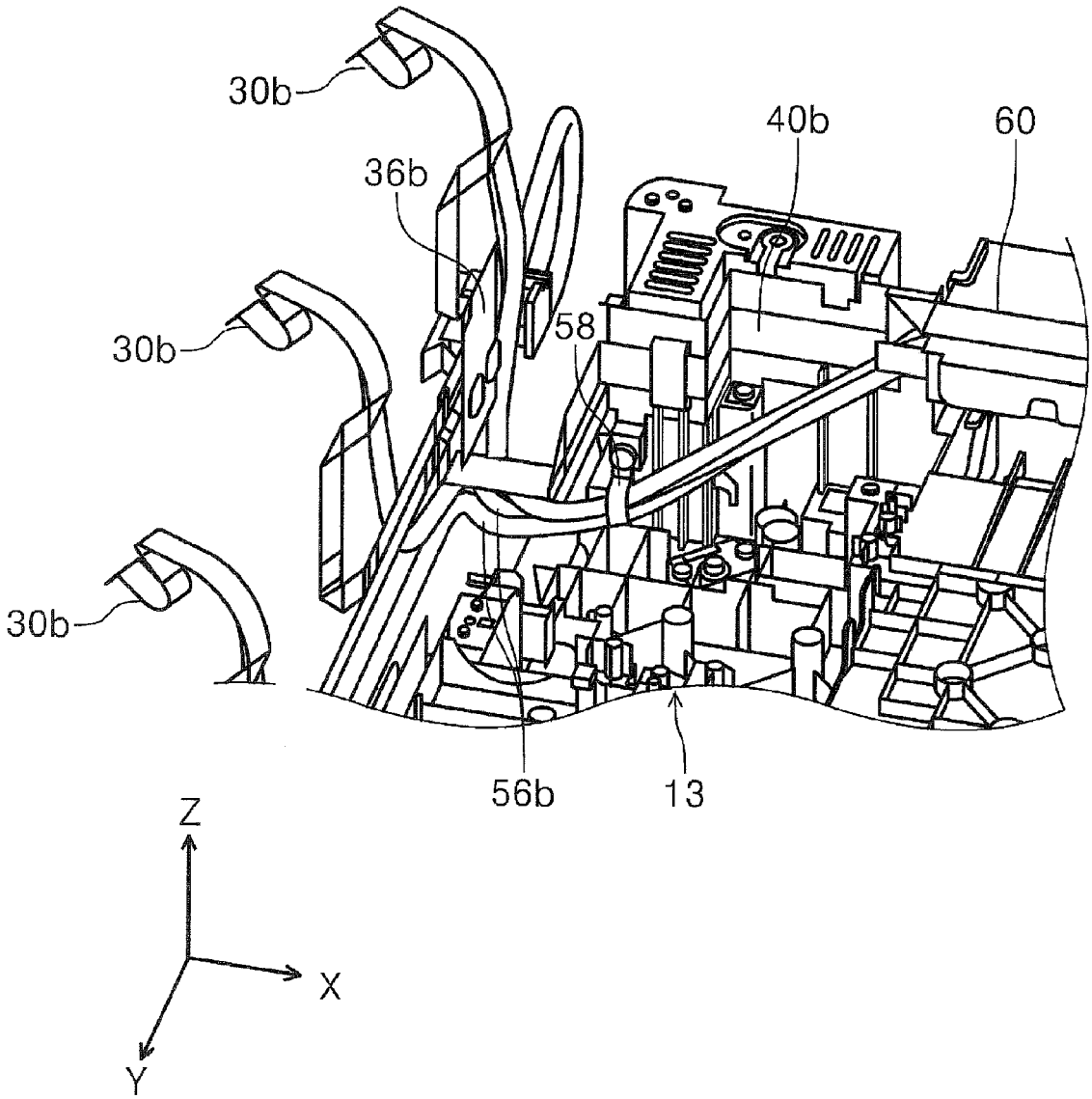
FIG. 21 is a perspective view illustrating handling the color ink inside a structure of a vicinity of an opening in FIG. 20.
Figure 22:
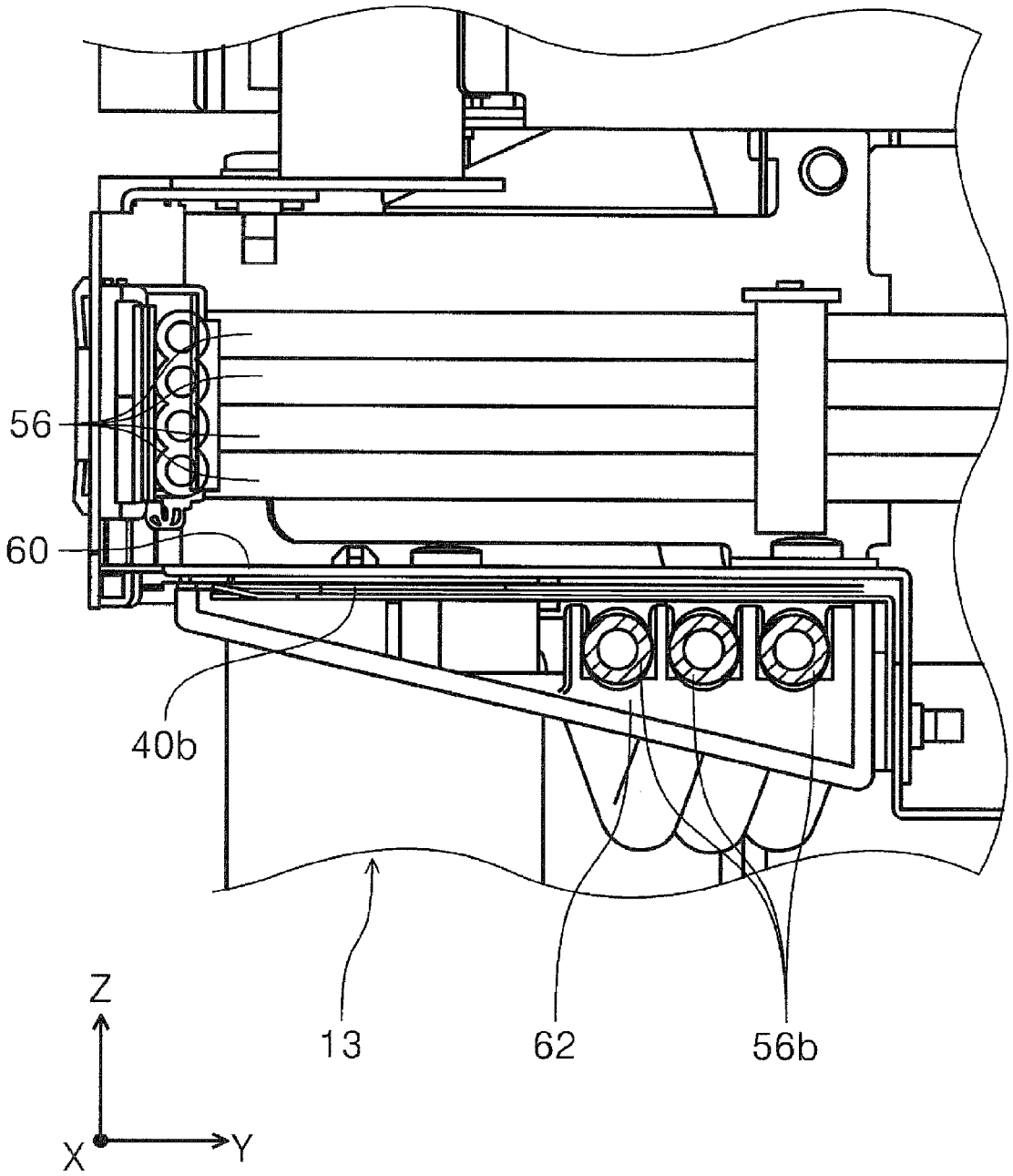
FIG. 22 is a sectional view illustrating a state of an ink tube of the color ink which is disposed on a lower side of a frame traversing in a width direction of the structure inside the structure.
Figure 23:
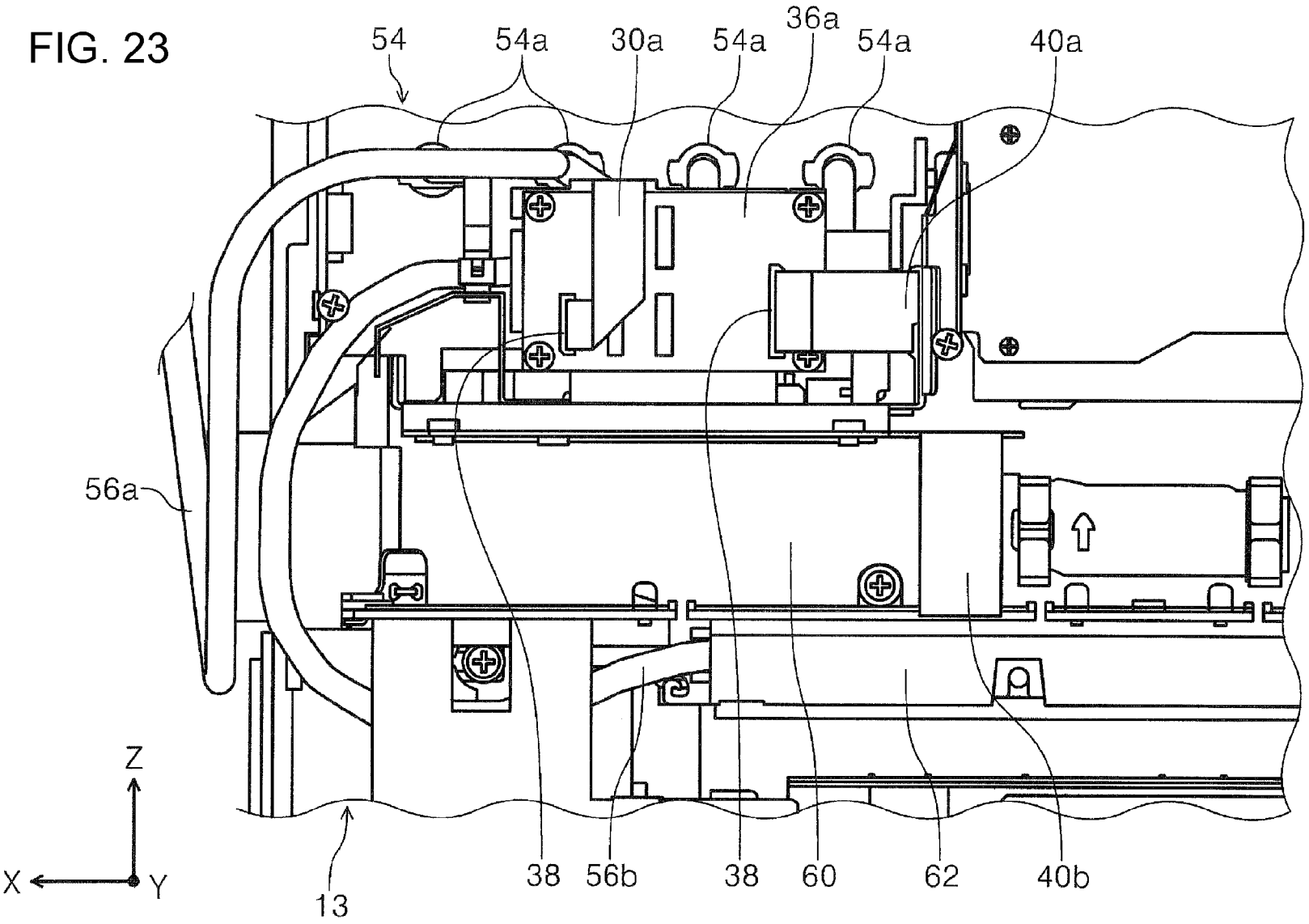
FIG. 23 is a view illustrating handling the ink tube when the ink relay portion provided inside the structure is seen from the front.
Figure 24:
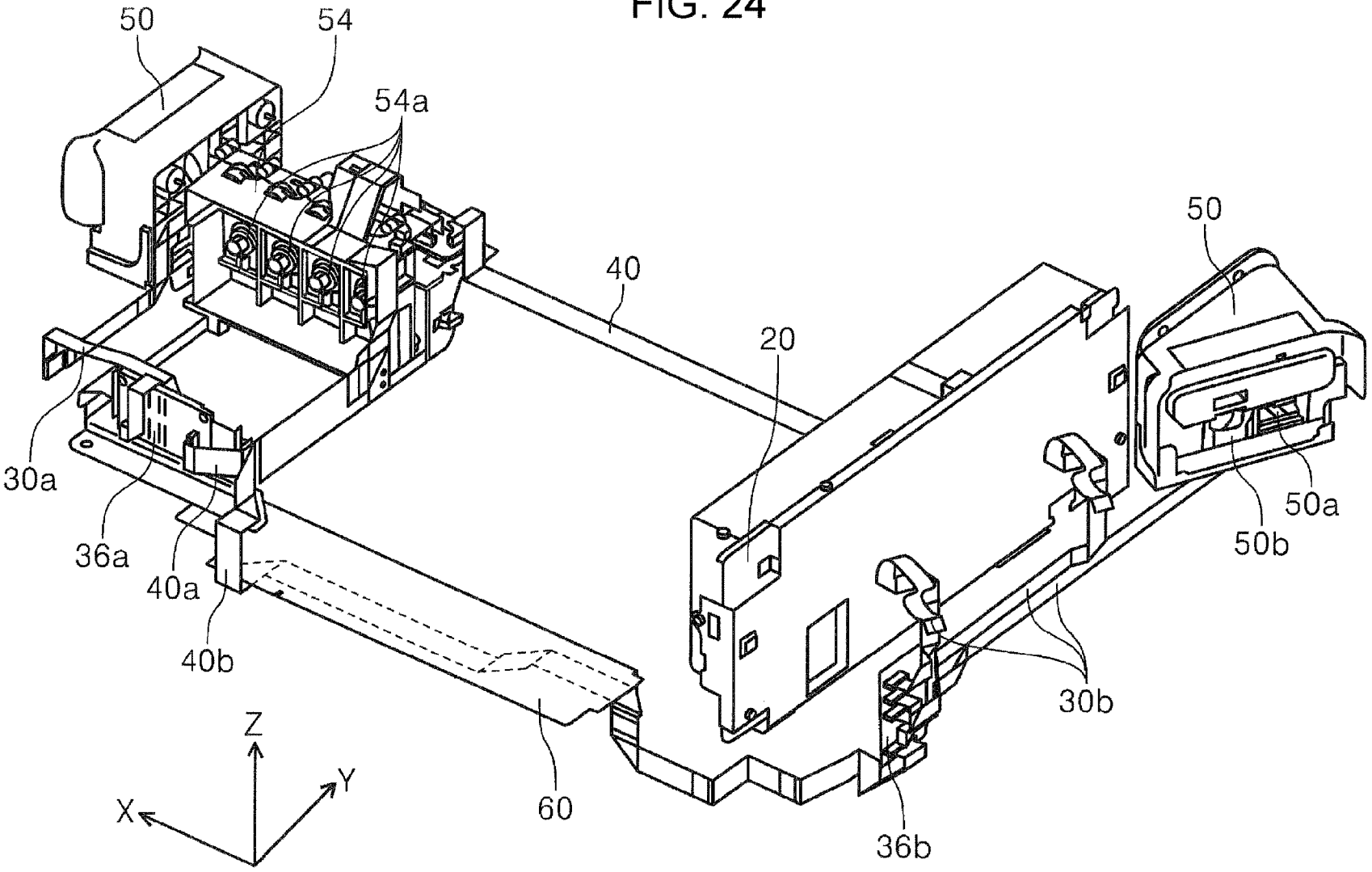
FIG. 24 is a view illustrating handling of a cable which transmits information from the ink accommodating member in the printer according to the first example, when seen from the front side of the apparatus.
Figure 25:
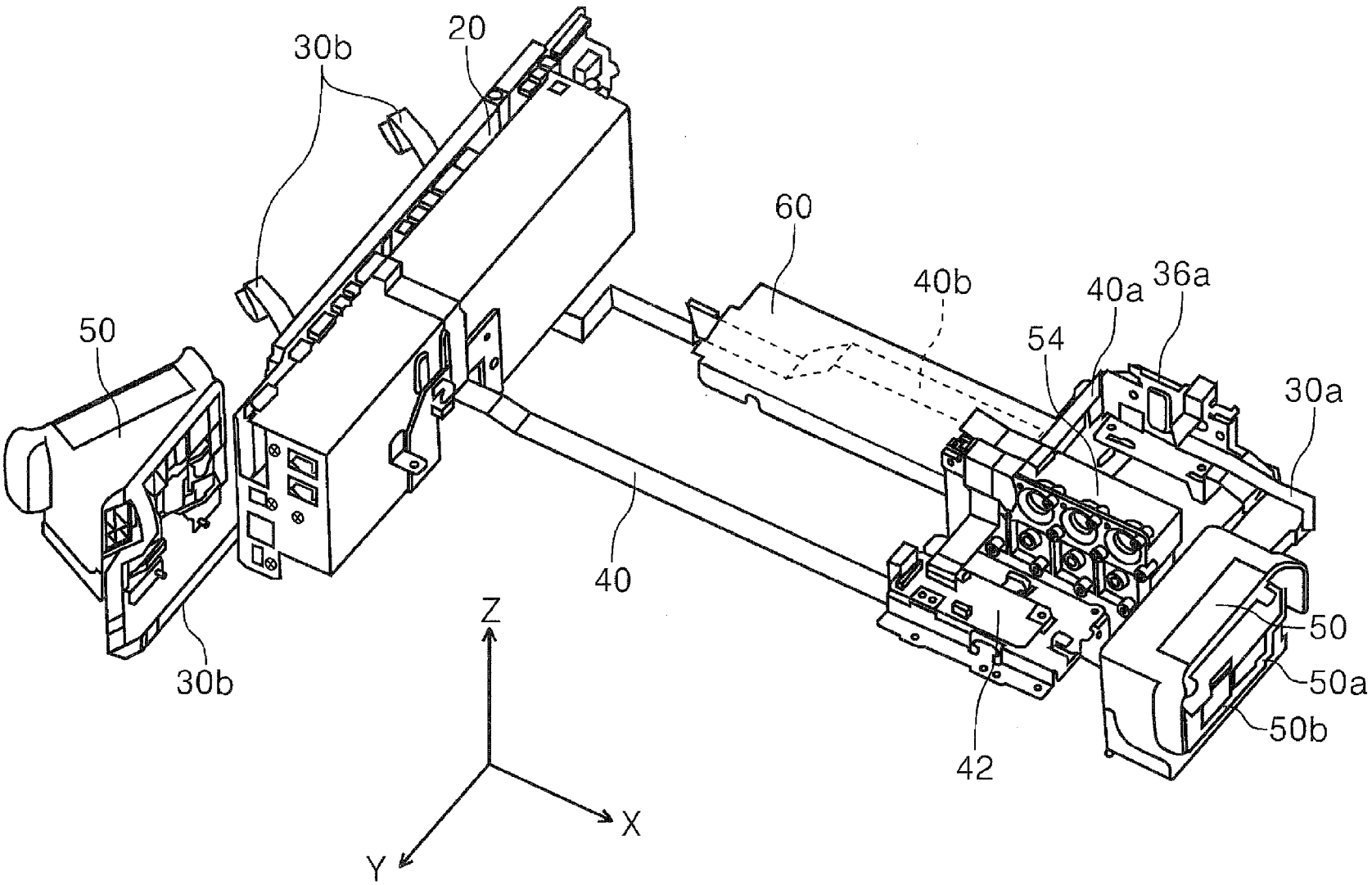
FIG. 25 is a view illustrating handling of a cable which transmits information from the ink accommodating member in the printer according to the first example, when seen from the rear side of the apparatus.
Figure 26:
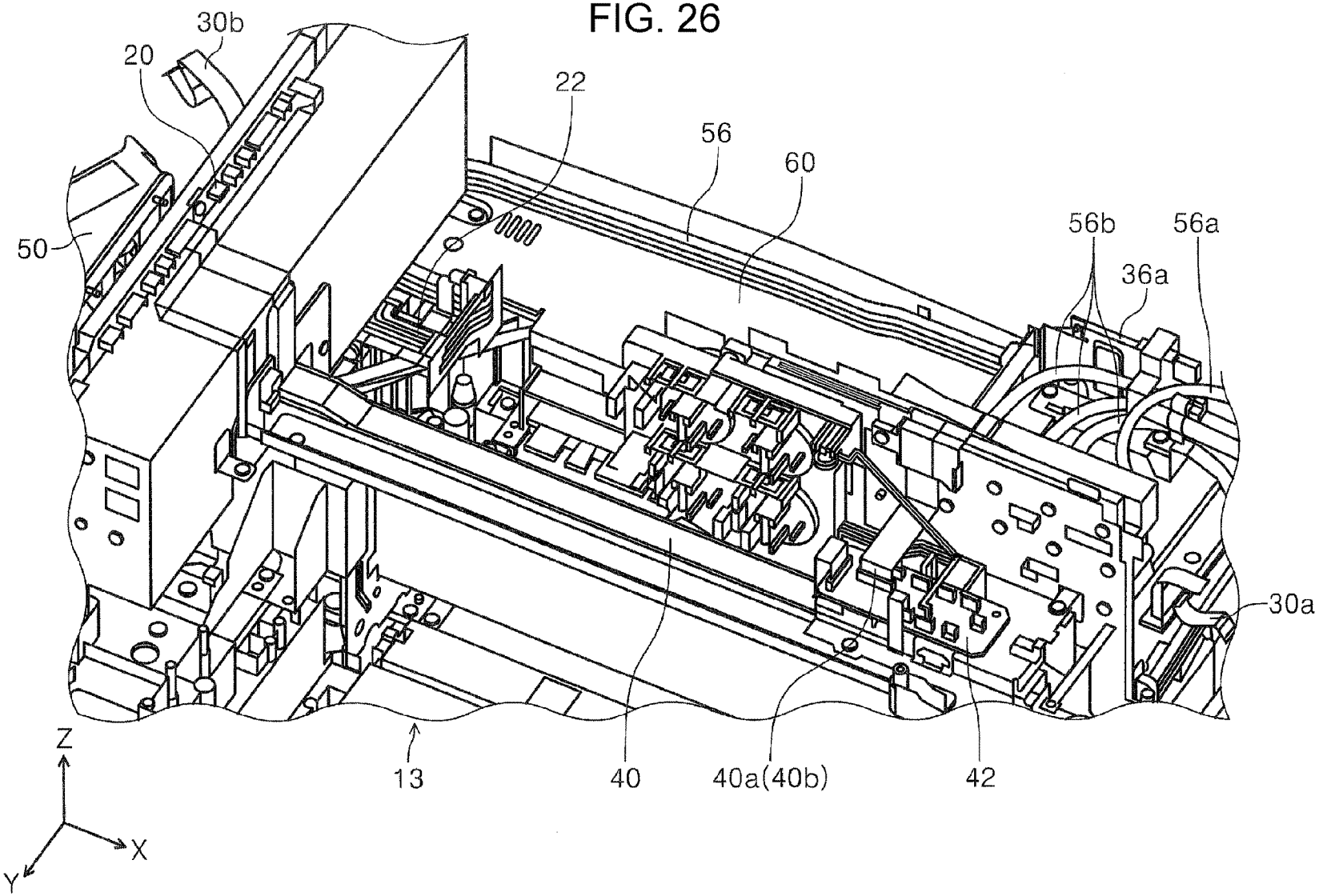
FIG. 26 is a perspective view illustrating handling of the cable from the confluence substrate in the structure to a controller.

FIG. 21 is a perspective view illustrating handling of the ink tube of the color ink inside the structure of a vicinity of the opening in FIG. 20, FIG. 22 is a sectional view illustrating a state of the ink tube of the color ink which is disposed on a lower side of a frame traversing a width direction of the structure in the structure, FIG. 23 is a view illustrating the handling of the ink tube when the ink relay portion which is provided inside the structure is seen from the front, FIG. 24 is a view illustrating the handling of a cable which transmits information from the ink accommodating member in the printer 10 when seen from a front side of an apparatus side, FIG. 25 is a view illustrating the handling of a cable which transmits information from the ink accommodating member in the printer 10 when seen from a rear side of an apparatus side, and FIG. 26 is a perspective view illustrating the handling of the cable from a confluence substrate to a controller in the structure.

In an X-Y-Z coordinate system illustrated in each drawing, an X direction indicates a scanning direction of a recording head, a Y direction indicates a depth direction of a recording apparatus and a paper transportation direction, and a Z direction indicates a direction where a distance (gap) between the recording head and paper is changed, that is an apparatus height direction. Also, in each drawing, a −Y direction is set to an apparatus front side, and a +Y direction side is set to an apparatus rear side.

<<<Outline of Printer and Electric Wiring in Printer>>>

An outline of the invention will be described with reference to FIG. 1 and FIG. 2. The printer 10 according to the invention is provided with an apparatus main body 12 and ink accommodating member storage cases 16 and 18 as a "case" which stores an ink accommodating member 14 (refer to FIG. 6) as a "liquid accommodating member" accommodating ink as "liquid". The apparatus main body 12 is provided with a structure 13 (refer to FIG. 26) and a housing 26 (refer to FIG. 1) which covers the structure 13.

The structure 13 is provided with a controller 20 and a carriage 22. The carriage 22 includes a recording head 24 which is capable of discharging ink with respect to a medium. The carriage 22 is configured to be movable in an X axis direction in FIG. 1 by controlling the controller 20 inside of the apparatus main body 12, that is, in the structure 13.

In addition, the ink accommodating member storage cases 16 and 18 are provided on the outside of the housing 26. The ink accommodating member storage cases 16 and 18 in the example are provided to be respectively detachable from both side surfaces in the X axis direction of the housing 26. Also, the ink accommodating member storage cases 16 and 18 are provided with covers 19 and 19. The covers 19 and 19 are configured to be respectively capable of being opened and closed with respect to the ink accommodating member storage cases 16 and 18 (for example, FIG. 3 and FIG. 4). In the ink accommodating member storage cases 16 and 18, the ink accommodating member 14 which is stored in the case can be exchanged in a state in which the covers 19 and 19 are opened with respect to the ink accommodating member storage cases 16 and 18 (refer to FIG. 3 and FIG. 4).

In the ink accommodating member storage case 16, the ink accommodating member 14 accommodating the black ink is stored to be detachable. Also, in the ink accommodating member storage case 18, a plurality of the ink accommodating members 14 accommodating ink of each color of magenta, cyan, and yellow are stored to be detachable.

In the ink accommodating member 14 of each color (black, magenta, cyan, and yellow), a CSIC substrate 28 as an "electronic component" is attached (refer to FIG. 7). The CSIC substrate 28 is provided with a memory element which stores types of ink and a remaining amount of ink accommodated in the ink accommodating member 14, and holds the information of the ink accommodating member 14.

As illustrated in FIG. 2, in a state in which the ink accommodating member 14 of each color (black, magenta, cyan, and yellow) is respectively stored in the ink accommodating member storage cases 16 and 18, the CSIC substrate 28 corresponding to each color (black, magenta, cyan, and yellow) is electrically connected to the controller 20 through a connection portion 50*a* (refer to FIG. 8) of the attaching portion 50 to be described later.

Here, the electric wiring 29 according to the invention illustrated in FIG. 2 will be described. The electric wiring 29 is configured with flat cables 30*a* and 30*b*, relay substrates 36*a* and 36*b*, flat cables 40*a* and 40*b*, and a confluence substrate 42.

In the CSIC substrate 28 corresponding to the black ink, one end of the flat cable 30*a* (refer to a dashed line in FIG. 2) of nine cores as "a cable of the electronic component side" is electrically connected. The flat cable 30*a* extends from the ink accommodating member storage case 16 to the inside of the housing 26 through an opening 32 (refer to FIG. 13) provided on the ink accommodating member storage case 16, and an opening 34 (refer to FIG. 14) which faces the opening 32 and is provided on a side surface of the housing 26.

The other end of the flat cable 30*a* is connected to the relay substrate 36*a* as a "connection portion" in the structure 13. The relay substrate 36*a* is configured as a circuit substrate capable of converting an analog signal which is likely to be affected by noise to a digital signal which is less likely to be affected by noise. Also, the other end of the flat cable 30*a* is attached through a connector 38 so as to be easily connected to or separated from the relay substrate 36*a*.

In addition, the flat cable 30*a* transmits the analog signal and the digital signal from the CSIC substrate 28 to the relay substrate 36*a*. Moreover, the relay substrate 36*a* which is electrically connected to the CSIC substrate 28 corresponding to the black ink is provided between the opening 34 and the controller 20.

Also, the relay substrate 36*a* converts the analog signal transmitted from the CSIC substrate 28 to a digital signal by an A/D convertor which is not illustrated. The flat cable 40*a* (refer to thick dashed line in FIG. 2) of 15 cores as "a cable on the controller side" extends to the confluence substrate 42 provided inside the structure 13 from the relay substrate 36*a*. The flat cable 40*a* transmits the digital signal from the relay substrate 36*a* to the confluence substrate 42.

Next, even in each CSIC substrate 28 corresponding to each color of magenta, cyan, and yellow, one end of a flat cable 30*b* (refer to thin dashed line in FIG. 2) of nine cores is electrically connected. The other end of each of the flat cables 30*b* is connected to be easily detachable with respect to the relay substrate 36*b* as a "connection portion" which is provided inside the ink accommodating member storage case 18 through the connector 38.

In addition, each flat cable 30*b*, which connects the CSIC substrate 28 and the relay substrate 36*b* corresponding to each color, transmits the analog signal and the digital signal from the CSIC substrate 28 to the relay substrate 36*b*. Also, the relay substrate 36*b* which is electrically connected to each of the CSIC substrates 28 corresponding to the color ink, is provided between the opening 32 and the CSIC substrate 28.

Also, the relay substrate 36*b* converts the analog signal transmitted from each CSIC substrate 28 to the digital signal. In the relay substrate 36*b*, one end of the flat cable 40*b* (refer to thick dashed line in FIG. 2) of 15 cores is connected to be easily detachable through the connector 38. The flat cable 40*b* extending from the relay substrate 36*b* extends to the inside of the structure 13 through the opening 32 (refer to FIG. 19) which is provided in the ink accommodating member storage case 18 and the opening 34 (refer to FIG. 20) which faces the opening 32 and is provided on a side surface of the housing 26. The other end of the flat cable 40*b* is connected to the confluence substrate 42.

That is, in the relay substrate 36*b* provided inside the ink accommodating member storage case 18, a plurality of the CSIC substrates 28 is electrically connected, information from the CSIC substrates 28 is converted from the analog signal to the digital signal, and then the converted information is transmitted through one flat cable 40*b* to the controller 20.

In the confluence substrate 42, the flat cable 40*a*, which is electrically connected to the CSIC substrate 28 corresponding to the black ink, and the flat cable 40*b*, which is electrically connected to the plurality of the CSIC substrates 28 respectively corresponding to the ink of each color other than the black ink, are connected. Also, the information transmitted by the two flat cables 40 in the confluence substrate 42 is organized in one flat cable 40 of 15 cores and is transmitted to the controller 20.

That is, it is configured that the information of the CSIC substrate 28 corresponding to each color (black, magenta, cyan, and yellow) is converted to the digital signal in the relay substrates 36*a* and 36*b*, and is transmitted to the controller 20 through the confluence substrate 42. Also, in the above description, a point of view of a flow of the signal from the CSIC substrate 28 toward the controller 20 has been described; however, a reverse direction of a flow of the signal also exists.

In addition, in the ink accommodating member storage cases 16 and 18, opening and closing detection sensors 44 and 44 (FIG. 3 or FIG. 5), which detect opening and closing of each storage case, are provided. A cable 46 (refer to FIG. 13 or FIG. 15), which extends from the opening and closing detection sensor 44 provided on the ink accommodating member storage case 16 side, is connected to the controller 20 through the openings 32 and 34 toward the controller 20 inside the structure 13. In the same way, the cable 46 (refer to thick solid line in FIG. 2 and FIG. 34) extending from the opening and closing detection sensor 44 provided on the ink accommodating member storage case 18 side is also connected to the controller 20 through the openings 32 and 34 toward the controller 20 of the inside of the structure 13.

The opening and closing detection sensor 44 provided in the ink accommodating member storage case 16 transmits a detection signal to the controller 20 when the cover 19 is opened with respect to the ink accommodating member storage case 16 (refer to FIG. 3). In the same way, the opening and closing detection sensor 44 provided on the ink accommodating member storage case 18 also transmits a detection signal to the controller 20 when the cover 19 is opened with respect to the ink accommodating member storage case 18 (refer to FIG. 4). The controller 20 controls the carriage 22 and the recording head 24 so as to immediately stop the recording operation, when receiving the signal from the opening and closing detection sensor 44, in a case in which the carriage 22 and the recording head 24 performs a recording operation on a medium.

In the printer 10 described above of the electric wiring 29, the following effects can be obtained.

That is, in the printer 10 in which the ink accommodating member storage cases 16 and 18 are provided on the outside of the housing 26, when performing maintenance, or the like on the inside of the apparatus main body, there may be a case in which the ink accommodating member storage cases 16 and 18 are required to be detached from the housing 26 first.

At this time, if the electric wiring 29 is wired to one cable without extra length, the cable is required to be detached, or the like from the controller 20 before detaching the ink accommodating member storage cases 16 and 18, and work required takes labor and time. Meanwhile, if extra length is provided to the cable in order to avoid such maintenance deterioration, it is not preferable that an influence of noise in response to an increase of a length of the cable is likely to be received.

However, as described above, the electric wiring 29 which electrically connects the controller 20 and the CSIC substrate 28 includes the relay substrates 36*a* and 36*b*, and the flat cables 30*a* and 30*b* of the CSIC substrate 28 side or the flat cables 40*a* and 40*b* of the controller 20 side can be separated from the relay substrates 36*a* and 36*b*. Accordingly, even when the electric wiring 29 is short, the ink accommodating member storage cases 16 and 18 can be easily detached from the housing 26. That is, both improvement of maintenance of the apparatus and suppressing of performance deterioration of the apparatus can be achieved.

Particularly, in the ink accommodating member storage case 18 side of the color ink side, the relay substrate 36*b* is provided between the opening 32 and the CSIC substrate 28. Also, in the ink accommodating member storage case 18, the inside thereof is revealed by opening the cover 19 as illustrated in FIG. 4, and is able to access the relay substrate 36*b*, that is, the connector 38 of the controller 20 side is detached, and thus the ink accommodating member storage case 18 can be easily separated from the housing 26.

In addition, a plurality of the flat cables 30*b* of the CSIC substrate 28 side are connected to the relay substrate 36*b*, are collected, and are connected to the controller 20 by one flat cable 40*b* of the controller 20 side. Therefore, each of the plurality of the CSIC substrates 28 can be set to have a short length of the cable compared to a configuration in which each of the substrates is connected to the controller 20, and the influence of noise can be suppressed to be minimum amount.

Moreover, in the example, a connection portion, which is capable of connecting and separating the flat cable 40*a* (or 40*b*) of 15 cores as "the cable on the controller side and the flat cable 30*a* of nine cores (or 30*b*) as the cable on the electronic component side", is configured with the relay substrate 36*a* (or 36*b*), but may be configured with the connection portion of simple connectors instead of the relay substrate. In this case, conversion (analog and digital) of the signal as described in the example is not performed, but a structure of the connection portion can be made to be simple at a row cost.

In addition, the electric wiring 29 which electrically connects the controller 20 and the CSIC substrate 28 includes the relay substrates 36*a* and 36*b*, the flat cables 30*a* and 30*b* near the CSIC substrate 28 of the ink accommodating member 14, and the flat cables 40*a* and 40*b* near the controller 20 side, a signal to transmit the flat cables 30*a* and 30*b* includes the analog signal, but a signal to transmit the flat cables 40*a* and 40*b* does not include the analog signal, and the analog signal in the apparatus main body 12 side (structure 13 side provided with recording head 24) where a noise source is significant is not used, that is, information is transmitted by the digital signal, and thus appropriate control for suppressing the influence of noise can be performed.

In addition, a plurality of the ink accommodating members 14 are provided on the inside of the ink accommodating member storage case 18, the CSIC substrate 28 and the flat cable 30*b* are provided in every ink accommodating members 14, and the plurality of the flat cables 30*b* are connected to the relay substrate 36*b*. That is, the plurality of the flat cables 30*b* are collected in the relay substrate 36*b*, and transmitting and receiving of the information is performed through transmitting of the digital signal by one flat cable 40*b*, and thus each of the plurality of the CSIC substrates 28 can be set to have a short length of the cable compared to a configuration in which the substrates are connected to the controller 20, and the influence of noise can be suppressed to be minimum.

In addition, the electric wiring 29 which electrically connects the controller 20 and the CSIC substrate 28 includes the relay substrates 36*a* and 36*b*, the flat cables 30*a* and 30*b* near the CSIC substrate 28 of the ink accommodating member 14, and the flat cables 40*a* and 40*b* near the controller 20 side. Also, in transmitting and receiving of the information between the CSIC substrate 28 and the controller 20, the relay substrates 36*a* and 36*b* constitute relay means which relays through transmitting of the digital signal by one flat cable 40, and is provided on a side near the CSIC substrate 28 with respect to an intermediate position between the controller 20 and the CSIC substrate 28 in the electric wiring 29, and thus a transmitting distance due to the digital signal is elongated, accordingly, and appropriate control for suppressing the influence of noise can be performed.

<<<Detailed Description of Each Configuration Component>>>

Hitherto, an outline relating to a characteristic configuration of the printer 10 has been described, and hereinafter, each configuration will be further described in more detail with reference to FIG. 3.

<<<Ink Accommodating Member and Ink Accommodating Member Storage Case>>>

First, the ink accommodating member 14 and the ink accommodating member storage cases 16 and 18 will be described with reference to FIG. 3 or FIG. 10. The ink accommodating member storage cases 16 and 18 include the covers 19 and 19. The covers 19 and 19 are configured to be rotatable with respect to a main body of the ink accommodating member storage cases 16 and 18. In a state in which the cover 19 is rotated with respect to the main body of the case (refer to FIG. 3 and FIG. 4), that is, in a state in which the ink accommodating member storage cases 16 and 18 are opened, the ink accommodating member 14 accommodated inside the ink accommodating member storage cases 16 and 18 can be exchanged.

In addition, with reference to FIG. 6 and FIG. 7, the ink accommodating member 14 is configured in a flexible bag shape, and accommodates ink. In addition, the attaching portion 14*a* is formed on an upper part of the ink accommodating member 14. The attaching portion 14*a* serves as a handle at the time of carrying the ink accommodating member 14. In addition, the CSIC substrate 28 and the ink supplying portion 48 are provided on the attaching portion 14*a*.

In addition, inside the ink accommodating member storage case 16, the attaching portion 50 to which the ink accommodating member 14 is mounted is provided (refer to FIG. 5). The attaching portion 50 includes the connection portion 50*a* which electrically connected to the CSIC substrate 28 of the ink accommodating member 14 and an ink supply port 50*b* which is connected to the ink supplying portion 48.

In addition, inside the ink accommodating member storage case 18, the attaching portion 50 corresponding to each color of magenta, cyan, and yellow is provided (FIG. 9). Even in the attaching portion 50 corresponding to each color, the connection portion 50*a* which is electrically connected to the CSIC substrate 28 of the ink accommodating member 14 and the ink supply port 50*b* which is connected to and supplies ink to the ink supplying portion 48 are provided.

In addition, in the ink accommodating member storage cases 16 and 18 as described above, the opening and closing detection sensors 44 and 44 are respectively provided. The opening and closing detection sensor 44 is provided on an upper part of the main body side of the case. The opening and closing detection sensor 44 is electrically connected to the controller 20 by the cable 46 (refer to FIG. 13). In the opening and closing detection sensor 44, a switch 44*a* (refer to FIG. 8) is provided. In addition, an engagement portion 52 which is capable of engaging the switch 44*a* is provided on an upper part of a part of the case which is rotatable with respect to the main body of the case illustrated in FIG. 10.

In a state in which a part of the case is opened with respect to the main body of the case, the switch 44*a* and the engagement portion 52 are engaged. Meanwhile, in a case in which a part of the case is rotated with respect to the main body of the case and is opened, engagement of the switch 44*a* and the engagement portion 52 is released. The switch 44*a* switches on and off thereof in response to an engagement state or a non engagement state of the engagement portion 52. The opening and closing detection sensor 44 transmits on and off of the switch 44*a* to the controller 20 as the detection signal of opening and closing of the ink accommodating member storage cases 16 and 18.

<<<Regarding Supplying Passage of Ink>>>

Next, the supplying passage of ink which is supplied from the ink accommodating member 14 accommodated in the ink accommodating member storage cases 16 and 18 will be described with respect to FIG. 11 or FIG. 23.

With reference to FIG. 11 and FIG. 12, the ink relay portion 54 is provided inside the structure 13. A plurality of the connection portions 54*a* for connecting the ink tube 56, which supplies the ink from the ink accommodating member 14 corresponding to each color of black, magenta, cyan, and yellow, are provided in the ink relay portion 54. Moreover, in FIG. 11, an ink supplying passage (ink accommodating member storage case 18 to ink relay portion 54) of the color side will be omitted, and in FIG. 12, the ink supplying passage (ink accommodating member storage case 16 to ink relay portion 54) of the black side will be omitted.

The ink tube 56 corresponding to each color of black, magenta, cyan, and yellow extends from the ink relay portion 54 toward the carriage 22. The plurality of the ink tubes 56 between the ink relay portion 54 and the carriage 22 are stacked and arrayed in a Z axis direction in FIG. 11 and FIG. 12 and are configured to be deformed in response to a movement of the carriage 22 in the X axis direction of FIG. 11 and FIG. 12.

In addition, the ink tube 56*a* corresponding to the black ink extending from the attaching portion 50 which is provided inside the ink accommodating member storage case 16 (illustration for describing is omitted in FIG. 11) to the inside the structure 13, and is connected to a connection portion 54*a* of the ink relay portion 54. Also, the ink accommodating member 14 is mounted on the attaching portion 50, the ink supplying portion 48 of the ink accommodating member 14 and the ink supply port 50*b* are communicated with each other, and the black ink can be supplied through the ink relay portion 54 from the ink accommodating member 14 to the recording head 24 of the carriage 22. Moreover, illustration for describing the ink accommodating member 14 corresponding to the black ink is omitted in FIG. 11.

In addition, the ink tube 56*b* corresponding to the color ink of each color (magenta, cyan, and yellow) extends to the inside of the structure 13 and is respectively connected to the connection portion 54*a* of the ink relay portion 54 from three attaching portions 50 (for describing in FIG. 12, the attaching portions 50 corresponding to magenta and yellow are omitted), which are provided on the ink accommodating member storage case 18 (illustration for describing is omitted in FIG. 12) as illustrated in FIG. 12 and correspond to each color of magenta, cyan, and yellow.

Moreover, if the ink accommodating member 14 of each color respectively corresponding to the attaching portion 50 corresponding to each of colors (magenta, cyan, and yellow) is mounted, the ink supplying portion 48 of the ink accommodating member 14 of each color and the ink supply port 50*b* of the attaching portion 50 corresponding to each color are communicated with each other, and the color ink can be supplied from the ink accommodating member 14 of each color through the ink relay portion 54 to the recording head 24 of the carriage 22. Also, illustration for describing the plurality of ink accommodating members 14 corresponding to the color ink of each color will be omitted in FIG. 12.

A passage of the ink tube 56*a* corresponding to the black ink will be further described with reference to FIG. 13 or FIG. 17. The opening 32 is formed on a side facing the housing 26 of the ink accommodating member storage case 16 in FIG. 13. The opening 32 is opened at a size in which the ink tube 56*a*, the flat cable 30*a*, and the cable 46 pass though.

As illustrated in FIG. 13, the ink tube 56*a* corresponding to the black ink traverses the inside of the ink accommodating member storage case 16 and extends to the opening 32 from the attaching portion 50 which is provided inside the ink accommodating member storage case 16. The ink tube 56*a* is guided to the outside of the ink accommodating member storage case 16 from the opening 32.

In addition, as illustrated in FIG. 14 and FIG. 15, the opening 34 is formed on a side surface of a +X axis direction side in the housing 26. The opening 34 is provided at a position facing the opening 32 provided on the ink accommodating member storage case 16 in a state in which the ink accommodating member storage case 16 is attached with respect to the housing 26. In addition, the opening 34 is also opened at a size in which the ink tube 56*a*, the flat cable 30*a*, and the cable 46 pass though.

As illustrated in FIG. 14 and FIG. 15, the ink tube 56*a* is guided through the opening 32 and the opening 34 from the inside of the ink accommodating member storage case 16 to the inside of the housing 26. Also, as illustrated in FIG. 16 and FIG. 17, the ink tube 56*a* guided to the inside of the housing 26 is surrounded in a −Y axis direction side of the ink relay portion 54 provided on an end portion of the +X axis direction side inside the structure 13 from the opening 34, and is connected to the connection portion 54*a* corresponding to the black ink of the ink relay portion 54.

Next, with reference to FIG. 16 or FIG. 23, a passage of the ink tube 56*b* corresponding to the color ink (magenta, cyan, and yellow) will be further described. The opening 32 is formed on a side corresponding to the housing 26 of the ink accommodating member storage case 18 in FIG. 18 and FIG. 19. The opening 32 is opened at a size in which the ink tube 56*b*, the flat cable 30*b*, and the cable 46 pass through.

The plurality of the attaching portions 50 corresponding to each color of magenta, cyan, and yellow are provided inside the ink accommodating member storage case 18 as illustrated in FIG. 18. Each of the ink tubes 56*b* is pulled out from the attaching portion 50 corresponding to the color ink (magenta, cyan, and yellow) of each of the colors. The ink tube 56*b* which is pulled out from each of the attaching portion 50 traverses the inside of the ink accommodating member storage case 18 and extends to the opening 32. The plurality of ink tubes 56*b* is guided to the outside of the ink accommodating member storage case 18 from the opening 32.

Moreover, the ink tube 56*b* corresponding to yellow ink causes to form a loop at an intermediate portion of the passage inside the ink accommodating member storage case 18.

In addition, as illustrated in FIG. 20, the opening 34 is formed on a side surface of the −X axis direction side in the housing 26. The opening 34 is provided on a position facing the opening 32 provided on the ink accommodating member storage case 18 in a state in which the ink accommodating member storage case 18 is attached with respect to the housing 26. In addition, the opening 34 is also opened at a size in which the ink tube 56*b*, the flat cable 30*b*, and the cable 46 pass through.

As illustrated in FIG. 18 or FIG. 20, the ink tube 56*b* is guided from the inside of the ink accommodating member storage case 16 to the inside of the housing 26 through the opening 32 and the opening 34. The plurality of ink tubes 56*b* which are guided from the opening 34 to the inside of the housing 26 are bundled by a clamp member 58 (refer to FIG. 21) disposed in the vicinity of the opening 34 inside the structure 13.

Also, the ink tube 56*b* bundled by the clamp member 58 extends to a lower side of a frame 60 which extends in the X axis direction in an end portion of the −Y direction side (front side) of the structure 13 as illustrated in FIG. 16 and FIG. 21. The frame 60 supports the ink tube 56 so that the ink tube 56 between the ink relay portion 54 and the carriage 22 can be followed in response to movement of the carriage 22.

As illustrated in FIG. 16, the ink tube 56*b* traverses the structure 13 through the lower side of the frame 60 inside the housing 26 from the end portion of the −X axis direction side to the end portion of the +X axis direction side. Specifically, as illustrated in FIG. 22, the ink tube 56*b* is disposed between the frame 60 and a cover member 62 which is provided to cover a lower surface of the frame 60. The cover member 62 arranges the plurality of ink tubes 56*b* in parallel in a Y axis direction, and guides the tubes along a lower surface of the frame 60 in the X axis direction.

Also, the ink tube 56*b* extending to an end portion of the +X axis direction side inside the structure 13 is curved in the +Z axis direction side as illustrated in FIG. 23, and extends to an upper surface side of the frame 60, that is, the +Z axis direction side. The plurality of ink tubes 56*b* are respectively connected to the connection portion 54*a* corresponding to each of colors (magenta, cyan, and yellow) in the ink relay portion 54 provided on the +X axis direction side inside the structure 13. Accordingly, the color ink can be supplied from the ink accommodating member 14 of each color through the ink relay portion 54 to the recording head 24 of the carriage 22.

<<<Regarding Electric Wiring>>>

Next, with reference to FIG. 13, FIG. 16 or FIG. 19, FIG. 21 or FIG. 26, the electric wiring 29, which is electrically connected to the CSIC substrate 28 of each of the ink accommodating members 14 accommodated inside the ink accommodating member storage cases 16 and 18 and extends to the controller 20, will be described.

With reference to FIG. 24 and FIG. 25, the flat cable 30*a* of nine cores, which is connected to the connection portion 50*a* corresponding to the black ink of the ink accommodating member storage case 16 (illustration for describing is omitted in FIG. 24 and FIG. 25), is connected to the relay substrate 36*a* which is disposed on a forward side of the ink relay portion 54. The flat cable 40*a* of 15 cores extends toward the confluence substrate 42 disposed on a rear side of the ink relay portion 54 and the relay substrate 36*a*, and is connected to the confluence substrate 42.

Meanwhile, the flat cable 30*b* of nine cores, which is connected to each of the connection portions 50*a* corresponding to the color ink the ink accommodating member storage case 18 (illustration for describing is omitted in FIG. 24 and FIG. 25), is respectively connected to the relay substrate 36*b* which is disposed inside the ink accommodating member storage case 18. The flat cable 40*b* of 15 cores traverses the inside of the structure 13 and extends toward the confluence substrate 42 disposed on a rear side of the ink relay portion 54 from the relay substrate 36*b*, and is connected to the confluence substrate 42. Also, only one of three attaching portions 50 is illustrated in FIG. 24 and FIG. 25.

One flat cable 40 extends toward the controller 20 from the confluence substrate 42. That is, the confluence substrate 42 and the controller 20 are connected to each other by the flat cable 40.

First, the electric wiring, which corresponds to the CSIC substrate 28 of the ink accommodating member 14 of the black ink from the ink accommodating member storage case 16 through the relay substrate 36*a* to the confluence substrate 42, will be described. With reference to FIG. 13, one end of the flat cable 30*a* of nine cores is connected to the connection portion 50*a* of the attaching portion 50 provided inside the ink accommodating member storage case 16.

In addition, a conductive member 64 is disposed on a passage from the connection portion 50*a* of the flat cable 30*a* to the opening 32 inside the ink accommodating member storage case 16. That is, the flat cable 30*a* is wired from the connection portion 50*a* to the opening 32 along the conductive member 64. Accordingly, the influence of noise in the flat cable 30*a* can be suppressed.

With reference to FIG. 16 and FIG. 17 again, the flat cable 30*a*, which extends from the inside of the ink accommodating member storage case 16, extends inside the structure 13 through the opening 32 and the opening 34. The relay substrate 36*a* is disposed on a front side (−Y axis direction side) of the ink relay portion 54. The flat cable 30*a* is connected to the relay substrate 36*a* through the connector 38. When the flat cable 30*a* is mounted on the relay substrate 36*a* through the connector 38, the flat cable 30*a* is easily detached from or mounted on the relay substrate 36*a*.

In addition, the relay substrate 36*a* is fixed to a vicinity of the opening 34 in an end portion of the +X axis direction side in the structure 13. Also, the flat cable 30*a* in the example transmits an analog signal and a digital signal from the connection portion 50*a* to the relay substrate 36*a*. The analog signal is converted to the digital signal in the relay substrate 36*a*.

The flat cable 40*a* of 15 cores extends toward the confluence substrate 42 from the relay substrate 36*a*. Specifically, the flat cable 40*a* extending from the relay substrate 36*a* extends to the −X axis direction side of the relay substrate 36*a*, and then extends to a rear side of the relay substrate 36*a*, that is, a side part of the −X axis direction side of the ink relay portion 54 positioned on the +Y axis direction side. Moreover, the flat cable 40*a* is also connected to the relay substrate 36*a* through the connector 38.

The flat cable 40*a* extends in the +Z axis direction in a side part of the −X axis direction side of the ink relay portion 54, and changes a direction where on the flat cable 40*a* on an upper portion of the ink relay portion 54 extends to the +Y axis direction side of the ink relay portion 54. Also, the flat cable 40*a* is connected to the confluence substrate 42 which is disposed on the +Y axis direction side (rear surface side) of the ink relay portion 54.

Next, the electric wiring, which corresponds to the CSIC substrate 28 of the ink accommodating member 14 of the color ink from the ink accommodating member storage case 18 through the relay substrate 36*b* to the confluence substrate 42, will be described. With reference to FIG. 18 and FIG. 19, one end of the flat cable 30*b* of nine cores is connected to the connection portion 50*a* of the attaching portion 50 corresponding to each of colors (magenta, cyan, and yellow) inside the ink accommodating member storage case 18, and the other end of the relay substrate 36*b* disposed inside the ink accommodating member storage case 18 is connected. That is, the plurality of the flat cables 30*b* is connected to the relay substrate 36*b*.

Moreover, the flat cable 30*b* corresponding to the color ink of each color in the example transmits the analog signal and the digital signal from the connection portion 50*a* to the relay substrate 36*b*. The analog signal is converted to the digital signal even in the relay substrate 36*b* disposed on the ink accommodating member storage case 18.

In addition, the conductive member 64 extending in the Y axis direction is disposed inside the ink accommodating member storage case 18. On the conductive member 64, the flat cables 30*b* extending from the connection portion 50*a* to the relay substrate 36 corresponding to color ink of magenta and cyan are wired in parallel without overlapping. Therefore, the plurality of the flat cables 30*b* do not receive an influence of noise mutually, or the influence of noise can be reduced.

In addition, the relay substrate 36*b* is fixed to a vicinity of the opening 32. Also, the flat cable 40*b* of 15 cores is guided from the relay substrate 36*b* through the opening 32 and the opening 34 to the inside of the housing 26. Here, the flat cable 30*b* and the flat cable 40*b* are detachably attached to the relay substrate 36*b* by the connector 38.

That is, the relay substrate 36*b* is fixed to the inside of the opening 32, that is, a position near the opening 32, and thus connection or separation of the flat cable 30*b* or the flat cable 40*b* can be easily performed.

With reference to FIG. 21 or FIG. 23, the flat cable 40*b*, which is guided from the relay substrate 36*b* to the inside of the structure 13, extends from the opening 34 to the frame 60 positioned on the −Y direction side of the structure 13. Also, the flat cable 40*b* is pinched between a lower surface of the frame 60 and the cover member 62 in a lower side of the frame 60, and extends along the lower surface of the frame 60 from an end portion of the −X axis direction side of the structure 13 to the +X axis direction side.

As illustrated in FIG. 23, the flat cable 40*b* extends from the lower surface of the frame 60 in a position corresponding to a side part of the −X axis direction side of the ink relay portion 54 in the X axis direction of the structure 13. Also, the flat cable 40*b* overlaps the flat cable 40*a* extending from the relay substrate 36*a* disposed on the −Y axis direction side (front side) of the ink relay portion 54, and extends to the confluence substrate 42 disposed on the +Y axis direction side of the ink relay portion 54.

In addition, in the confluence substrate 42 as illustrated in FIG. 26, the flat cable 40*a*, which extends from the relay substrate 36*a* provided inside the structure 13, and the flat cable 40*b*, which extends from the relay substrate 36*b* provided inside the ink accommodating member storage case 18 are joined. That is, the two flat cables 40*a* and 40*b* in the confluence substrate 42 are electrically organized as the flat cable 40.

One flat cable 40 extending from the confluence substrate 42 extends from the +X axis direction side to the −X axis direction side in an upper part of the frame provided on the +Y axis direction side of the ink relay portion 54 of the inside of the structure 13, and is connected to the controller 20 provided on an end portion of the −X axis direction side inside the structure 13.

Second Example

Figure 27:
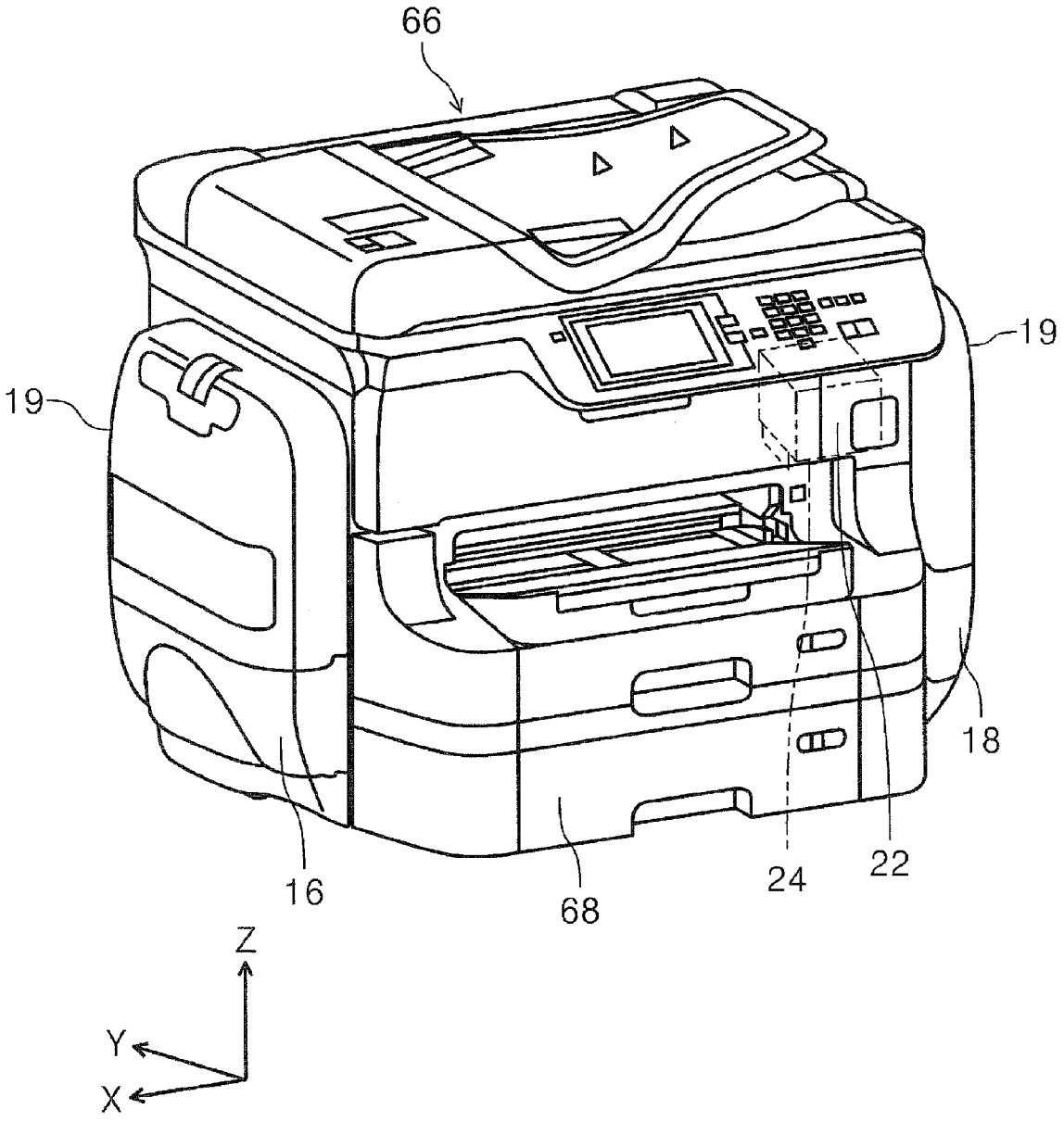
FIG. 27 is an exterior perspective view of the printer according to a second example.
Figure 28:
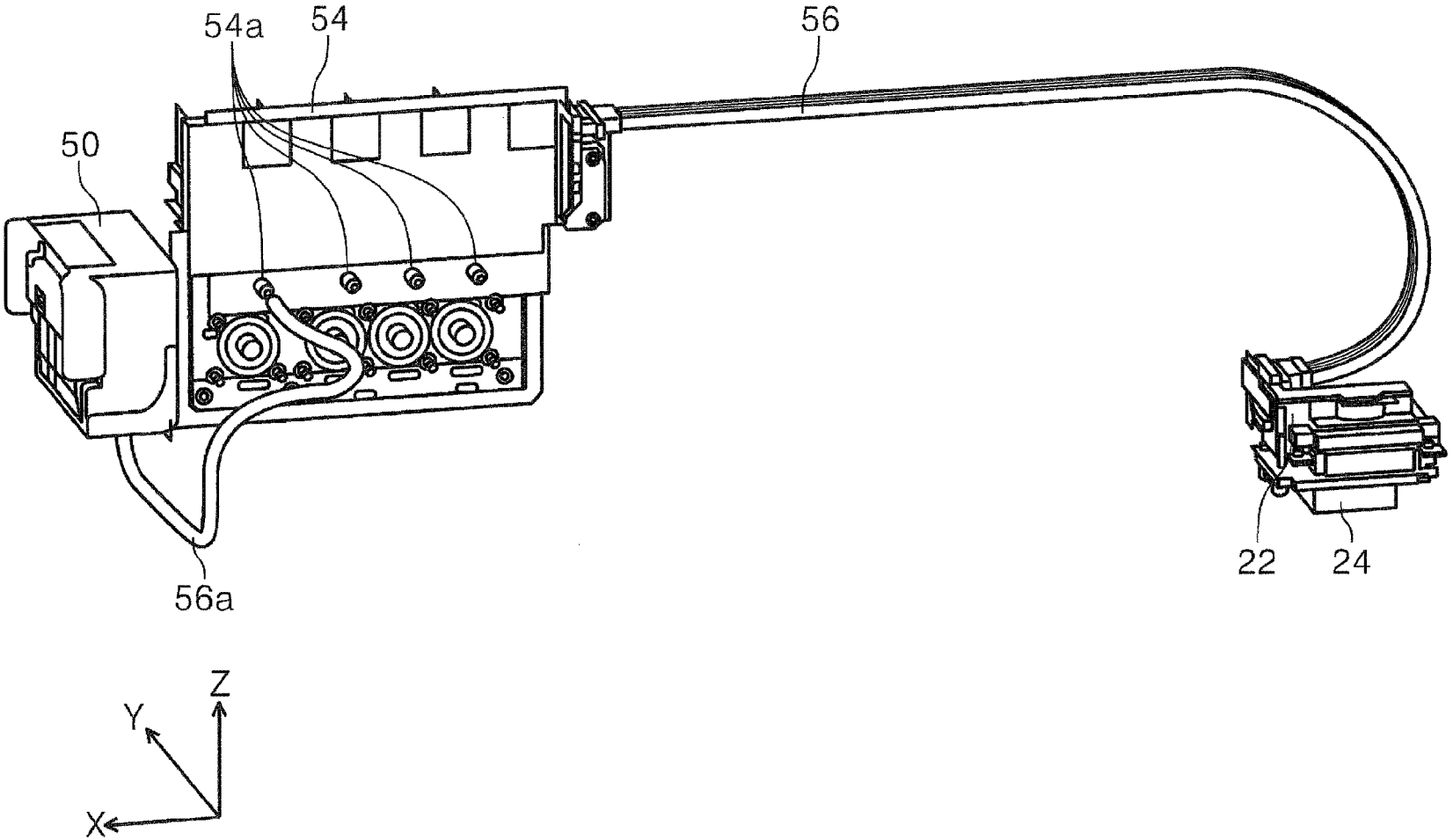
FIG. 28 is a perspective view illustrating the supplying passage of the black ink in the printer according to the second example.
Figure 29:
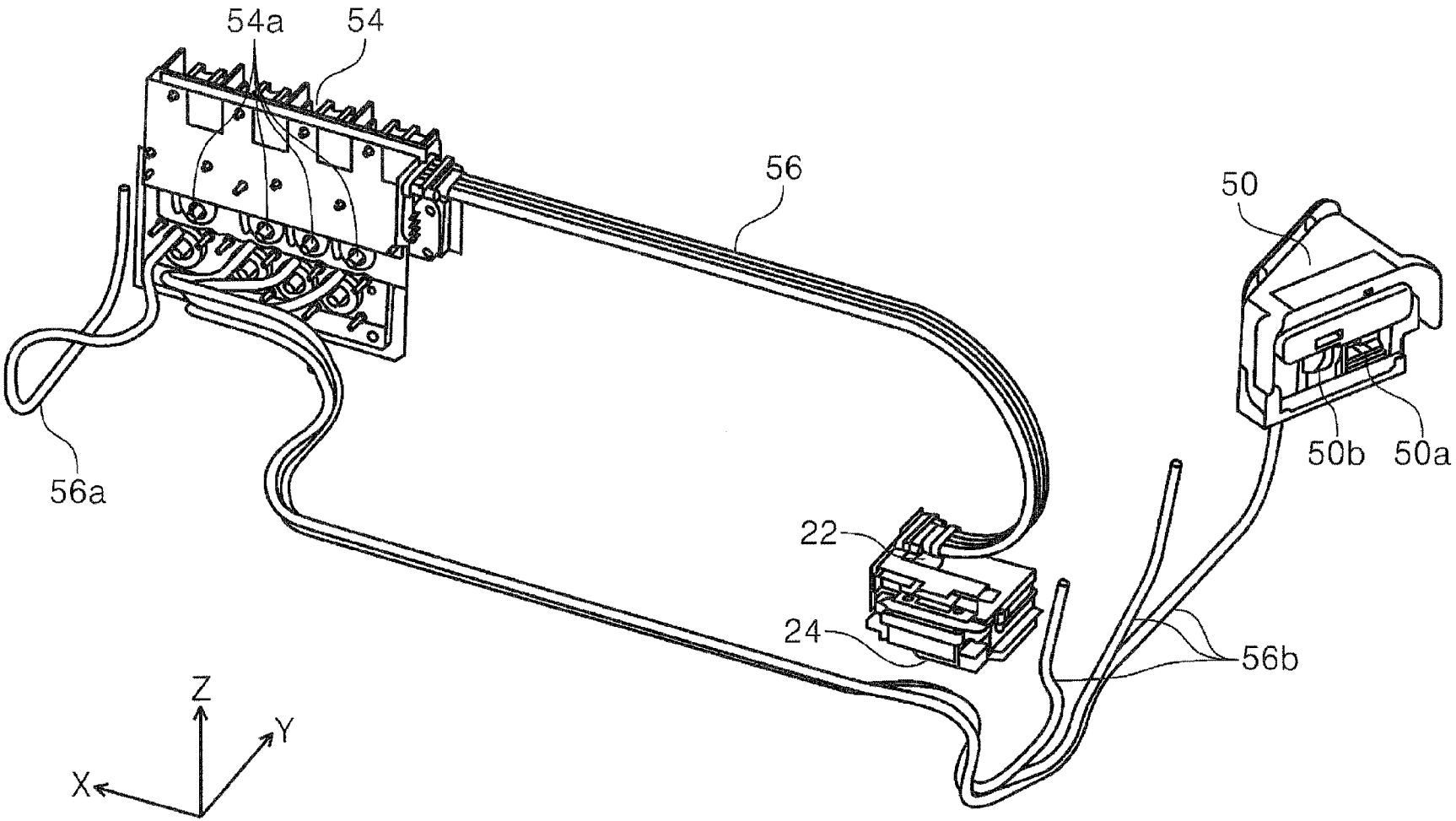
FIG. 29 is a perspective view illustrating the supplying passage of the color ink in the printer according to the second example.

Hereinafter, a second example will be described with reference to FIG. 27 and later. FIG. 27 is an exterior perspective view of the printer (hereinafter, refer to printer 66) according to the second example, FIG. 28 is a perspective view illustrating the supplying passage of the black ink in the printer 66, FIG. 29 is a perspective view illustrating the supplying passage of the color ink in the printer 66, and FIG. 30 is a perspective view illustrating an opening which is provided on a side surface of the housing, and guides the ink tube of the black ink extending from the ink accommodating member storage case to the inside of the housing.

Figure 30:
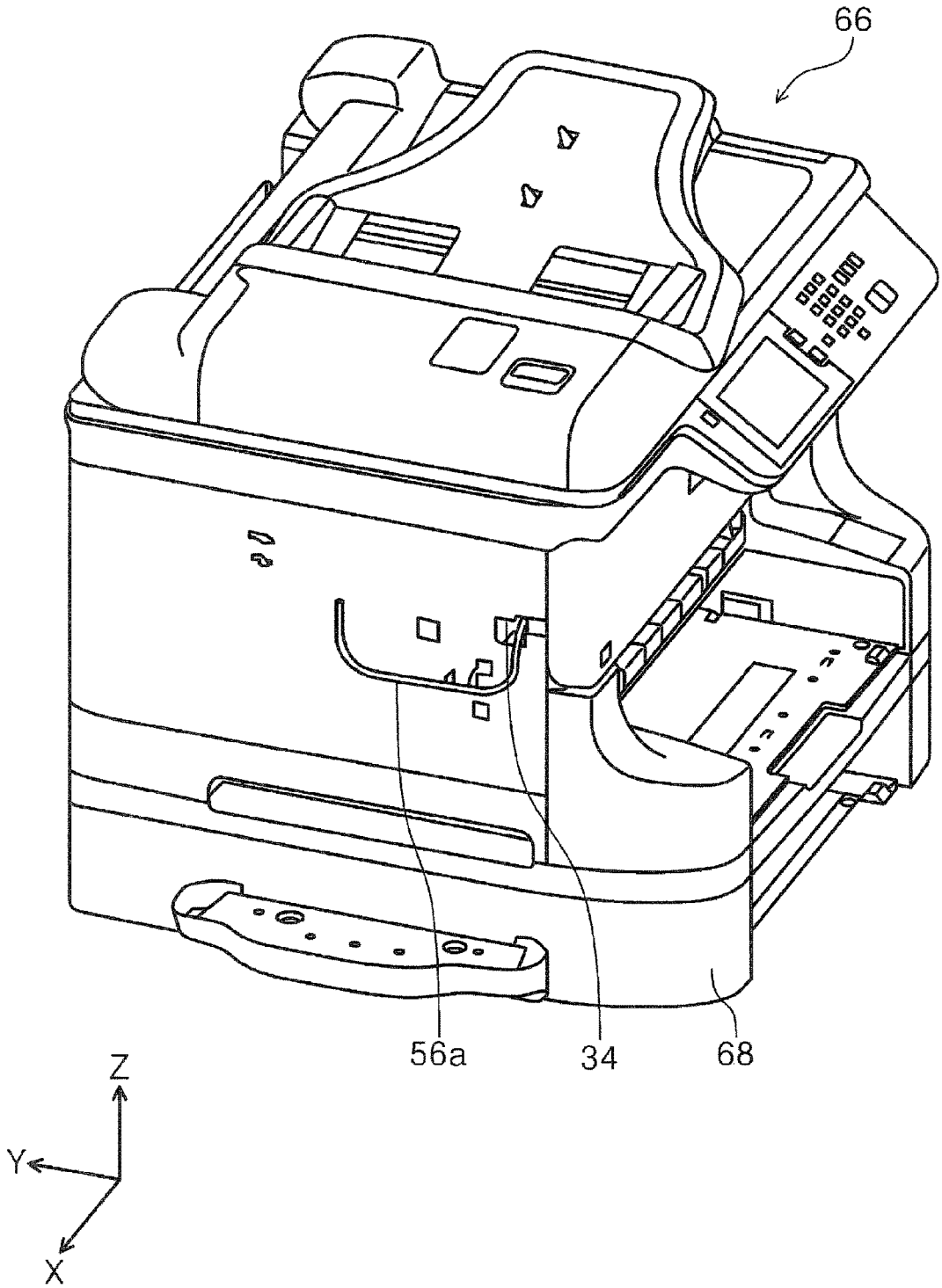
FIG. 30 is a perspective view illustrating an opening which is provided on a side surface of the housing, and guides the ink tube of the black ink extending from the ink accommodating member storage case to the inside of the housing.
Figure 31:
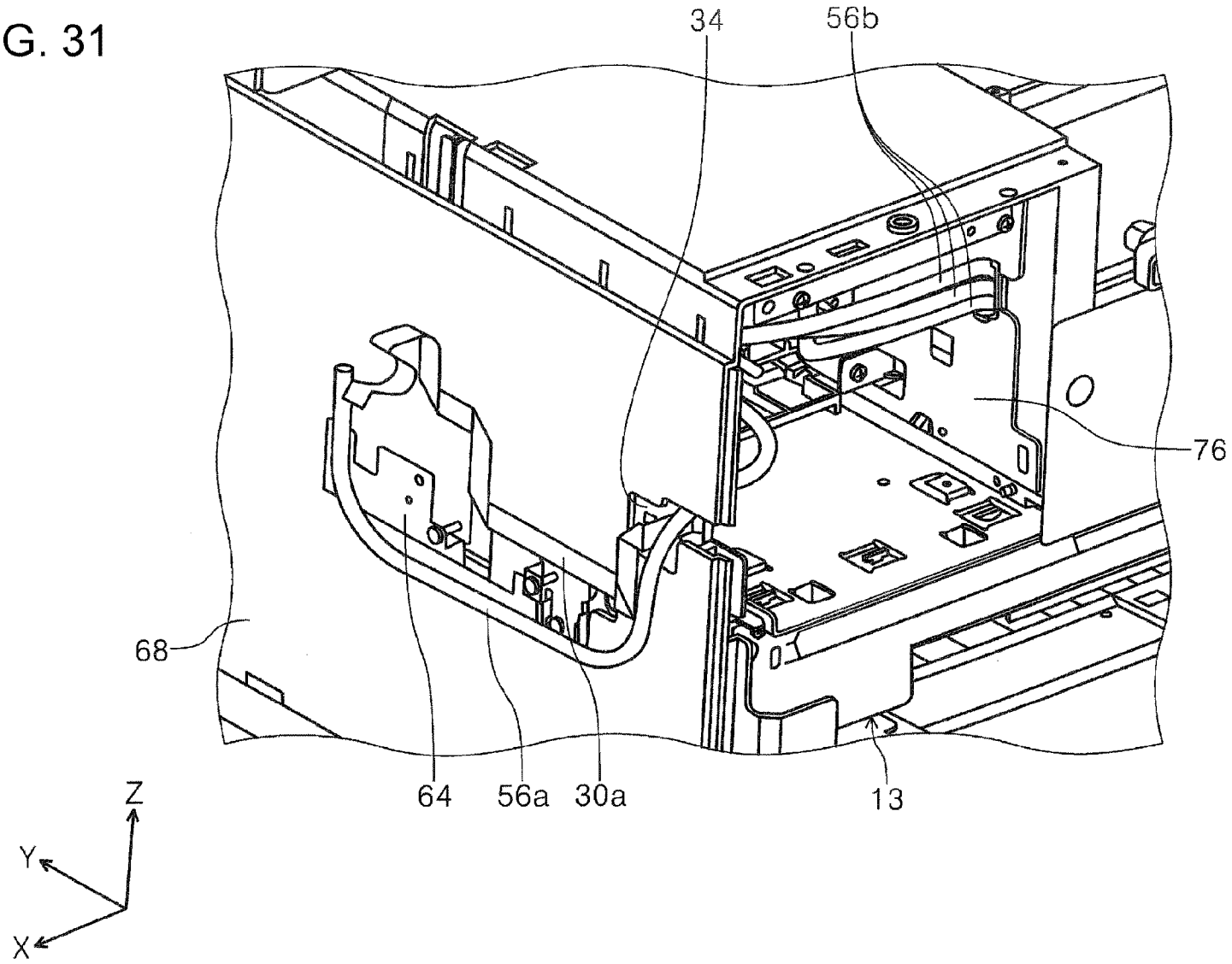
FIG. 31 is an enlarged perspective view of an opening in FIG. 30.
Figure 32:
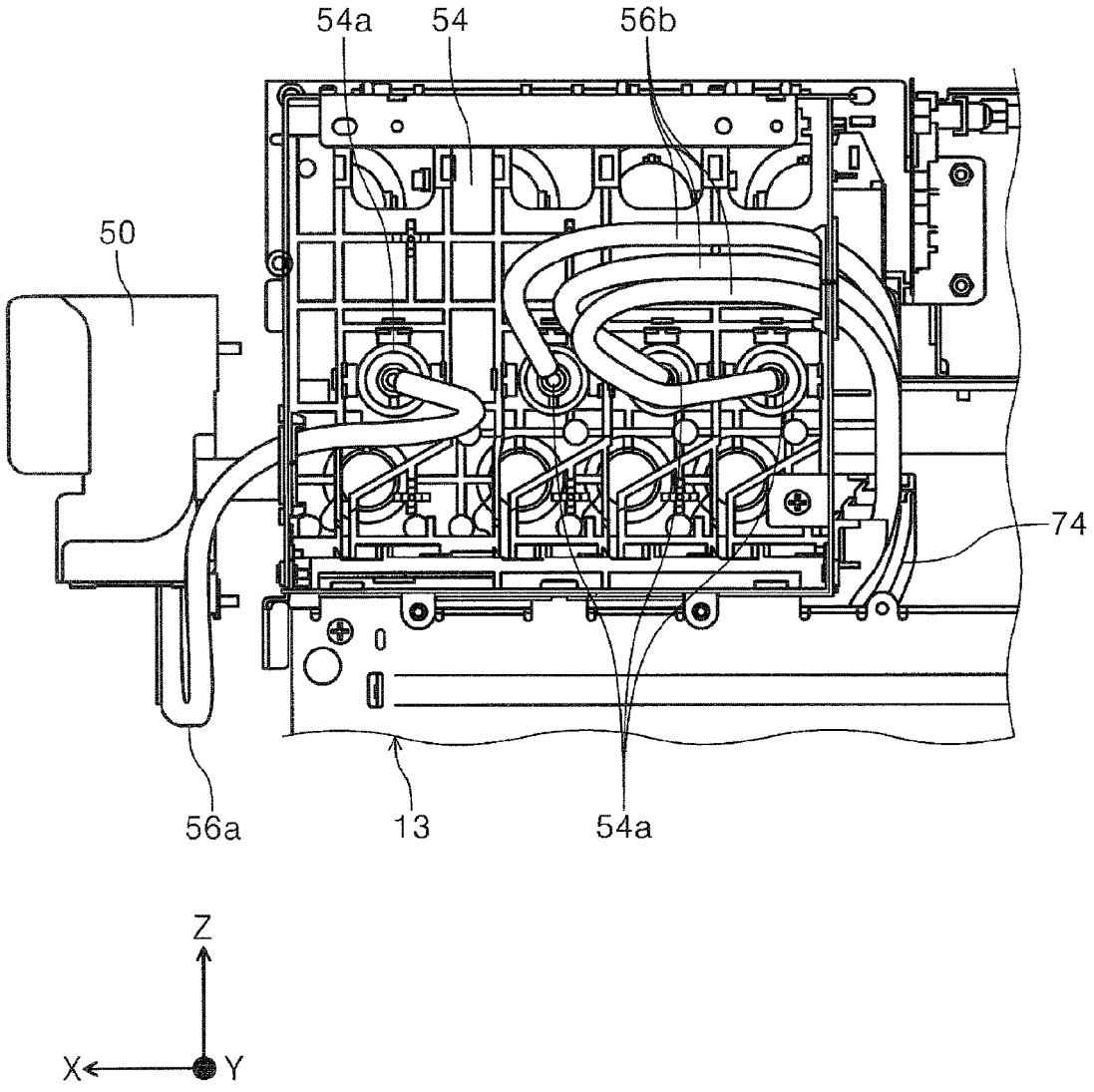
FIG. 32 is a view illustrating handling of an ink tube when an ink relay portion which is provided on the inside the structure is seen from the front.
Figure 33:
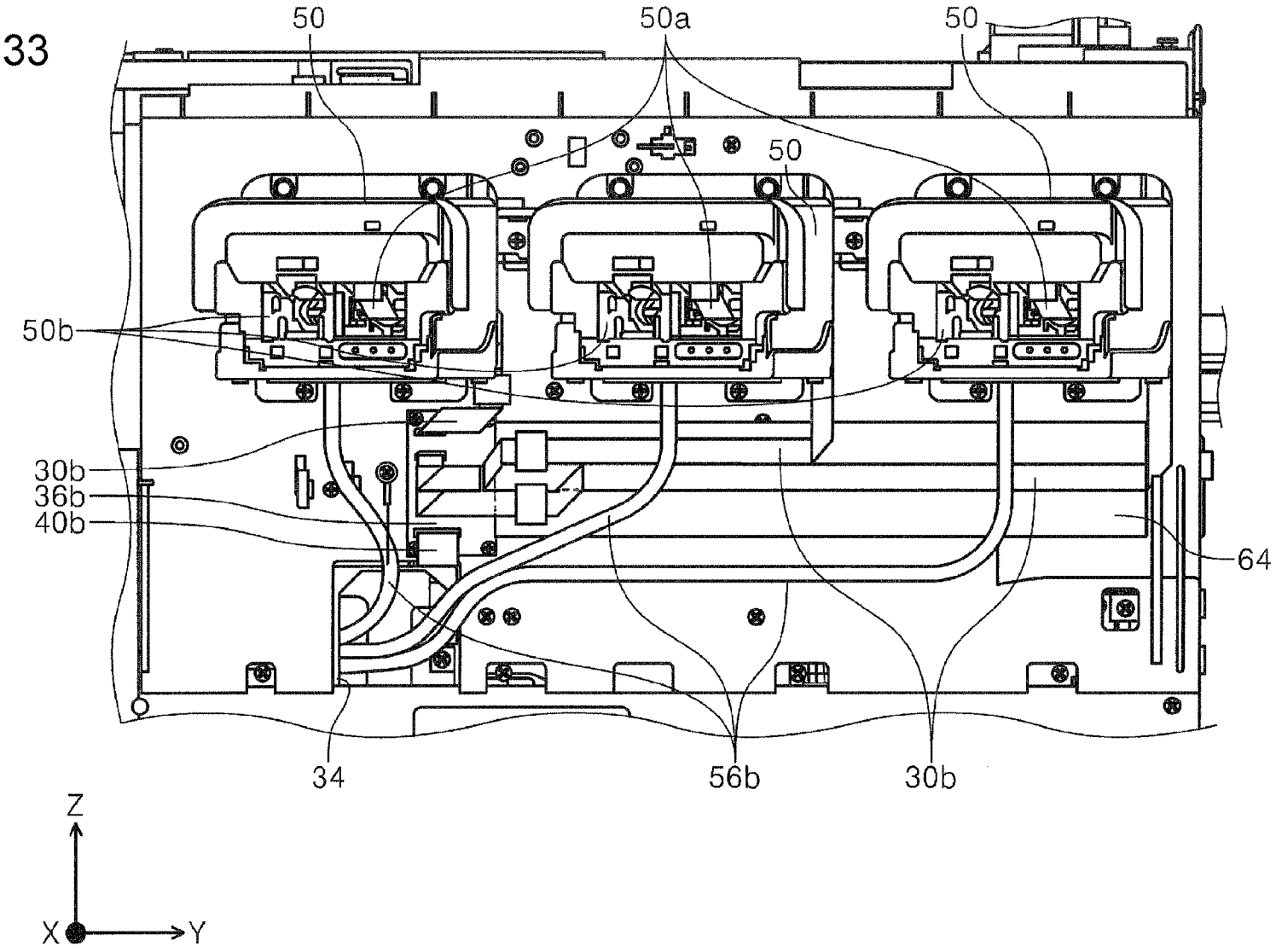
FIG. 33 is a side view illustrating the supplying passage of the color ink from the ink accommodating member storage case which stores the ink accommodating member of the color ink to the inside of the housing.
Figure 34:
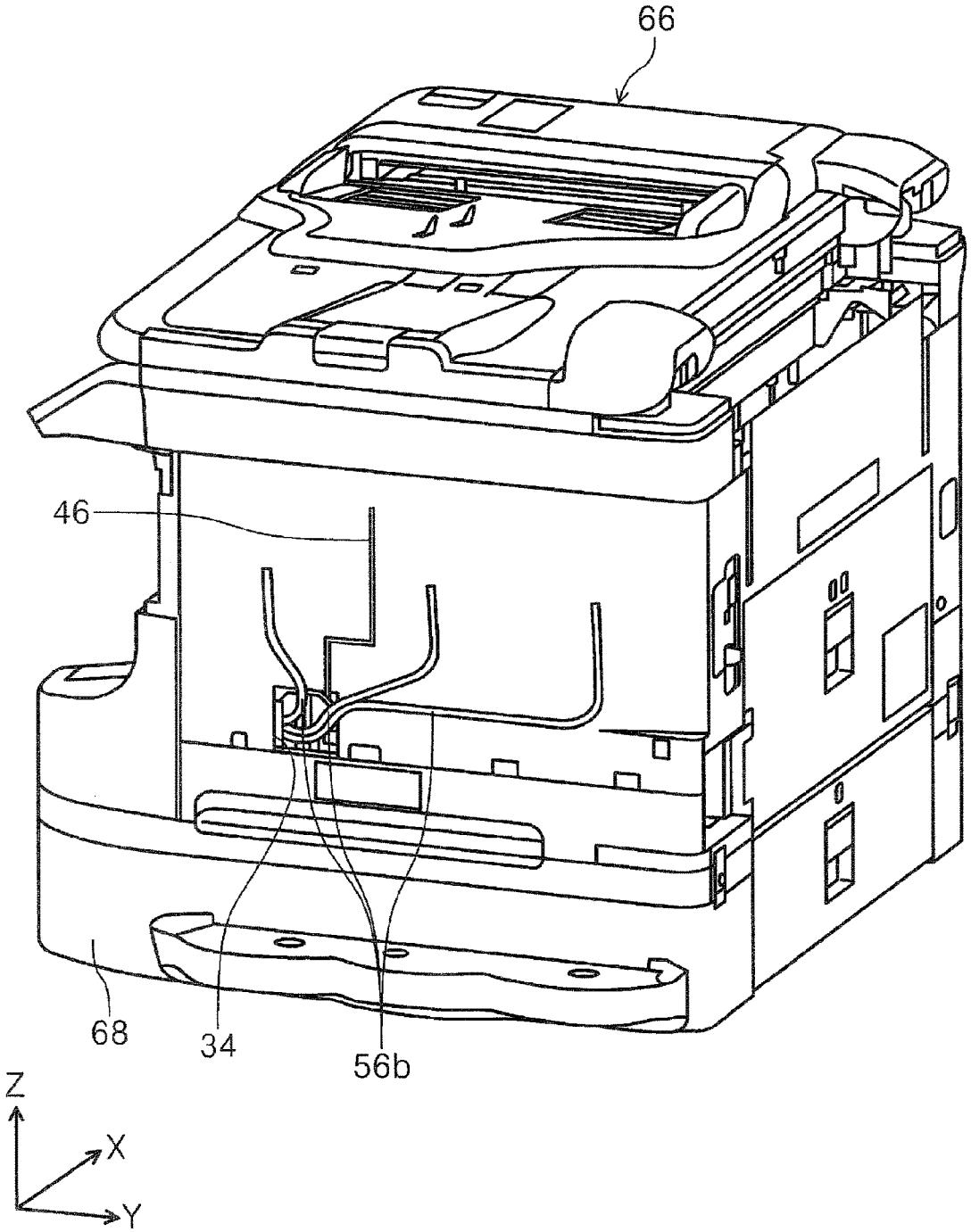
FIG. 34 is a perspective view illustrating an opening which is provided on the side surface of the housing, and guides a plurality of ink tubes of the color ink extending from the ink accommodating member storage case to the inside of the housing.
Figure 35:
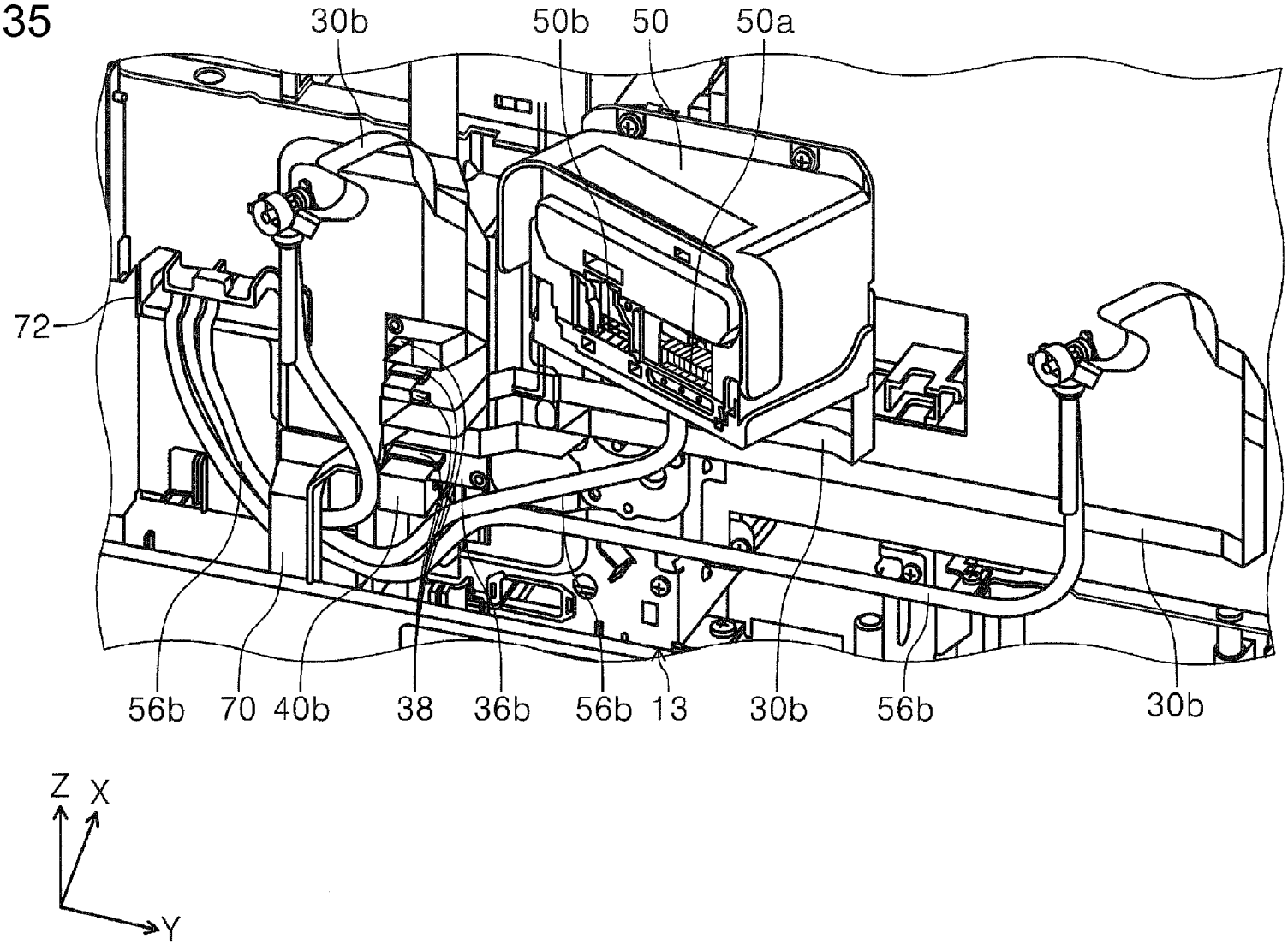
FIG. 35 is a perspective view illustrating handling of the ink tube of the color ink inside the structure of a vicinity of the opening in FIG. 34.

FIG. 31 is an enlarged perspective view of the opening in FIG. 30, FIG. 32 is a view illustrating a handling of the ink tube when the ink relay portion provided inside the structure is seen from the front, FIG. 33 is a side view illustrating the supplying passage of the color ink from the ink accommodating member storage case, which stores the ink accommodating member of the color ink, to the inside of the housing, FIG. 34 is a perspective view illustrating the opening which is provided on a side surface of the housing, and guides a plurality of the ink tubes of the color ink, which extend from the ink accommodating member storage case to the inside of the housing, FIG. 35 is a perspective view illustrating a handling of the ink tube of the color ink inside the structure of a vicinity of the opening in FIG. 34.

Figure 36:
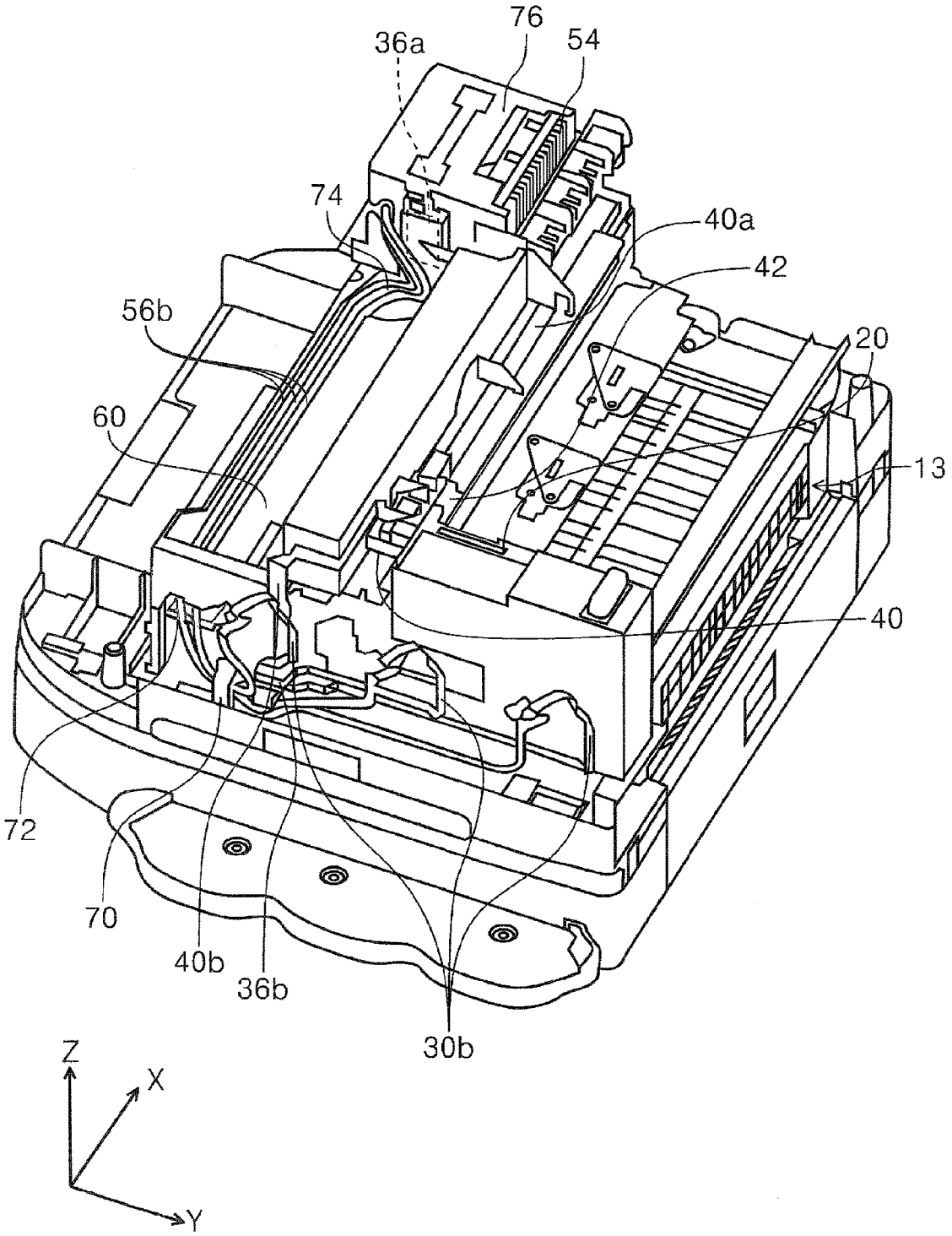
FIG. 36 is a rear side perspective view of the structure in the printer according to the second example.
Figure 37:
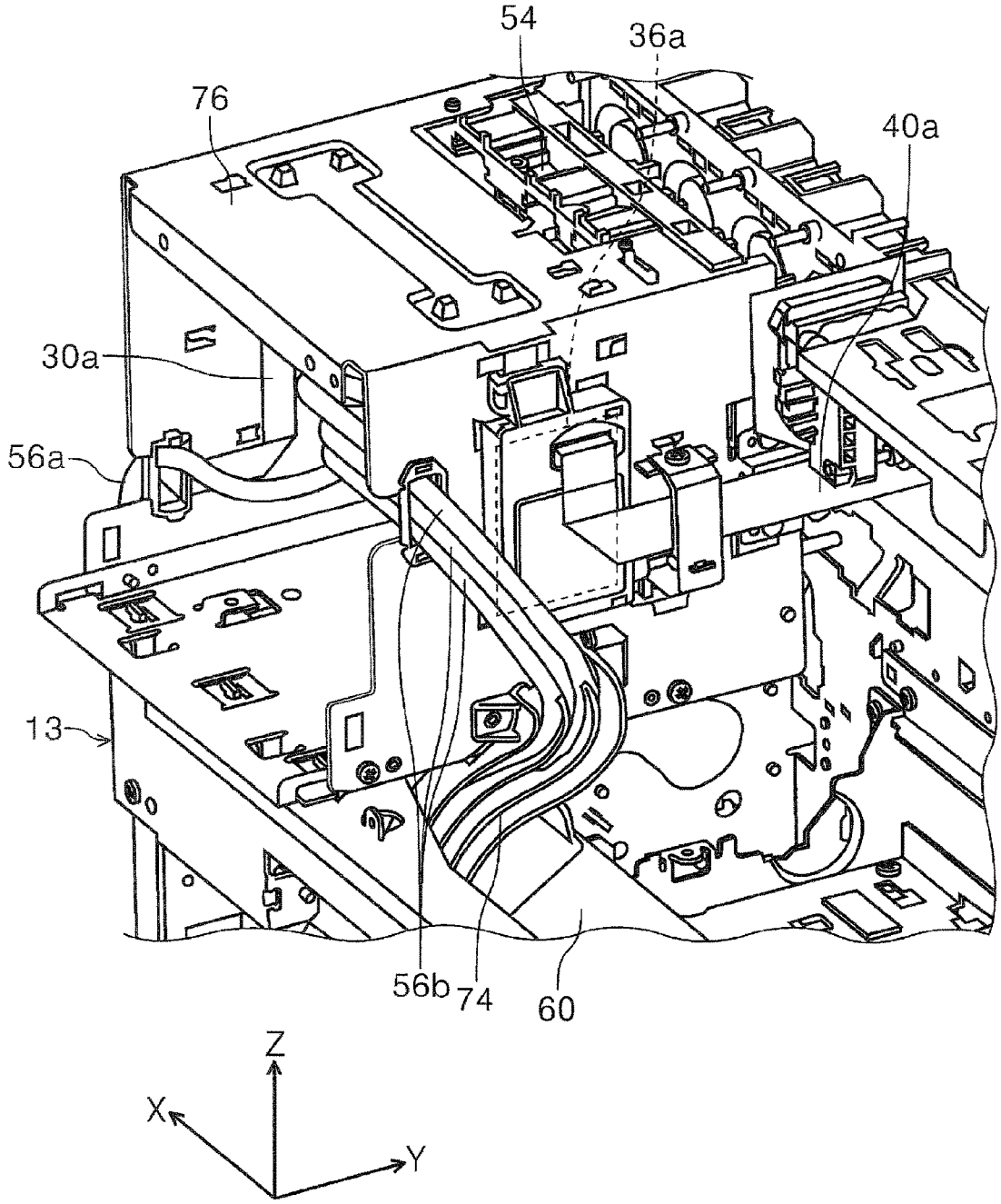
FIG. 37 is a perspective view when seen from a right side of the ink relay portion.
Figure 38:
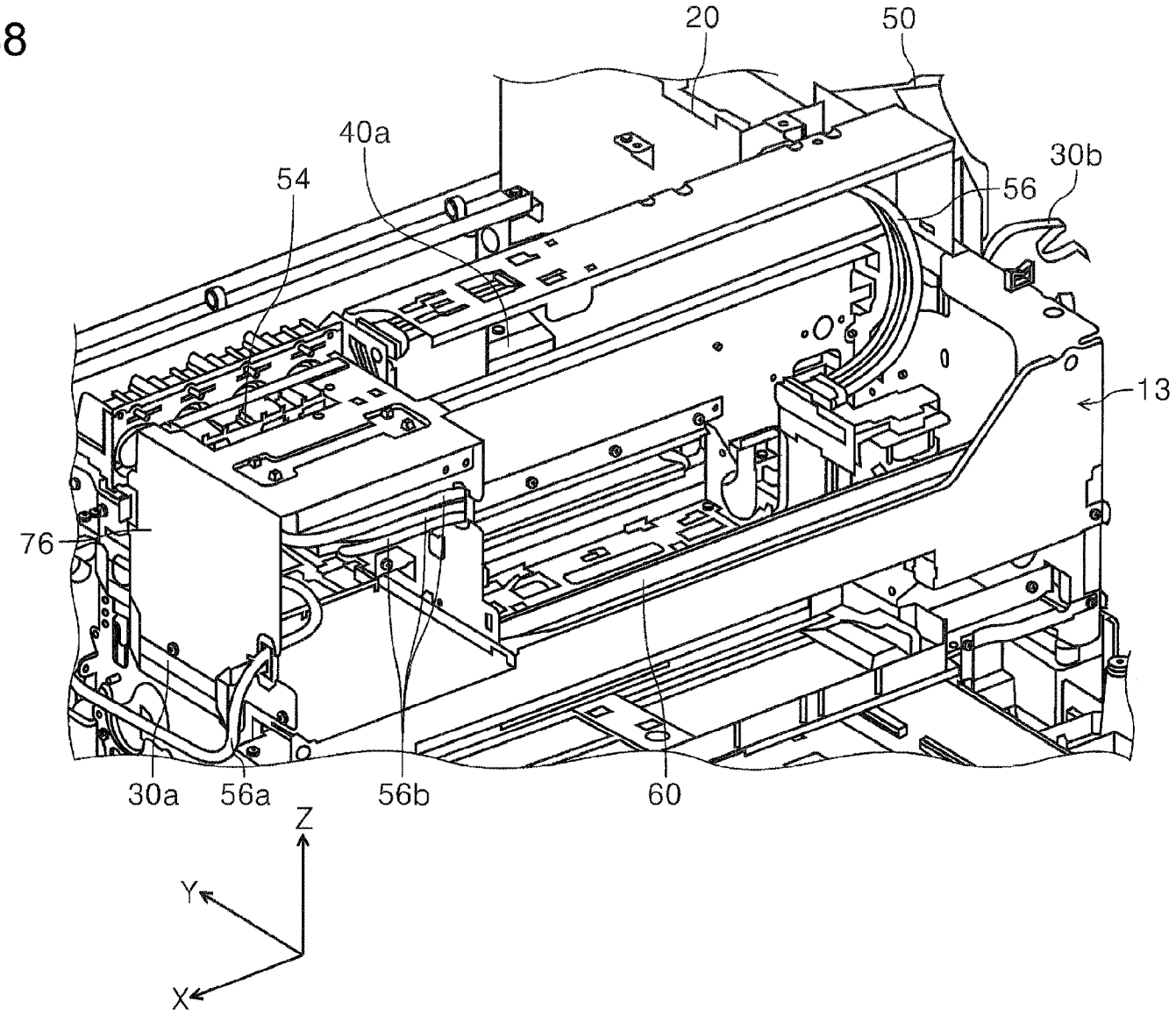
FIG. 38 is a perspective view when a moving region of a carriage and the ink relay portion in the structure are seen from the front.
Figure 39:
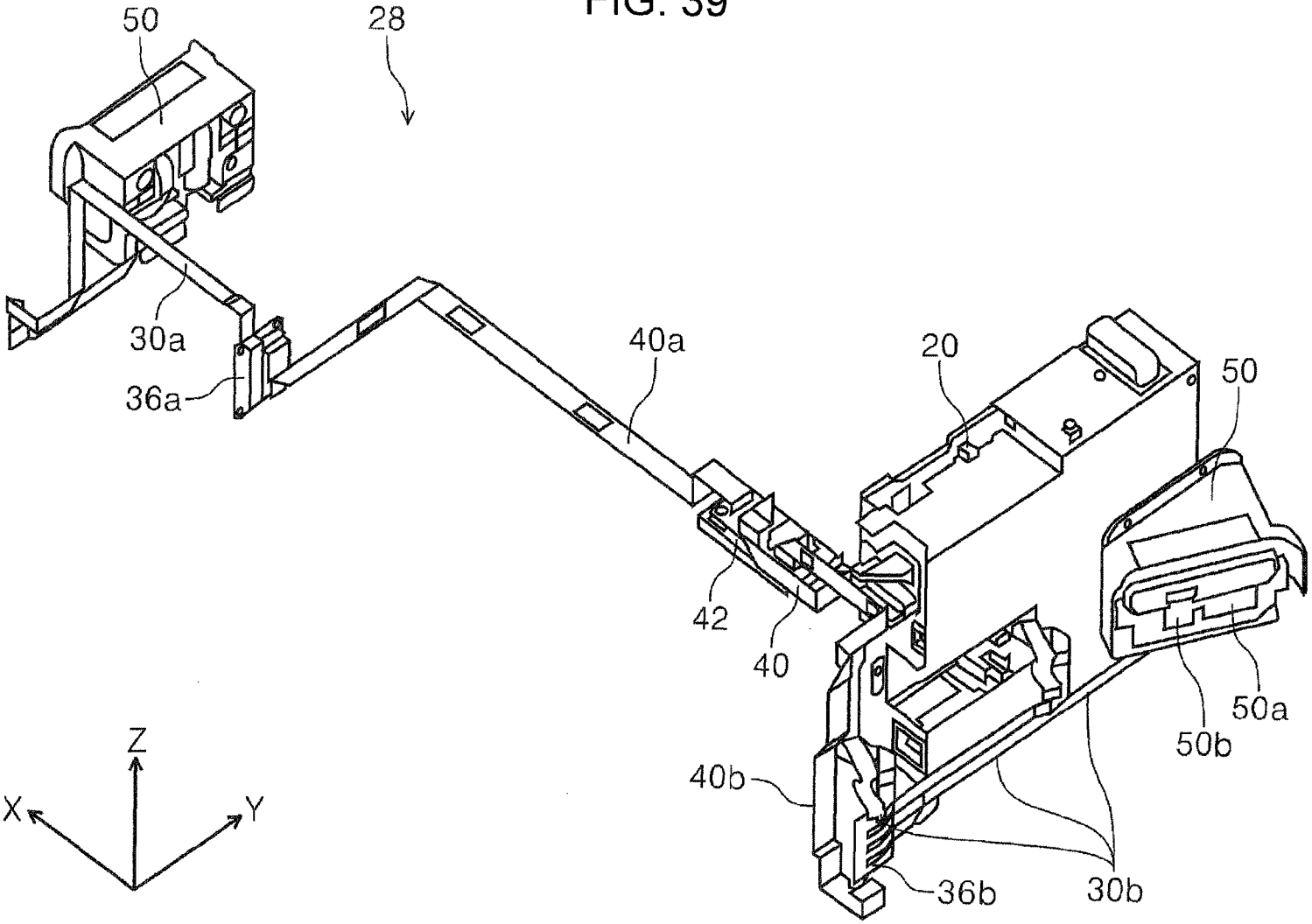
FIG. 39 is a view of a handling of a cable which transmits information from the ink accommodating member in the printer according to the second example when seen from a right side.
Figure 40:
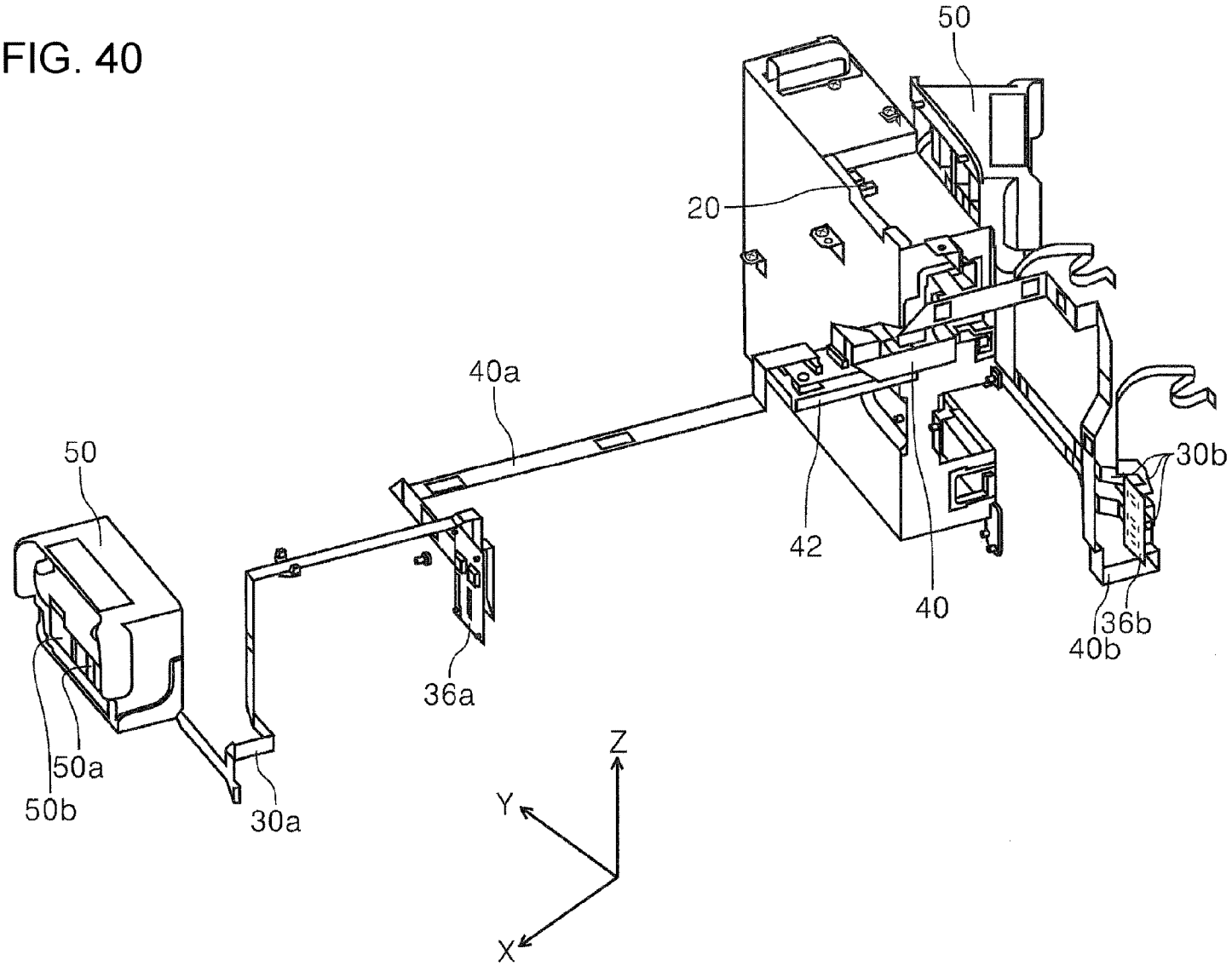
FIG. 40 is a view of the handling of the cable which transmits information from the ink accommodating member in the printer according to the second example when seen from a left side.

FIG. 36 is a rear side perspective view of the structure in the printer 66, FIG. 37 is a perspective view when the ink relay portion is seen from a right side, FIG. 38 is a perspective view when a moving region of the carriage in the structure and the ink relay portion is seen from a forward side, FIG. 39 is a view when the handling of the cable which transmits information from the ink accommodating member in the printer 66 is seen from the right side, and FIG. 40 is a view when the handling of the cable which transmits information from the ink accommodating member in the printer 66 is seen from the left side.

Figure 41:
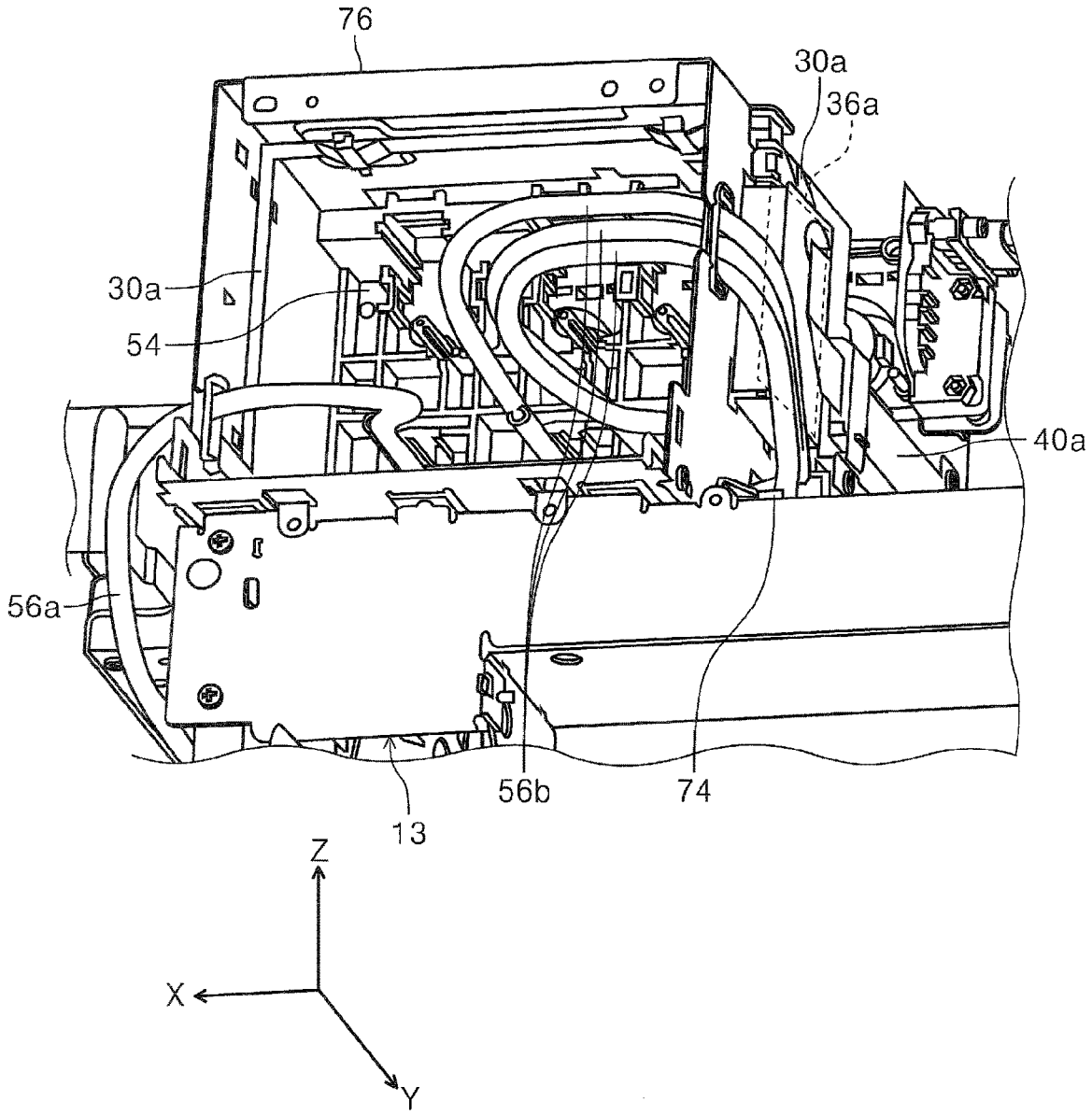
FIG. 41 is a description diagram illustrating the handling of the cable which transmits information of black ink in the ink relay portion.
Figure 42:
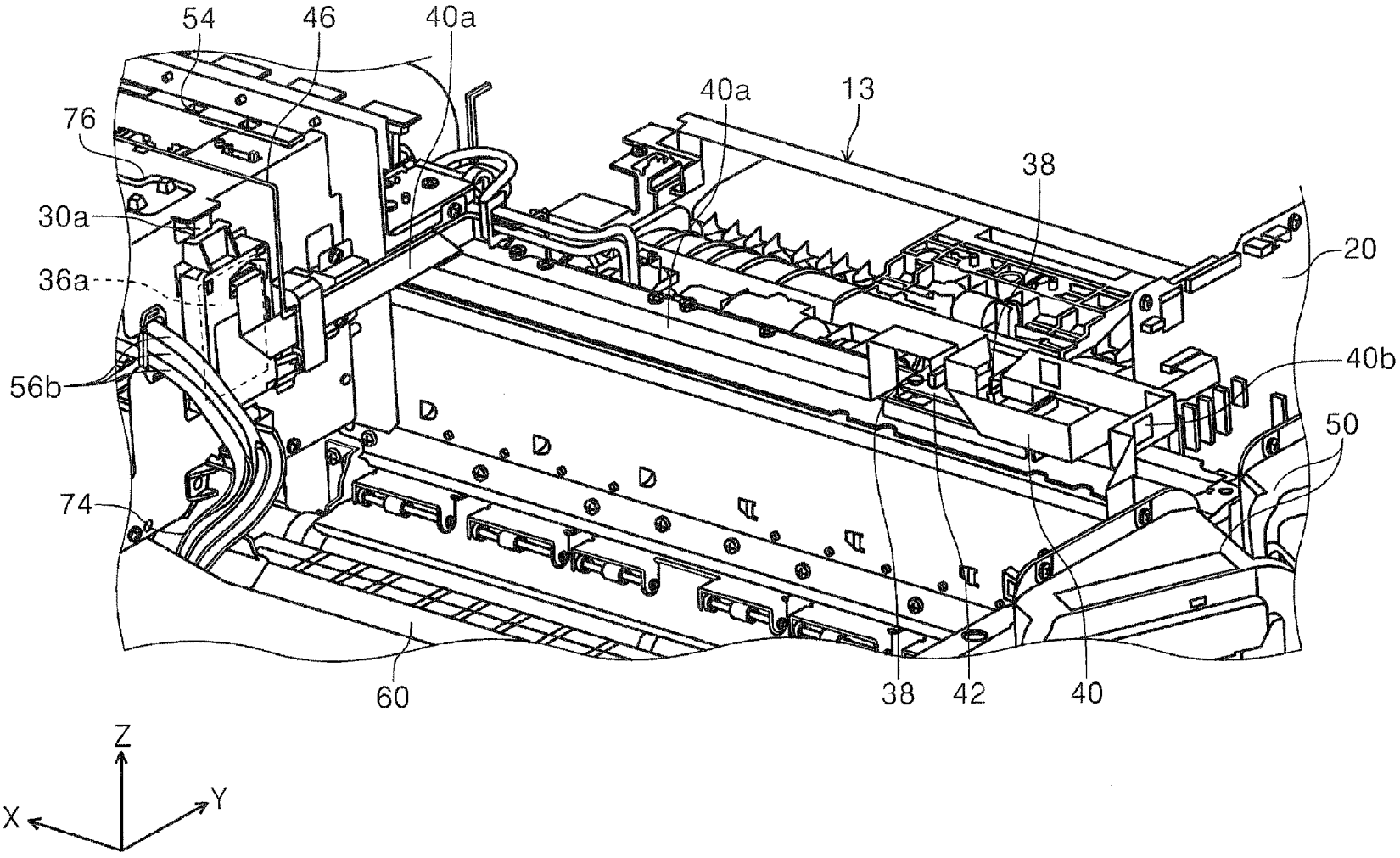
FIG. 42 is a perspective view illustrating the handling of the cable inside a structure.
Figure 43:
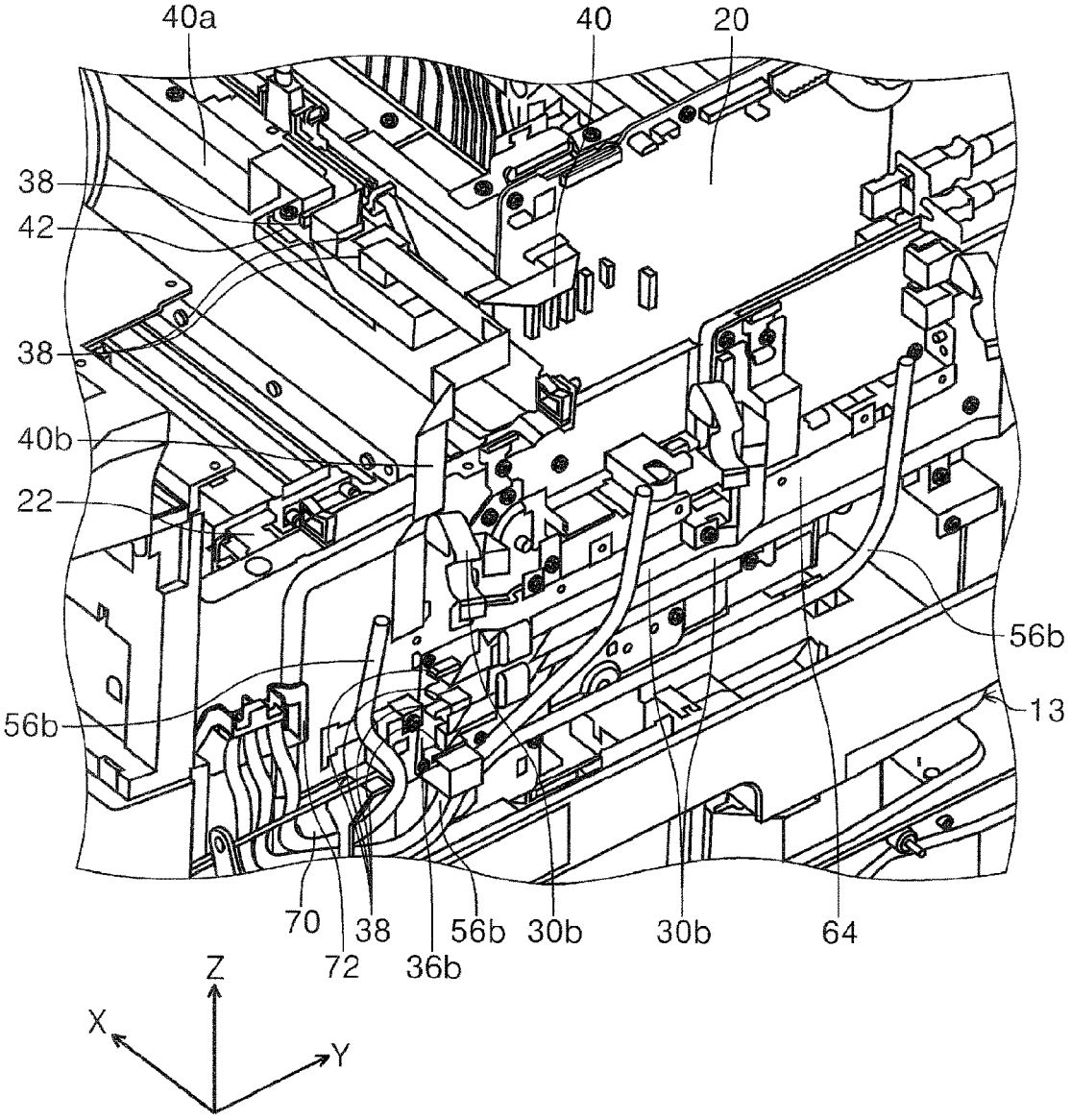
FIG. 43 is a perspective view illustrating the handling of the cable of a vicinity of the controller inside the structure.
Figure 44:
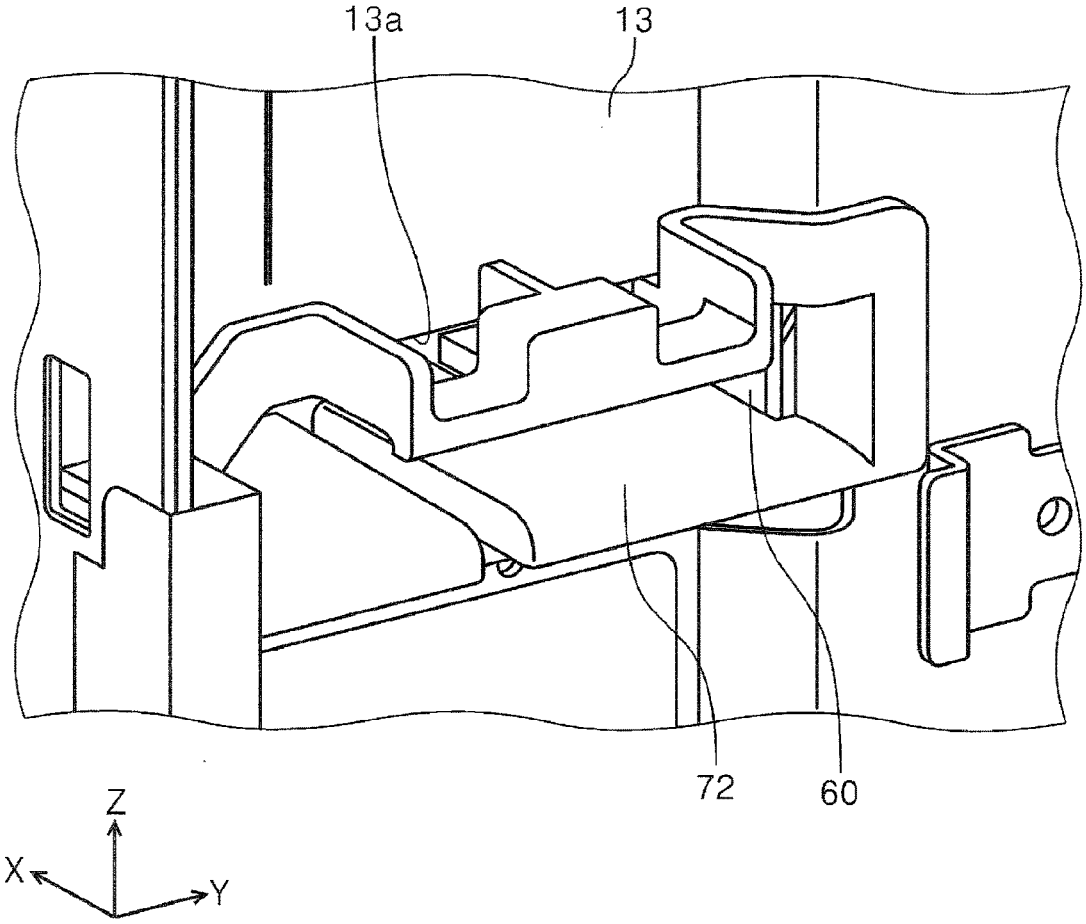
FIG. 44 is an enlarged view of an edge guide which is provided inside the housing and protects the ink tube.
Figure 45:
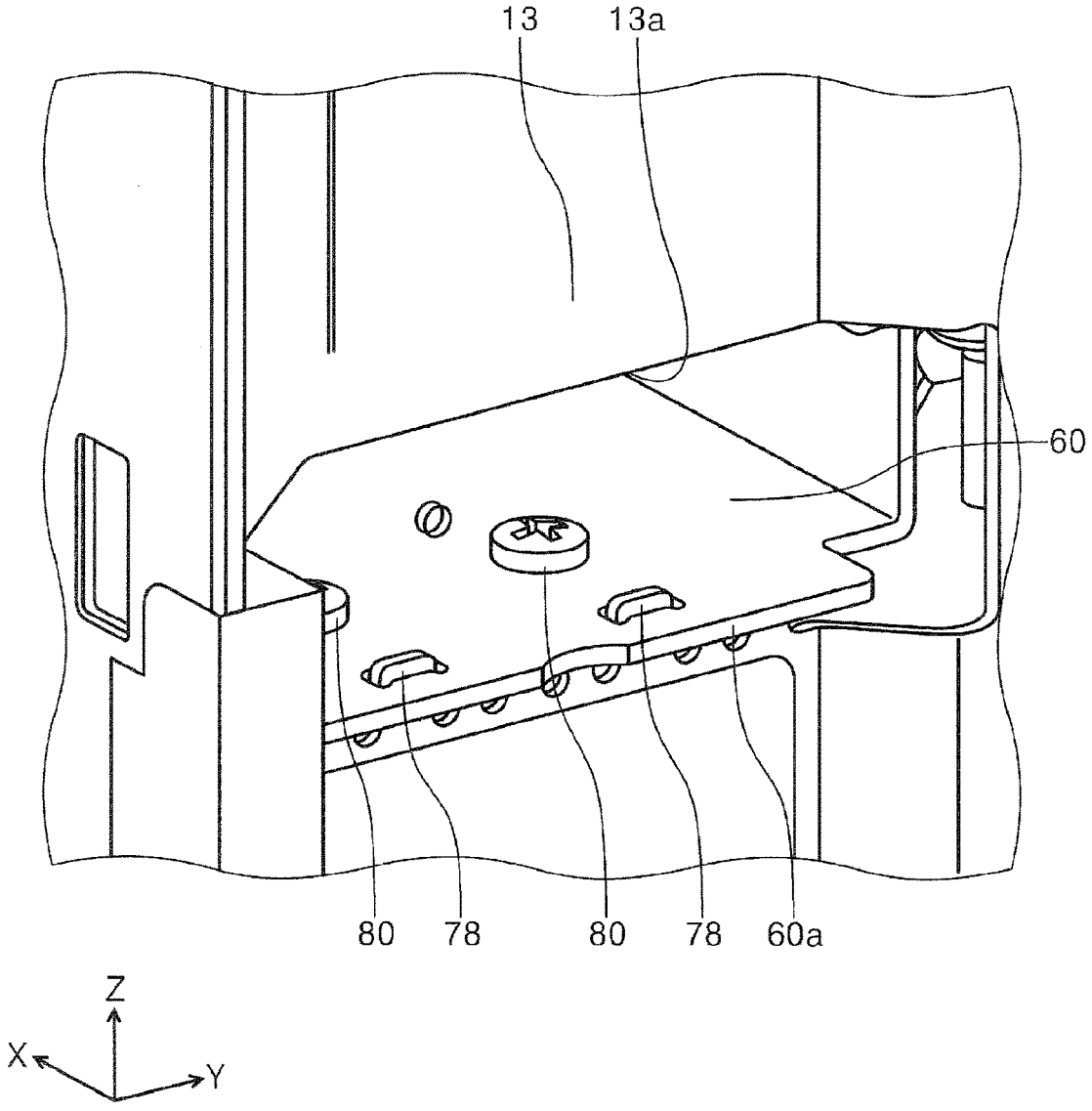
FIG. 45 is a view illustrating a connection portion of a frame in a state in which the edge guide is detached inside the housing.

FIG. 41 is a describing view illustrating the handling of the cable which transmits the information of the black ink inside the ink relay portion, FIG. 42 is a perspective view illustrating the handling of the cable inside the structure, FIG. 43 is a perspective view illustrating the handling of the cable on a vicinity of the controller inside the structure, FIG. 44 is enlarged view of an edge guide which is provided inside the housing, and protects the ink tube, and FIG. 45 is a view illustrating the connection portion of the frame in a state in which the edge guide inside the housing is detached.

In an X-Y-Z coordinate system illustrated in each drawing, an X direction indicates the scanning direction of the recording head, a Y direction indicates the depth direction and the paper transportation direction of the recording apparatus, a Z direction indicates a direction where a distance (gap) between the recording head and paper is change, that is, an apparatus height direction. Moreover, in each drawing, a −Y direction is set to a forward side of an apparatus side, and a +Y direction side is set to a rear side of the apparatus.

The printer 66 according to the second example is illustrated with reference to FIG. 27. The printer 66 also includes the ink accommodating member storage cases 16 and 18 on the outside of the housing 68, that is, an end portion of the +X axis direction side and an end portion of the −X axis direction side. Moreover, since the ink accommodating member storage cases 16 and 18 have the same configuration as that of the first example, description thereof will be omitted.

<<<Regarding Supplying Passage of Ink>>>

With reference to FIG. 28 and FIG. 29, the ink relay portion 54 is provided inside the structure 13. In the ink relay portion 54, the connection portion 54*a* for connecting the ink tube 56, which supplies the ink from the ink accommodating member 14 corresponding to each color of black, magenta, cyan, and yellow, is provided in multiple. Also, in FIG. 28, the ink supplying passage (ink accommodating member storage case 18 to ink relay portion 54) of color side is omitted, and in FIG. 29, the attaching portion 50 on the ink supplying passage of black side is omitted. In addition, in FIG. 29, only one of the three attaching portions 50 respectively corresponding to color ink is described.

The ink tube 56 corresponding to each color of black, magenta, cyan, and yellow extends from the ink relay portion 54 toward the carriage 22. The plurality of ink tubes 56 between the ink relay portion 54 and the carriage 22 are arrayed in parallel in the Y axis direction in FIG. 28 and FIG. 29, and are configured to follow a movement of the X axis direction in FIG. 28 and FIG. 29 of the carriage 22. Specifically, the plurality of ink tubes 56 as illustrated in FIG. 38 are disposed so that a bending portion of the ink tube 56 according to a movement of the carriage 22 is formed in the Z axis direction.

In addition, the ink tubes 56*a* and 56*b* corresponding to the color ink of each color (black, magenta, cyan, and yellow) are connected to the connection portion 54*a* respectively corresponding to the ink relay portion 54. Therefore, if the ink accommodating member 14 of each color is connected to the attaching portion 50 of the ink accommodating member storage cases 16 and 18, ink can be supplied to the recording head 24 through the ink relay portion 54 by the ink tubes 56*a* and 56*b*.

Even in the example with reference to FIG. 30 or FIG. 31, the opening 34 is provided on a side surface of the +X axis direction side of the housing 68. In addition, the opening 34 is provided on a position facing the opening 32 of the ink accommodating member storage case 16 in the same manner as that of the first example.

In addition, the ink tube 56*a*, which is connected to the ink supply port 50*b* provided inside the ink accommodating member storage case 16, is guided to the inside of the housing 68 through the opening 32 and the opening 34. The ink tube 56*a* guided to the inside of the housing 68 is connected to the connection portion 54*a* corresponding to the ink relay portion 54.

With reference to FIG. 33 and FIG. 34, the attaching portion 50 corresponding to the ink accommodating member 14 of each color of magenta, cyan, and yellow is provided on inside the ink accommodating member storage case 18. the ink tube 56*b* respectively extends toward the opening 32 which is provided the ink accommodating member storage case 18, and the opening 34 which is disposed on the −X axis direction side of the housing 68, from the ink supply port 50*b* of each of the attaching portions 50. Moreover, the opening 34 faces the opening 32 even in the example.

With reference to FIG. 36 or FIG. 38, the ink tube 56*b* which extends from the opening 34 to the inside of the housing 68 go through the position determining member 70 provided on an end portion of the −X axis direction side inside the structure 13, and then passes through the edge guide 72. Each of the ink tubes 56*b* which passes through the edge guide 72 extends from the −X axis direction side to the +X axis direction side on an upper surface of the frame 60 extending in the X axis direction in the −Y axis direction side (front side) of the structure 13.

Here, with reference to FIG. 44 and FIG. 45, the edge guide 72 will be described. As illustrated in FIG. 45, the frame 60 (refer to FIG. 36 and FIG. 42) extending in the X axis direction in the structure 13 is determined to be positioned by a position determining portion 78 on an end portion of the −X axis direction side of the structure 13, and then, is attached to an end portion of the −X axis direction side of the structure 13 in a fastening member 80.

If the ink tube 56*b* passes through on the upper surface of the frame 60 from the −X axis direction side toward the +X axis direction side in a state in which the frame 60 is bonded to the end portion of the −X axis direction side of the structure 13, there is a concern that the ink tube 56*b* is damaged by being adjacent to an edge of an end surface 60*a* of the end portion of the −X axis direction side of the frame 60 or an edge 13*a* in the end portion of the −X axis direction side of the structure 13, or the ink tube 56*b* is damaged when the ink tube 56*b* is adjacent to the position determining portion 78 or the fastening member 80.

The edge guide 72 is attached in the end portion of the −X axis direction side of the structure 13 so as cover the edge 13*a* and the edge of the end surface 60*a* of the frame 60. In addition, when the edge guide 72 is mounted on the end portion of the −X axis direction side of the structure 13, the position determining portion 78 or the fastening member 80 is also covered. Accordingly, since the ink tube 56*b* extends in the +X axis direction on the frame 60 through the inside of the edge guide 72, it is prevent that the ink tube 56*b* is adjacent to these members or the edge, and therefore, a concern of a damage of the ink tube 56*b* can be reduced.

As illustrated in FIG. 32, FIG. 36, or FIG. 38, the ink tube 56*b*, which extends in the +X axis direction side on the frame 60, is bent in the +Z axis direction from the upper part of the frame 60 by a slider member 74 disposed in the −X axis direction side of the ink relay portion 54, and is respectively connected to the connection portion 54*a* corresponding to the ink relay portion 54. The slider member 74 is a member which guides the ink tube 56*b* from the upper part of the frame 60 to the ink relay portion 54 while a minimum curvature is maintained so that an ink passage of the ink tube 56*b* is not crushed.

<<<Regarding Electric Wiring>>>

Next, with reference to FIG. 31, FIG. 33 or FIG. 37, FIG. 39 or FIG. 43, the electric wiring 29, which is electrically connected to the CSIC substrate 28 of each ink accommodating member 14 accommodated inside the ink accommodating member storage cases 16 and 18 and extends to the controller 20, will be described.

With reference to FIG. 39 and FIG. 40, the flat cable 30*a* of nine cores, which is connected to the connection portion 50*a* corresponding to the black ink of the ink accommodating member storage case 16 (illustration for describing is omitted in FIG. 24 and FIG. 25), is connected to the relay substrate 36*a* disposed inside the structure 13. The flat cable 40*a* of 15 cores extends to the confluence substrate 42 from the relay substrate 36*a*, and is connected to the confluence substrate 42.

Meanwhile, the flat cable 30*b* of nine cores, which is connected to each of the connection portion 50*a* corresponding to the color ink of the ink accommodating member storage case 18 (illustration for describing is omitted in FIG. 24 and FIG. 25), is connected to the relay substrate 36*b* disposed inside the ink accommodating member storage case 18. The flat cable 40*b* of 15 cores extends toward the confluence substrate 42 provided inside the structure 13 from the relay substrate 36*b*, and is connected to the confluence substrate 42. Also, in FIG. 39 and FIG. 40, only one of three attaching portions 50 corresponding to the color ink is illustrated.

One flat cable 40 extends toward the controller 20 from the confluence substrate 42. That is, the confluence substrate 42 and the controller 20 are connected to each other by one flat cable 40.

First, the electric wiring from the ink accommodating member storage case 16 through the relay substrate 36*a* to the confluence substrate 42 will be described with reference to FIG. 31, FIG. 41, or FIG. 43. The flat cable 30*a* of nine cores, which is electrically connected to the CSIC substrate of the ink accommodating member accommodating the black ink through the connection portion 50*a*, extends the inside of the housing 68 through the opening 32 and the opening 34 from the inside of the ink accommodating member storage case 16. Moreover, the flat cable 30*a* is wired along the conductive member 64 in the inside of the ink accommodating member storage case 16.

In addition, as illustrated in FIG. 41 and FIG. 42, in the ink relay portion 54 positioned on an end portion of the +X axis direction side of the structure 13, the cover 76 is provided to cover three ways of the +X axis direction, the −X axis direction, and the +Z axis direction. The cover 76 in the example is constituted by a conductive material.

The flat cable 30*a* pulled out to the inside the structure 13 extends along an inner wall of the +X axis direction side and an inner wall of the +Z axis direction side of the cover 76, and is connected to the relay substrate 36*a* which is provided on an external wall of the −X axis direction side of the cover 76. The flat cable 30*a* transmits the analog signal and the digital signal from the CSIC substrate 28 to the relay substrate 36*a*. In addition, an analog signal in the relay substrate 36*a* is converted to a digital signal.

The flat cable 40*a* of 15 cores extends toward the +Y axis direction from the relay substrate 36*a*, which is provided on an outer wall of the cover 76. Also, the flat cable 40*a* is positioned on the +Y axis direction side of the carriage 22, extends in the −X axis direction side by changing a direction in the upper part of the frame extending in the X axis direction, and is connected to the confluence substrate 42 provided on the upper portion of the frame.

Next, the electric wiring, which corresponds to the CSIC substrate 28 of the ink accommodating member 14 of the color ink from the ink accommodating member storage case 18 through the relay substrate 36*b* to the confluence substrate 42, will be described. With reference to FIG. 33 and FIG. 35, one end of the flat cable 30*b* of nine cores is respectively connected to the connection portion 50*a* of the attaching portion 50 corresponding to each of colors (magenta, cyan, and yellow) inside the ink accommodating member storage case 18, and the other end thereof is respectively connected to the relay substrate 36*b* disposed inside the ink accommodating member storage case 18. That is, the plurality of the flat cables 30*b* are connected to the relay substrate 36*b*. Also, in FIG. 35, only one the three attaching portions 50 corresponding to the color ink is illustrated.

Moreover, the flat cable 30*b* corresponding to the color ink of each color in the example transmits an analog signal and a digital signal from the connection portion 50*a* to the relay substrate 36*b*. Even in the relay substrate 36*b* disposed on the ink accommodating member storage case 18, the analog signal is converted to the digital signal.

In addition, the conductive member 64 extending in the Y axis direction is disposed inside the ink accommodating member storage case 18. The flat cables 30*b* extending from the connection portion 50*a* corresponding to the color ink of magenta and cyan to the relay substrate 36 is wired in parallel on the conductive member 64 without being overlapped. Therefore, the plurality of the flat cables 30*b* does not receive influence of noise from each other, or is capable of reducing the influence of noise.

In addition, the relay substrate 36*b* is fixed to a vicinity of the opening 32. Also, the flat cable 40*b* of 15 cores is guided to the inside of the structure 13 from the relay substrate 36*b* through the opening 32 and the opening 34. Here, the flat cable 30*b* and the flat cable 40*b* are attached to be detachable from the relay substrate 36*b* by the connector 38.

The flat cable 40*b* of 15 cores extends from the relay substrate 36*b* to the inside of the structure 13 through the opening 32 and the opening 34. As illustrated in FIG. 36 and FIG. 43, the flat cable 40*b* extends in the +Z axis direction in the end portion of the −X axis direction side of the structure 13. Also, the flat cable 40*b* extends to the confluence substrate 42 along the frame inside the structure 13, and is connected to the confluence substrate 42.

In addition, as illustrated in FIG. 36, FIG. 42, and FIG. 43, in the confluence substrate 42, the flat cable 40*a*, which extends from the relay substrate 36*a* provided inside the structure 13, and the flat cable 40*b*, which extends from the relay substrate 36*b* which is provided inside the ink accommodating member storage case 18, are joined. That is, the two flat cables 40*a* and 40*b* in the confluence substrate 42 are electrically organized in the flat cable 40. Also, one flat cable 40, which extends from the confluence substrate 42, is connected to the controller 20 provided on an end portion of the −X axis direction side in inside the structure 13.

In addition, illustration is omitted in the example, but the opening and closing detection sensors 44 and 44 are respectively provided inside the ink accommodating member storage cases 16 and 18. The opening and closing detection sensor 44 and the controller 20 are electrically connected to each other by the cable 46. Therefore, the detection signal of the opening and closing detection sensor 44 is transmitted to the controller 20, and the controller 20 controls a recording operation based on the detection signal.

Modification Example of First Example and Second Example (1) In the example, the cable 46, which extends from the opening and closing detection sensor 44, is configured to surround the inside of the structure 13 connected the ink accommodating member storage cases 16 and 18 and connected to the controller 20 as it is; however, instead of this configuration, a configuration may be used in which the cable 46 is configured with two cables of a cable on the controller side and a cable on the case side and to be detachable from the connection portion. Here, the connection portion can be disposed on a vicinity of the openings 32 and 34. In addition, the connection portion is capable of adopting a configuration in which these two cables are connected by a relay substrate, a connector, or the like. According to this configuration, workability when the ink accommodating member storage cases 16 and 18 is detached from the apparatus main body 12 can be improved.

(2) In addition, in the example, a configuration is used in which the ink accommodating member 14 accommodated inside the ink accommodating member storage cases 16 and 18 can be exchanged in a state in which the covers 19 and 19 of the ink accommodating member storage cases 16 and 18 are opened, but instead of this configuration, a configuration may be used in which the ink accommodating member 14 accommodated inside the ink accommodating member storage cases 16 and 18 can be replenished in a state in which the covers 19 and 19 of the ink accommodating member storage cases 16 and 18 are opened.

To summarize the above description, the printers 10 and 66 in the example are provided with the recording head 24 which is capable of discharging ink with respect to a medium, the controller 20 which controls the recording head 24, the housings 26 and 68 which cover the structure 13 providing with the recording head 24 and the controller 20, the ink accommodating member storage cases 16 and 18 which store the ink accommodating member 14 accommodating ink and the CSIC substrate 28 holding information of the ink accommodating member 14, and are attached to the outside of the housings 26 and 68, the ink tubes 56*a* and 56*b* which guide ink from the ink accommodating member 14 to the outside of the housings 26 and 68, and the electric wiring 29 which electrically connects the controller 20 and the CSIC substrate 28. The electric wiring 29 includes the relay substrates 36*a* and 36*b* which are connected to the flat cables 30*a*, 30*b*, 40*a*, and 40*b*, the flat cables 40*a* and 40*b* which constitute wiring of the controller 20 side with respect to the relay substrates 36*a* and 36*b*, and the flat cables 30*a* and 30*b* which constitute wiring of the CSIC substrate 28 side with respect to the relay substrates 36*a* and 36*b*. At least one of the flat cables 40*a* and 40*b* and the flat cables 30*a* and 30*b* can be connected to or separated from the relay substrates 36*a* and 36*b*. The opening 32 is formed on the ink accommodating member storage cases 16 and 18 through the flat cables 30*a* and 30*b*. The relay substrate 36*b* is provided between the opening 32 and the CSIC substrate 28.

The printers 10 and 66 in the example are provided with the recording head 24 which is capable of discharging ink with respect to a medium, the controller 20 which controls the recording head 24, the housings 26 and 68 which cover the structure 13 providing with the recording head 24 and the controller 20, the ink accommodating member storage cases 16 and 18 which store the ink accommodating member 14 accommodating ink and the CSIC substrate 28 holding information of the ink accommodating member 14, and are attached to the outside of the housings 26 and 68, the ink tubes 56*a* and 56*b* which guide ink from the ink accommodating member 14 to the outside of the housings 26 and 68, and the electric wiring 29 which electrically connects the controller 20 and the CSIC substrate 28. The electric wiring 29 includes the relay substrates 36*a* and 36*b* which are connected to the flat cables 30*a*, 30*b*, 40*a*, and 40*b*, the flat cables 40*a* and 40*b* which constitute wiring of the controller 20 side with respect to the relay substrates 36*a* and 36*b*, and the flat cables 30*a* and 30*b* which constitute wiring of the CSIC substrate 28 side with respect to the relay substrates 36*a* and 36*b*. At least one of the flat cables 40*a* and 40*b* and the flat cables 30*a* and 30*b* can be connected to or separated from the relay substrates 36*a* and 36*b*. The opening 34 through the flat cables 30*a* and 30*b* is formed on the housings 26 and 68. The relay substrate 36*a* is provided between the opening 34 and the controller 20.

The relay substrates 36*a* and 36*b* are configured with the circuit substrate. In addition, the printers 10 and 66 are provided with a plurality of the ink accommodating members 14 inside the ink accommodating member storage case 18. The CSIC substrate 28 and the flat cable 30*b* are provided in each of the plurality of ink accommodating members 14. The relay substrate 36*b* is capable of connecting the plurality of the flat cables 30*b* and one flat cable 40*b*, and transmitting and receiving of the information between the plurality of the CSIC substrates 28 and the controller 20 are relayed using one flat cable 40.

The relay substrate 36*b* is fixed to the inside of the opening 32. The plurality of the flat cables 30*b* are wired in parallel without being overlapped inside the ink accommodating member storage case 18. The relay substrates 36*a* and 36*b* are constituted by the connector 38.

In addition, the flat cables 30 and 40, the relay substrate 36, and the confluence substrate 42 are applied to the ink jet printer as an example of the recording apparatus, but can be also applied to the other liquid discharging apparatuses in general.

Here, a liquid discharging apparatus is not limited to a recording apparatus such as a printer, a copy machine, and facsimile, which performs recording on a recording medium by discharging ink using an ink jet type recording head from the recording head, and includes an apparatus which discharges liquid with a purpose corresponding to of ink, instead, from a liquid discharging head corresponding to the ink jet type recording head onto a medium receiving the discharged ink corresponding to the recording medium, and allows the liquid to be attached to the medium receiving the discharged ink.

As the liquid discharging head, in addition to the recording head, a color material discharging head used for manufacturing a color filter of a liquid crystal display, or the like, an electrode material (conductive paste) discharging head used for forming an electrode such as an organic EL display or a field emission display (FED), a bio organic material discharging head used for manufacturing a bio chip, a sample discharging head as a precision pipette, and the like are used.

Moreover, the invention is not limited to the above examples, various modifications can be performed within a range of the invention disclosed in claims, and it is needless to say that those modification examples are also included in the range of the invention.

REFERENCE SIGNS LIST

10, 66 PRINTER
12 APPARATUS MAIN BODY
13 STRUCTURE
13*a* EDGE
14 INK ACCOMMODATING MEMBER
14*a* ATTACHING PORTION
16, 18 INK ACCOMMODATING MEMBER STORAGE CASE
19 COVER, TANK UNIT
20 CONTROLLER
22 CARRIAGE
24 RECORDING HEAD
26, 68 HOUSING, RECORDING UNIT
28 CSIC SUBSTRATE
29 ELECTRIC WIRING
30*a*, 30*b*, 40*a*, 40*b* FLAT CABLE
32, 34 OPENING
36*a*, 36*b* RELAY SUBSTRATE
38 CONNECTOR
42 CONFLUENCE SUBSTRATE
44 OPENING AND CLOSING DETECTION SENSOR
44*a* SWITCH
46 CABLE
48 INK SUPPLYING PORTION
50 ATTACHING PORTION
50*a*, 54*a* CONNECTION PORTION
50*b* INK SUPPLY PORT
52 ENGAGEMENT PORTION
54 INK RELAY PORTION
56, 56*a*, 56*b* INK TUBE
58 CLAMP MEMBER
60 FRAME
60*a* END SURFACE
62 COVER MEMBER
64 CONDUCTIVE MEMBER
70 POSITION DETERMINING MEMBER
72 EDGE GUIDE
74 SLIDER MEMBER
76 COVER
78 POSITION DETERMINING PORTION
80 FASTENING MEMBER

The entire disclosure of Japanese Patent Application No. 2014-050941, filed Mar. 14, 2014 is expressly incorporated by reference herein.

The invention claimed is:

1. A recording apparatus comprising:
a recording head that is capable of discharging liquid onto a medium;
a controller that controls the recording head;
a housing that covers a structure including the recording head and the controller;
a case that stores a liquid accommodating member accommodating the liquid and an electronic component holding information of the liquid accommodating member, and is attached to the outside of the housing;
a tube that guides the liquid from the liquid accommodating member to the inside of the housing; and
an electric wiring that electrically connects the controller and the electronic component,
wherein the electric wiring includes a connection portion which connects cables, a cable on the controller side which constitutes a wiring of the controller side with respect to the connection portion, and a cable on the electronic component side which constitutes a wiring of the electronic component side with respect to the connection portion,
wherein at least one of the cable on the controller side and the cable on the electronic component side is able to be connected to and disconnected from the connection portion,
wherein an opening through which the electric wiring passes is formed in the case, and
wherein the connection portion is provided between the opening and the electronic component.

2. A recording apparatus comprising:
a recording head that is capable of discharging liquid onto a medium;
a controller that controls the recording head;
a housing that covers a structure including the recording head and the controller;
a case that stores a liquid accommodating member accommodating the liquid and an electronic component holding information of the liquid accommodating member, and is attached to the outside of the housing;
a tube that guides the liquid from the liquid accommodating member to the inside of the housing; and
an electric wiring that electrically connects the controller and the electronic component, wherein the electric wiring includes a connection portion which connects cables, a cable on the controller side which constitutes a wiring of the controller side with respect to the connection portion, and a cable on the electronic component side which constitutes a wiring of the electronic component side with respect to the connection portion, wherein at least one of the cable on the controller side and the cable on the electronic component side is able to be connected to and disconnected from the connection portion, wherein an opening through which the electric wiring passes is formed in the housing, and wherein the connection portion is provided between the opening and the controller.

3. The recording apparatus according to claim 1 or 2, wherein the connection portion is configured with a circuit substrate.

4. The recording apparatus according to claim 3, wherein a plurality of the liquid accommodating members are provided inside the case, wherein the electronic component and the cable on the electronic component side are provided in each of the plurality of liquid accommodating members, and wherein the circuit substrate is capable of connecting a plurality of the cables on the electronic component side and one cable on the controller side, and relays transmitting and receiving of the information between a plurality of the electronic components and the controller using the one cable on the controller side.

5. The recording apparatus according to claim 4, wherein the circuit substrate is fixed to the inside of the opening.

6. The recording apparatus according to claim 4 or 5, wherein the plurality of cables on the electronic component side are wired in parallel without being overlapped with each other in the inside of the case.

7. A recording apparatus comprising:

a recording head that is capable of discharging liquid onto a medium;

a controller that controls the recording head;

a recording unit that includes the recording head and the controller;

a tank unit that includes a liquid accommodating member accommodating the liquid and an electronic component holding information of the liquid accommodating member;

a tube that guides the liquid from the liquid accommodating member to the inside of the recording unit; and an electric wiring that electrically connects the controller and the electronic component, wherein the electric wiring includes a connection portion which connects cables, a cable on the controller side which constitutes a wiring of the controller side with respect to the connection portion, and a cable on the electronic component side which constitutes a wiring of the electronic component side with respect to the connection portion, wherein at least one of the cable on the controller side and the cable on the electronic component side is able to be connected to and disconnected from the connection portion, wherein an opening through which the electric wiring passes is formed in the tank unit, and wherein the connection portion is provided between the opening and the electronic component.

8. A recording apparatus comprising:

a recording head that is capable of discharging liquid onto a medium;

a controller that controls the recording head;

a recording unit that includes the recording head and the controller;

a tank unit that includes a liquid accommodating member accommodating the liquid and an electronic component holding information of the liquid accommodating member;

a tube that guides the liquid from the liquid accommodating member to the inside of the recording unit; and an electric wiring that electrically connects the controller and the electronic component, wherein the electric wiring includes a connection portion which connects cables, a cable on the controller side which constitutes a wiring of the controller side with respect to the connection portion, and a cable on the electronic component side which constitutes a wiring of the electronic component side with respect to the connection portion, wherein at least one of the cable on the controller side and the cable on the electronic component side is able to be connected to and disconnected from the connection portion, wherein an opening passing through which the electric wiring passes is formed on the recording unit, and wherein the connection portion is provided between the opening and the controller.

9. The recording apparatus according to claim 7 or 8, wherein the connection portion is configured with a circuit substrate.

10. The recording apparatus according to claim 9, wherein a plurality of the liquid accommodating members are provided inside the tank unit, wherein the electronic component and the cable on the electronic component side are provided in each of the plurality of liquid accommodating members, and wherein the circuit substrate is capable of connecting a plurality of the cables on the electronic component side and one cable on the controller side, and relays transmitting and receiving of the information between a plurality of the electronic components and the controller using the one cable on the controller side.

11. The recording apparatus according to claim 10, wherein the circuit substrate is fixed to the inside of the opening.

12. The recording apparatus according to claim 10 or 11, wherein the plurality of cables on the electronic component side are wired in parallel without being overlapped with each other in the inside of the tank unit.

13. The recording apparatus according to any one of claim 1 to 8, wherein the connection portion is configured with a connector.

* * * * *